US009138061B1

(12) United States Patent
Eisenberg

(10) Patent No.: US 9,138,061 B1
(45) Date of Patent: Sep. 22, 2015

(54) SEATING

(71) Applicant: Joel H. Eisenberg, Paulden, AZ (US)

(72) Inventor: Joel H. Eisenberg, Paulden, AZ (US)

( * ) Notice: Subject to any disclaimer, the term of this patent is extended or adjusted under 35 U.S.C. 154(b) by 0 days.

(21) Appl. No.: 14/088,694

(22) Filed: Nov. 25, 2013

Related U.S. Application Data

(60) Provisional application No. 61/733,596, filed on Dec. 5, 2012.

(51) Int. Cl.
*A47C 7/44* (2006.01)
*A47C 7/14* (2006.01)
*A47C 1/023* (2006.01)

(52) U.S. Cl.
CPC . *A47C 7/14* (2013.01); *A47C 1/023* (2013.01); *A47C 7/44* (2013.01)

(58) Field of Classification Search
CPC ..... A47C 7/44; A47C 1/1023; A47C 7/14
USPC ..... 297/337, 353, 317, 318, 296, 297, 298, 297/301.1
See application file for complete search history.

(56) References Cited

U.S. PATENT DOCUMENTS

| | | | | |
|---|---|---|---|---|
| 2,538,507 | A * | 1/1951 | Cramer | 297/301.4 X |
| 2,725,921 | A | 12/1955 | Markin | |
| 3,489,459 | A | 1/1970 | Katan, Sr. et al. | |
| 3,756,654 | A | 9/1973 | Bauer | |
| 3,982,785 | A | 9/1976 | Ambasz | |
| 4,084,850 | A * | 4/1978 | Ambasz | 297/337 X |
| 4,422,690 | A | 12/1983 | Kopich | |
| 4,452,486 | A | 6/1984 | Zapf et al. | |
| 4,491,366 | A | 1/1985 | Silber | |
| 4,761,033 | A | 8/1988 | Lanuzzi et al. | |
| 4,842,333 | A | 6/1989 | Meiller | |
| 5,035,466 | A | 7/1991 | Mathews et al. | |
| 5,150,948 | A | 9/1992 | Volkle | |
| 5,556,163 | A | 9/1996 | Rogers, III et al. | |
| 5,558,399 | A | 9/1996 | Serber | |
| 5,577,811 | A | 11/1996 | Ogg | |
| 5,580,127 | A | 12/1996 | Piretti | |
| 5,944,382 | A | 8/1999 | Ambasz | |
| 6,390,554 | B1 | 5/2002 | Eakins et al. | |
| 6,609,755 | B2 | 8/2003 | Koepke et al. | |
| 6,616,231 | B2 | 9/2003 | Koepke et al. | |
| 6,634,711 | B2 | 10/2003 | Phillips et al. | |
| 6,641,214 | B2 | 11/2003 | Veneruso | |
| 6,655,731 | B2 * | 12/2003 | Martin | 297/337 |

(Continued)

FOREIGN PATENT DOCUMENTS

| | | | |
|---|---|---|---|
| DE | 4239548 | A1 | 4/1993 |
| DE | 4239548 | A1 * | 4/1993 |
| DE | 4239548 | | 2/2015 |

OTHER PUBLICATIONS

Office Action in U.S. Appl. No. 14/088,599, dated May 16, 2014, pp. 1-21.

(Continued)

*Primary Examiner* — Anthony D Barfield
(74) *Attorney, Agent, or Firm* — Fish & Richardson P.C.

(57) ABSTRACT

Among other things, a seat includes a back-supporting surface; and a seating surface movable along a path toward and away from the back-supporting surface. At least part of the back-supporting surface is movable to enable a lower portion of the back-supporting surface to move substantially along the path.

76 Claims, 38 Drawing Sheets

(56) References Cited

U.S. PATENT DOCUMENTS

| | | | | |
|---|---|---|---|---|
| 6,669,292 | B2 | 12/2003 | Koepke et al. | |
| 6,685,267 | B1 | 2/2004 | Johnson et al. | |
| 7,380,881 | B2 | 6/2008 | Freed et al. | |
| 7,475,943 | B1 * | 1/2009 | Huang | 297/353 |
| 7,611,202 | B2 | 11/2009 | Johnson et al. | |
| 8,061,775 | B2 | 11/2011 | Diffrient | |
| 8,347,791 | B1 | 1/2013 | Gray et al. | |
| 8,662,586 | B2 | 3/2014 | Serber | |
| 2008/0018155 | A1 | 1/2008 | Smiley et al. | |
| 2010/0231013 | A1 * | 9/2010 | Schlenker | 297/353 |
| 2011/0034839 | A1 | 2/2011 | Yang et al. | |
| 2012/0181838 | A1 | 7/2012 | Wu | |

OTHER PUBLICATIONS

Corresponding U.S. Appl. No. 14/088,599, filed Nov. 25, 2013, pp. 1-59.

U.S. Appl. No. 14/088,599.

* cited by examiner

BACK GLIDE HINGED TO SEAT BACK

SEATING

This patent application is entitled to the benefit of the filing date of U.S. provisional application 61/733,596, filed on Dec. 5, 2012, and incorporated by reference here in its entirety.

BACKGROUND

The following description relates to seating.

A seat can support a user in a seated position to relieve physical stress associated with standing and to allow the user to engage in one or more sedentary activities for prolonged periods of time. Examples of such activities include working at a computer, reading, watching television, and driving an automobile.

Although sitting can alleviate physical stress associated with standing, the user's body can experience other types of physical stress in the seated position. Examples include stress on the user's back, hip, or neck. The amount of stress placed on parts of the user's body in the seated position can be a combination of the user's posture while in the seated position and the amount of time the user spends in the seated position, among other things. Prolonged periods of sitting can also result in circulatory problems that may cause injury to joints or other physical complications. In some circumstances, prolonged periods of sitting with inadequate support can result in injury to the user. Prolonged sitting in existing chairs can cause oxidative stress and major age-related diseases, cancer, and premature death.

SUMMARY

In general, in an aspect, a seat includes a back-supporting surface; and a seating surface movable along a path toward and away from the back-supporting surface. At least part of the back-supporting surface is movable to enable a lower portion of the back-supporting surface to move substantially along the path.

Implementations may include one or more of the following features. There is a support with respect to which the at least part of the back-supporting surface is movable and with respect to which the seating surface is movable substantially along the path. The back-supporting surface is movable to enable the lower portion to move substantially along the path in response to force exerted by a back of a user seated on the seating surface as the seating surface moves. The back-supporting surface is movable to enable the lower portion to move substantially along the path in response to force exerted by a back of a user seated on the seating surface as the seating surface remains stationary. The seating surface moves while the back-supporting surface remains stationary. The back-supporting surface is movable to enable the lower portion to move substantially along the path as the seating surface moves along an entire length of travel along the path. The back-supporting surface is movable to enable the lower portion to move generally parallel to the path for a maximum distance of about 22.86 cm to 27.94 cm or, for a tall person 33 cm, as the seating surface moves along the path. The back-supporting surface is movable to change the included angle between the seating surface and the back-supporting surface as the seating surface moves along the path. A minimum included angle between the seating surface and the back-supporting surface is about 90 degrees to about 100 degrees. A maximum included angle between the seating surface and the back-supporting surface is about 140 degrees to about 160 degrees. The minimum included angle between the path and the back-supporting surface is between about 80 degrees and about 90 degrees and the maximum included angle is between about 140 degrees and about 160 degrees.

The seating surface is biased to move toward the back-supporting surface along the path. The seating surface is biased to move toward the back-supporting surface under the force of gravity. The back-supporting surface is rotatable about an axis parallel to the back-supporting surface and parallel to the seating surface. The axis of rotation of the back-supporting surface and the path are non-convergent. The axis of rotation of the back-supporting surface is in the back-supporting surface. The axis of rotation of the back-supporting surface is behind the back-supporting surface. The axis of rotation of the back-supporting surface is forward of the back-supporting surface. The axis of rotation of the back-supporting surface is on the support of the seat. The axis of rotation of the back-supporting surface is on an arm of the seat. The back-supporting surface is movable in a direction perpendicular or substantially perpendicular to the seating surface. The movement of the back-supporting surface in the direction perpendicular or substantially perpendicular to the seating surface changes a distance between the lower portion of the back-supporting surface and the seating surface. The back-supporting surface is biased to move away from the seating surface in the direction perpendicular or substantially perpendicular to the seating surface. A spring biases the back-supporting surface to move away from the seating surface in the direction perpendicular or substantially perpendicular to the seating surface. The axis of rotation of the back-supporting surface is between the lower portion and an upper portion of the back-supporting surface. The path of the seating surface is, in some cases, oblique to the seating surface and in some cases substantially parallel to the seating surface. The path of the seating surface is inclined in a direction away from the back-supporting surface. The included angle between the seating surface and the path is constant as the seating surface moves along the path. The seating surface is slidably or rollably movable relative to the support. The seating surface is slidably or rollably movable relative to the support along the path. A spacer is disposed between the seating surface and the support (including the seat guide) and is fixed relative to the seating surface and slidably or rollably movable relative to the support. In some cases the seating surface is oblique to (or in some cases parallel to) the path and the spacer spans an included angle between the path and the seating surface. The back-supporting surface is slidably or rollably movable relative to the support.

The support sometimes includes a plurality of wheels to move the seat on the floor. The support is adjustable in a direction relative to the floor. The support includes a gas cylinder actuatable to move the support relative to a floor. In some cases, the back-supporting surface can include at least one roller in contact with a back of a user seated on the seating surface and rotatable relative to the back of the user as the seating surface moves along the path. A mechanism slows or stops motion of the seating surface at one or more positions along its path. A mechanism slows or stops motion of the back-supporting surface. A mechanism permits adjusting an arc of rotation of the back-supporting surface. The mechanism comprises a detent. A device controls a path of the motion of the back-supporting surface. A device controls the motion of the seating surface. A mechanism enables vertical or substantially vertical adjustment of a position of the back-supporting surface relative to the seating surface. A mechanism enables the back-supporting surface to be adjusted horizontally relative to the seating surface. A mechanism permits adjusting a vertical or substantially vertical height of the back-supporting surface above the floor. The seating surface may be parallel to the path of the seating surface. The seat can include arms, storage areas, a foot stool, or a work surface.

In general, in an aspect, a seat includes a back-supporting surface and a seating surface movable along a path toward and away from the back-supporting surface. The back-supporting surface and the seating surface are independently movable relative to one another, and the back-supporting surface is movable to push the user away from the back-supporting surface or to push the seat away from the back-supporting surface or both, or follow the user along the path.

Implementations may include one or more of the following features. The back-supporting surface is movable in response to a force exerted on the back-supporting surface by the user. In some instances, the back-supporting surface can be movable in response to motorized force exerted on the back-supporting surface. The seat glider is movable in response to a motorized force exerted on the seat glider or to another external force other than the user. The back-supporting surface is movable in response to manual methods exerted on the back-supporting surface. A stopping mechanism limits a range of motion of the seat glider as it moves back and forth.

The back-supporting surface is movable in a direction perpendicular or substantially perpendicular to the seating surface. The back-supporting surface includes a lower portion nearer the seating surface and an upper portion that is farther from the seating surface, and the back-supporting surface is rotatable about an axis between the upper and lower portions of the back-supporting surface and substantially parallel to the seating surface. The axis is movable in a direction perpendicular or substantially perpendicular to the seating surface to change a point of contact between a back of the user and the back-supporting surface. The height of the back-supporting surface relative to the seating surface is adjustable. The seating surface is slidably mounted on a seat guide that is fixed on the support and the horizontal distance of the surface of the seat back from the seat guide is adjustable.

In general, in an aspect, a user is supported above a floor in a way that includes: moving a seating surface substantially along a path toward and away from a back-supporting surface; and varying an orientation of the back-supporting surface such that a portion of the back-supporting surface closest to the seating surface moves substantially along the path as the seating surface moves along the path.

Implementations may include one or more of the following features. The varying of the orientation of the back-supporting surface is based at least in part on a force exerted by a back of a user seated on the seating surface as the seating surface moves along the path. The varying of the orientation of the back-supporting surface is based at least in part on a force exerted by a back of a user seated on the seating surface when the seating surface is not moving. The varying of the orientation of the back-supporting surface includes changing the included angle between the seating surface and the back-supporting surface. The changing of the included angle between the seating surface and the back-supporting surface includes rotating the back-supporting surface about an axis parallel to the back-supporting surface and parallel to the seating surface. Changing the included angle between the seating surface and the back-supporting surface sometimes comprises the seating surface moving along the path. The varying of the orientation of the back-supporting surface includes continuously varying the orientation of the back-supporting surface as the seating surface moves along the path. The varying of the orientation of the back-supporting surface includes changing a distance, parallel to the path, between the seating surface and the portion of the back-supporting surface closest to the seating surface. A mechanism slows or stops motion of the seating surface at one or more positions along the path. A mechanism slows or stops motion of the back-supporting surface. The arc of rotation of the seat back is adjustably controllable. The degree of rotation can be limited by a detent.

In certain implementations, the seat has arms. A seat glider bears the seating surface, a back glider bears the back-supporting surface, a back guide supports the back glider, a seat guide bears the seat glider, and the arms are attached to the seat glider, the seat guide, the back guide, the back glider, the back-supporting surface, or an element that supports the seat guide, seat glider, the back guide, or the back glider, or is otherwise attached to the seat. The arms can have storage areas. A foldable foot stool, for example, stored in the arms, can extend out for use in connection with an ample degree of re-anticline. A desk top can extend transversely over the user.

Implementations can include one or more of the following advantages.

In some implementations, seats include a back-supporting surface having a lower portion that is movable, relative to an upper portion of the back-supporting surface, in a path as a seating surface moves in the path toward and away from the back-supporting surface. Such movement of the back-supporting surface can facilitate consistent support of a user's back as the user moves the seat through various seating positions. For example, a point on the lower portion of the back-supporting surface can remain in contact with a point on a lumbar portion of the user's back through various seating positions to reduce the likelihood of stress and/or injury caused by inappropriate or inconsistent lumbar support. It also can push into the spine resulting in an articulation (gentle manipulation) of the spine.

In certain implementations, the lower portion of the back-supporting surface is movable in the path in response to force exerted by a back of a user seated on the seating surface as the seating surface moves in the path. Such movement of the back-supporting surface in response to force exerted by a back of a user can facilitate adjustment of the seating position of the user without taking the user's hands away from another activity (e.g., typing on a computer, holding a telephone, etc.). Additionally or alternatively, such movement of the back-supporting surface in response to force exerted by a back of a user can facilitate continuous (or substantially continuous) minor adjustments to the seated position of the user and can cause spinal adjustments.

In some implementations, the lower portion of the back-supporting surface and the seating surface are independently movable relative to one another in the path. Such relative independent movement of the back-supporting surface and the seating surface can allow a user to exert a force on the back-supporting surface such that a lower portion of the back-supporting surface moves the user's lumbar spine forward and, in some instances, up an incline plane to rotate the user's pelvis, mobilizing the user's spine while the user is in the seated position. It is believed that such mobilization of the user's spine produces joint motion necessary for intervertebral joint cartilage nourishment which might otherwise degenerate and result in a cascade of events producing chronic inflammation, as compared to sitting in a stationary position in which the user's spine is immobilized.

In some implementations, the seating surface is biased (e.g., under the force of gravity) to move toward the back-supporting surface along the path. As compared to an unbiased seat, this bias can improve circulation to a user's joints. For example, while in the seated position, one or more of the user's knees, hips, and lower back can be actively engaged to resist the movement of the seating surface toward the back-supporting surface. And it can move spinal joints.

In certain implementations, the lower portion of the back-supporting surface moves in the path through a combination of vertical or substantially vertical movement (e.g., movement in a direction perpendicular or substantially perpendicular to the seating surface) and rotational movement (e.g., a change in the included angle between the back-supporting surface and the seating surface). These combined movements can facilitate consistent support of the user's back through a range of seating positions, which may be required for performing a particular task. For example, the relative movement of the back-supporting surface to the seating surface can be substantially self-adjusting in response to movement of the user. Additionally or alternatively, the relative movements of the back-supporting surface and the seating surface can be implemented through a robust mechanical design (e.g., a spring biasing the back-supporting surface away from the seating surface and an incline biasing the seating surface toward the back-supporting surface) suitable for numerous, continuous adjustments over prolonged periods or use of a spring assisting the seating surface away from the back-supporting surface especially in the case of a severe incline.

In some implementations, the height of the axis of the rotational movement (e.g., the height of a hinge) of the back-supporting surface can be adjusted relative to the seating surface to mobilize different parts of the user's spine. For example, positioning the axis of rotation of the back-supporting surface at a point high on the user's back will result in less rotation of the back-supporting surface and more forward motion of the seating surface as the user pushes back on the back-supporting surface while in the seated position. Similarly, positioning the axis of rotation of the back-supporting surface at a point low on the user's back will result in more rotation of the back-supporting surface and less forward motion of the seating surface as the user pushes back on the back-supporting surface while in the seated position. Thus, in some instances, the axis of rotation of the back-supporting surface can be changed (e.g., by user manipulation or through motorized movement) to mobilize different parts of the spine.

In general, in an aspect, a seat includes a back-supporting surface, and a seating surface movable relative to the support along a path toward and away from the back-supporting surface. The back-supporting surface is supported by a mechanism that enables up and down motion of the back-supporting surface independently of the motion of the seating surface toward and away from the back-supporting surface.

Implementations may include one or more of the following features. The supporting mechanism is biased to move the back-supporting surface up to a rest position when no force is being applied to move the back-supporting surface down. The supporting mechanism provides a resting vertical position for the back-supporting surface, and the resting vertical position can be adjusted up and down manually.

In general, in an aspect, a seat includes a support, a back-supporting surface coupled to the support, and a seating surface movable relative to the support in a direction of motion toward and away from the back-supporting surface. The back-supporting surface is supported by a mechanism that, while the seating surface moves toward and away from the back-supporting surface, simultaneously enables up and down motion of the back-supporting surface, and rotation of the back-supporting surface about an axis.

Implementations may include one or more of the following features. The axis of the back-supporting surface is horizontal and is higher than the seating surface. When the seat is not occupied, the back-supporting surface is biased to rise to a rest position vertically and to rotate to an upright resting orientation.

In general, in an aspect, a seat includes a support, a back-supporting surface, and a seating surface movable substantially along a path toward and away from the back-supporting surface. A mechanism that has a manual control enables a user to selectively reduce the ability of the seating surface to move toward and away from the back-supporting surface at two or more locations along the path of the seating surface. The same manual control also enables the user to control a height of the seat above a floor.

Implementations may include one or more of the following features. The manual control comprises a lever that is reachable at a periphery of and below the seat. The manual control can be moved in one direction to control the height of the seat through a gas cylinder and in a second direction to selectively reduce the ability of the seating surface to move toward or away from the back-supporting surface.

In general, in an aspect, a seat includes a back-supporting surface, and a seating surface movable toward and away from the back-supporting surface. The back-supporting surface has a center of gravity above the axis of rotation. A rotation control mechanism reduces the tendency of the back-supporting surface to rotate back beyond a predetermined angle of rotation. The back-supporting surface is mounted so that its center of gravity is forward of the axis of rotation so that when the seat is not occupied, the back-supporting surface tends to rotate to an upright position.

In general, in an aspect, a seat includes a seat pan, a seat back, and a support on which the seat pan and seat back are mounted to permit forward and rearward motion of the seat pan, upward and downward motion of the seat back independently of the forward and rearward motion of the seat pan, and rotation of the seat back around a horizontal axis of rotation independently of the upward and downward motion of the seat back and independently of the forward and rearward motion of the seat pan.

Implementations may include one or any combination of two or more of the following features. The seat pan is mounted to move upward as the seat pan moves forward and to move downward as the seat pan moves rearward. The seat back is biased toward an upward vertical position.

In general, in an aspect, a person sitting on a seat can move through a range of motions that include moving the person's buttocks forward and rearward relative to a floor while simultaneously rotating at least part of the person's spine about an axis other than an axis that passes through the person's hip joints and simultaneously moving the person's back upward and downward relative to the person's hip joints.

Implementations may include one or more the following features. The person can also move his back about an axis through or near the hip joint. The rotation control mechanism comprises a detent. A mechanism stops the rotation of the back-supporting surface at the upright position when it tends to rotate to the upright position.

In general, in an aspect, a seated person is enabled to use his body as a mechanical linkage for structural elements of a seat, to enable a range of motions that include simultaneously (1) moving his buttocks forward and rearward relative to a floor, (b) rotating or gliding his spine and back about or through a combination of one of his spinal joints and/or his hip joints and (c) moving his back upward and downward relative to the (his) hip joints.

In general, in an aspect, a seated person can use his body as a mechanical linkage to cause coordinated motion of (a) a seat back against which the back of the seated person rests and that includes an axis of rotation that is movable generally upward and downward away from and towards a floor and that is rotatable around the axis of rotation independently of the motion generally upward and downward, and (b) a seat pan on which the buttocks of the seated person rest and that is movable forward and backward independently of the motion of the seat back upward and downward and the rotation of the seat back.

In general, in an aspect, a seat includes a support, a seat pan mounted to enable forward and backward motion of the seat pan during use, and a seat back mounted to enable motion of the seat back vertically or substantially vertically and to enable rotation of the seatback around a horizontal axis of rotation during use. A mechanism to constrain or control at least one of: the forward and backward motion of the seat pan, the vertical or substantially vertical motion of the seatback, and the rotation of the seatback.

Implementations may include one or more the following features. The mechanism includes springs or other resilient elements. The axis of rotation of the back-supporting surface is in the back-supporting surface.

The details of one or more implementations are set forth in the accompanying drawings and the description below.

Other features, objects, and advantages of the invention will be apparent from the description and drawings, and from the claims.

DESCRIPTION

Figure 1:
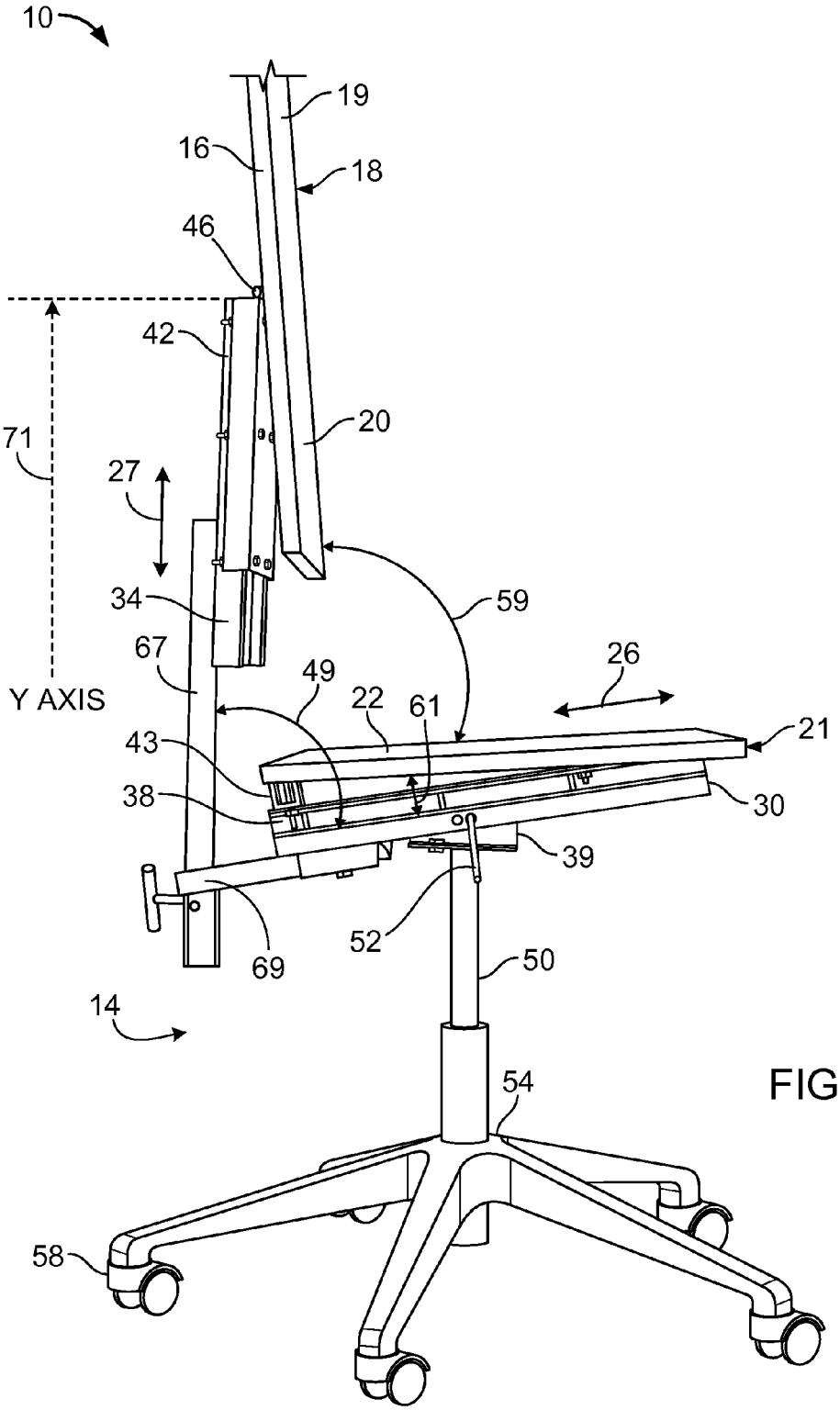
FIG. 1 is a side view of a seat in a first position.
Figure 2:
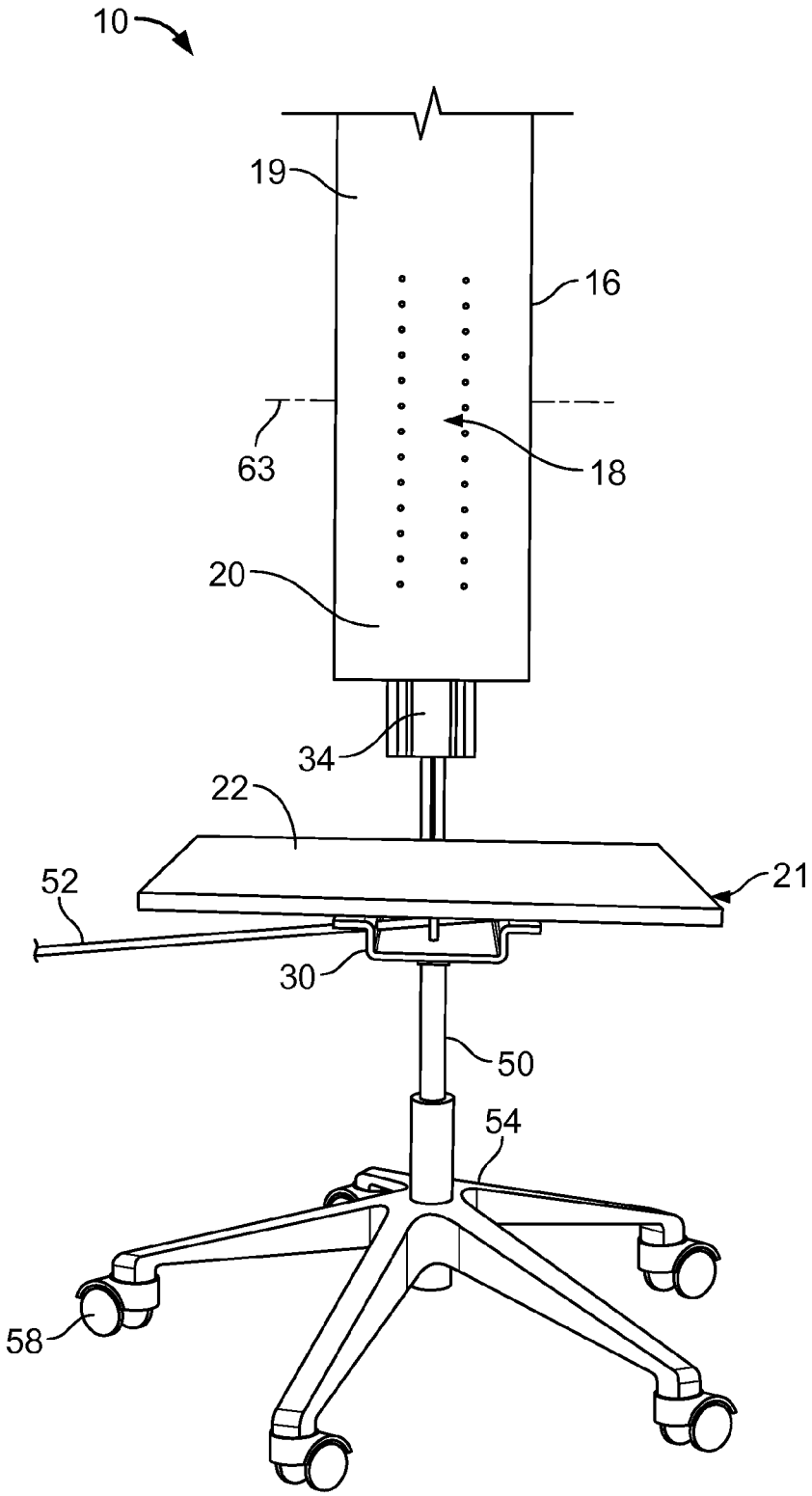
FIG. 2 is a front view of the seat of FIG. 1 in the first position.
Figure 3:
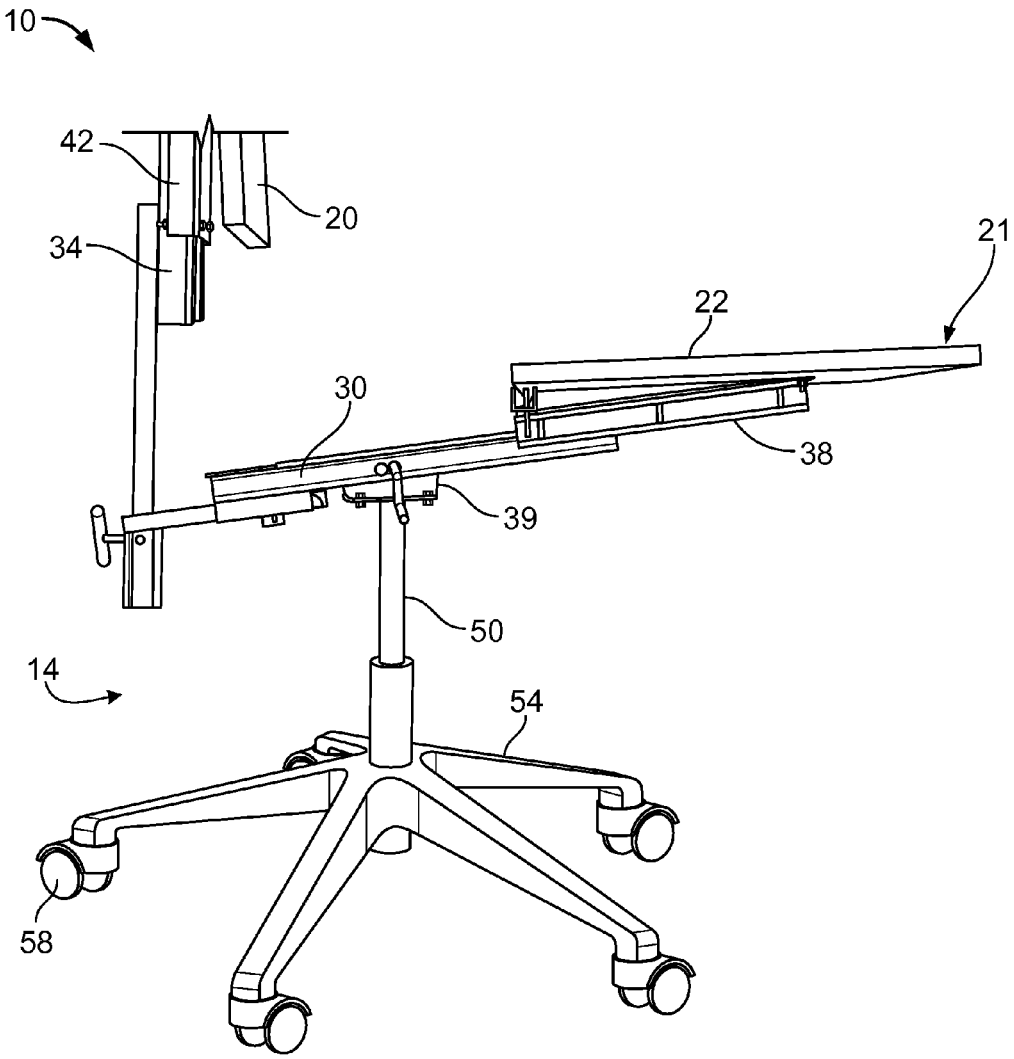
FIG. 3 is a side view of the seat of FIG. 1 in a second position.
Figure 4:
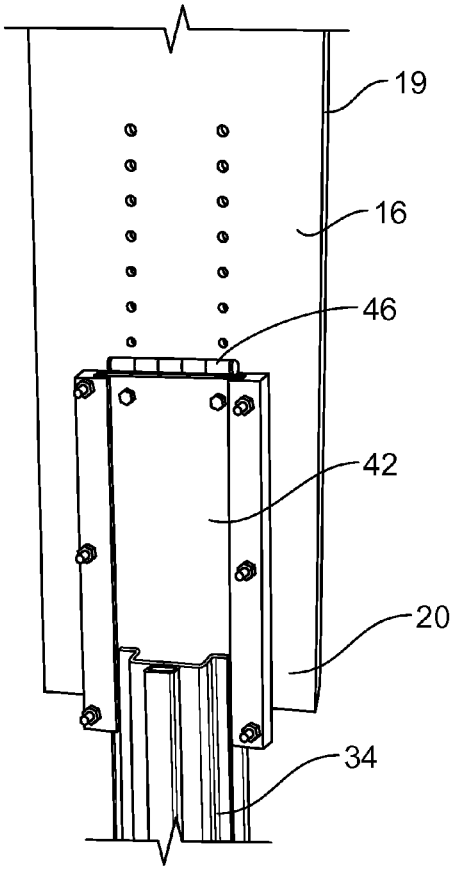
FIG. 4 is a partial rear view of the seat of FIG. 1.
Figure 10A:
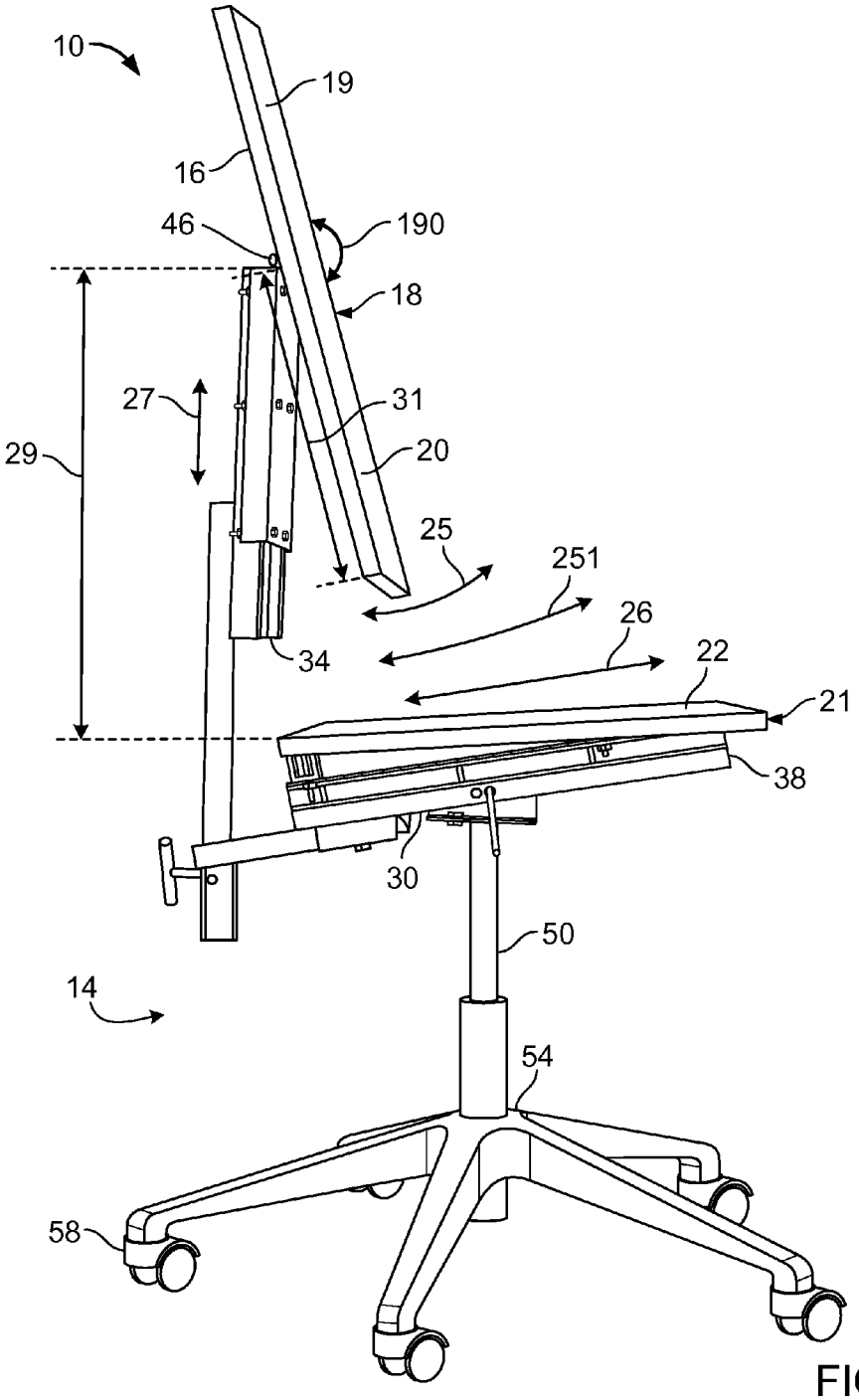
Figure 10B:
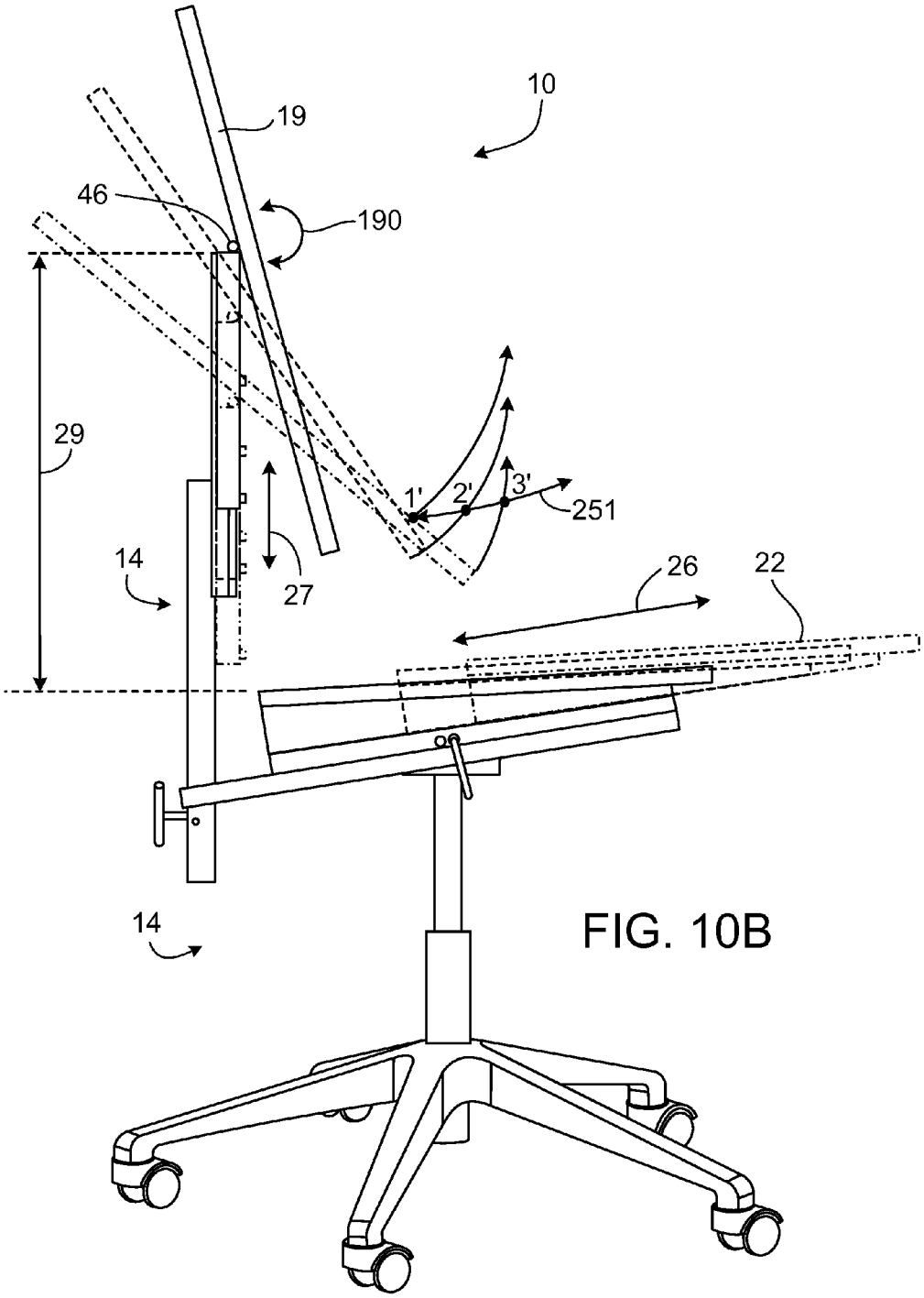
Figure 10C:
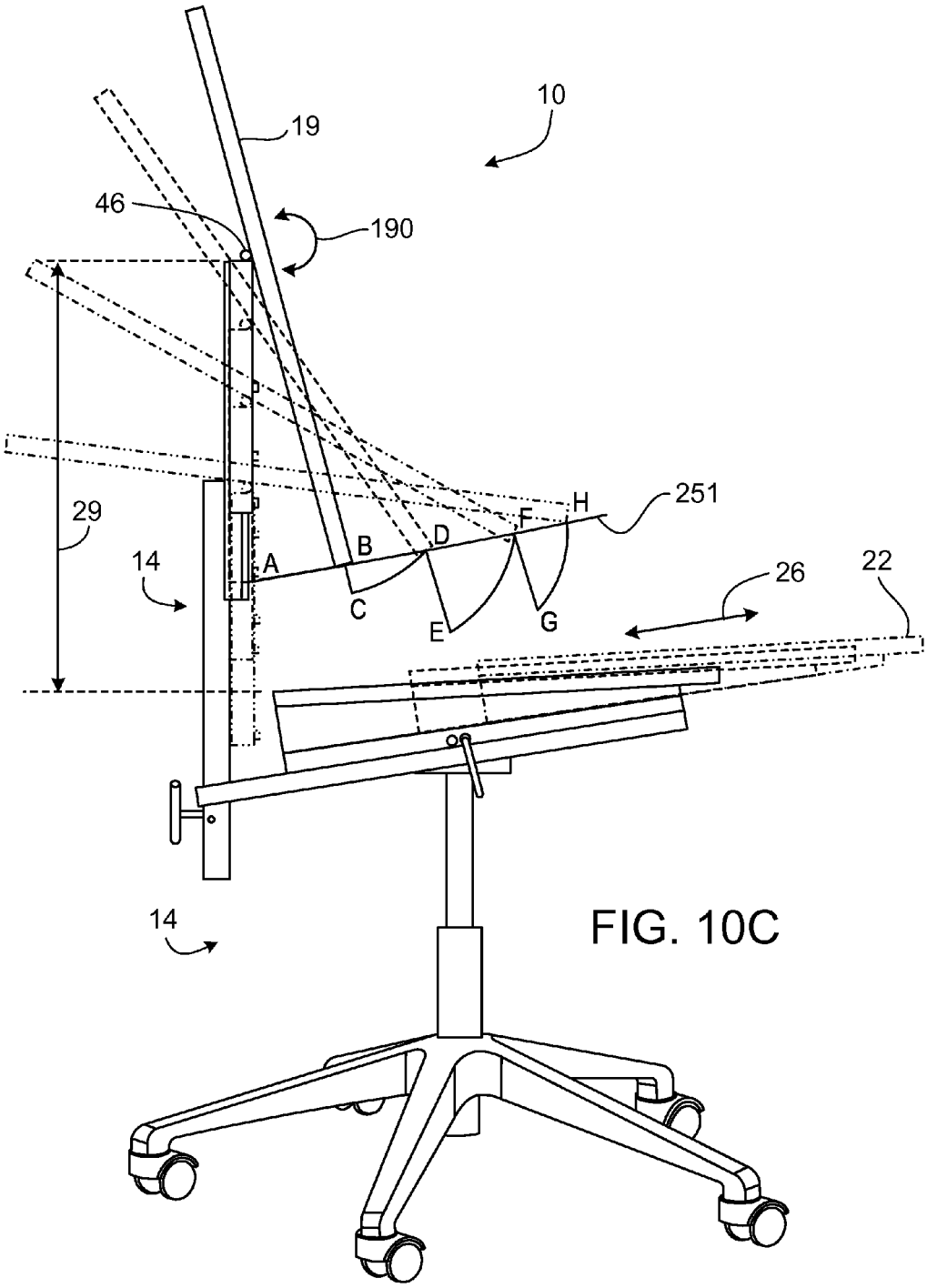

FIGS. 10A, 10B, and 10C are schematic illustrations of changes in the configuration of the seat of FIG. 1.

Figure 11:
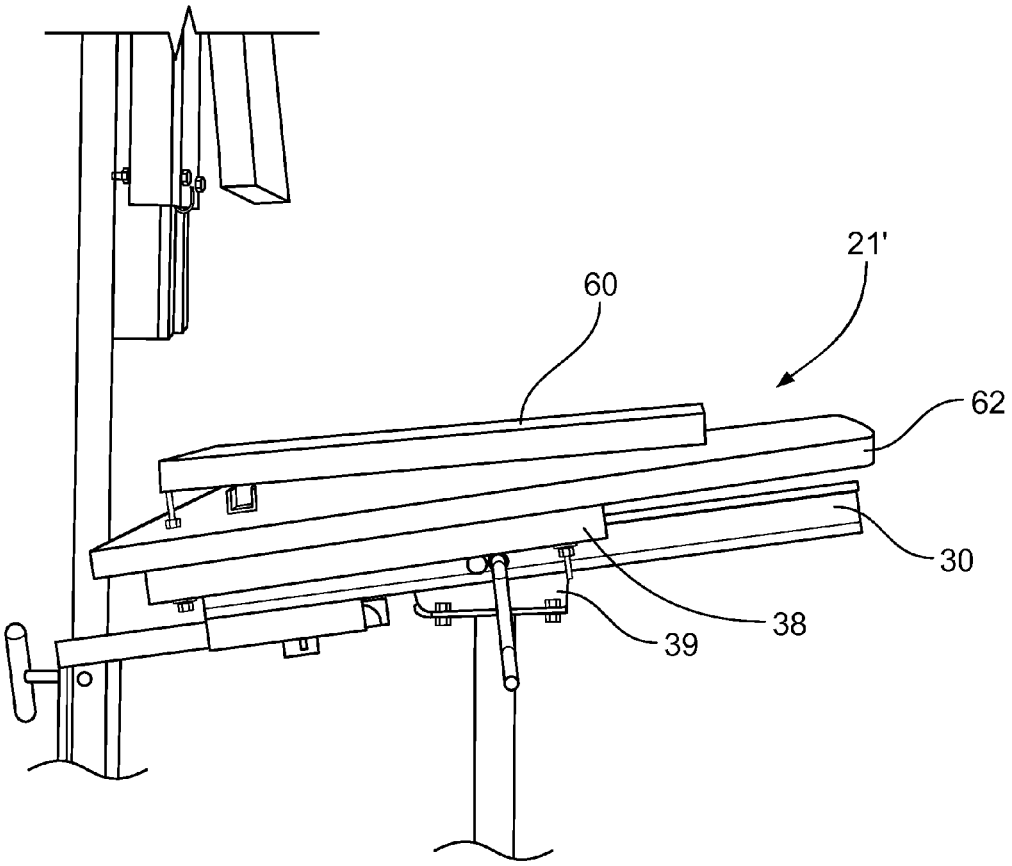

FIG. 11 is a side view of a seat pan of a seat.

Figure 12:
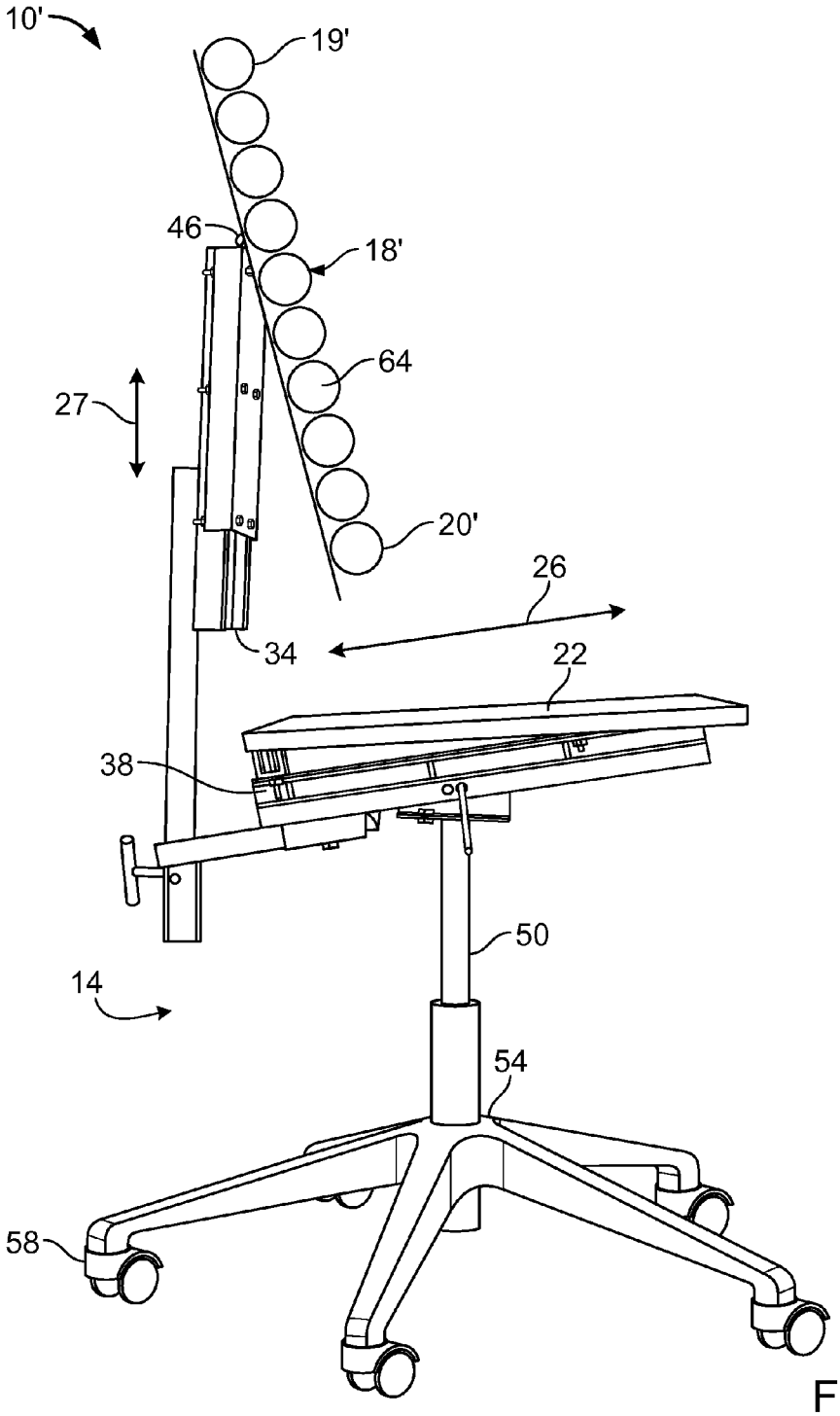

FIG. 12 is a side view of a seat.

Figure 13:
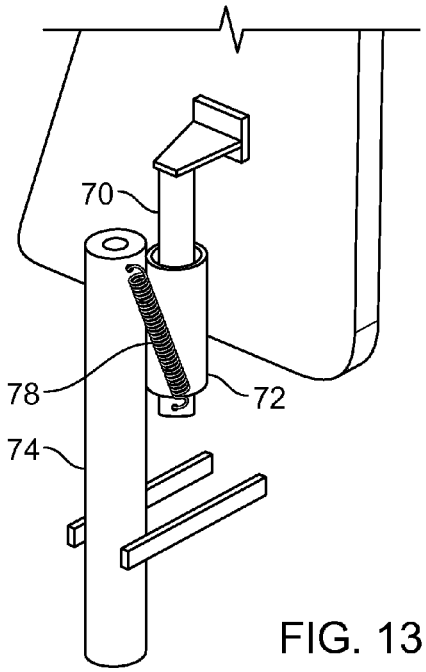

FIG. 13 is a partial perspective view of a seat back support.

Figure 14:
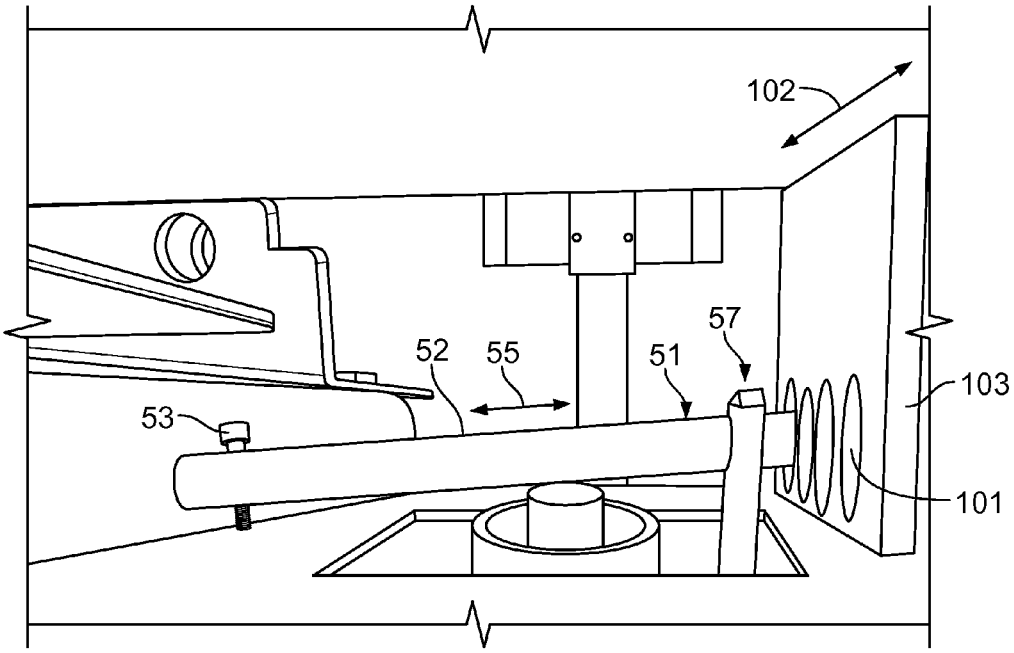
Figure 15:
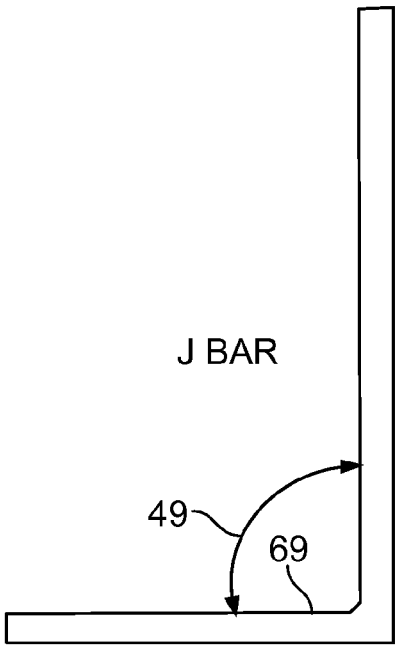

FIG. 14 is a perspective view of a seat guide and a seat glider.

FIGS. 15, 16, 16A, 17, 18, 19, 20, 21, 22, and 23 show pieces of and the assembling of the pieces of the back of a seat.

FIGS. 24, 25, 25A, and 26 are motion curves.

FIGS. 27 through 32 illustrate motion of the seat back.

Figure 33:
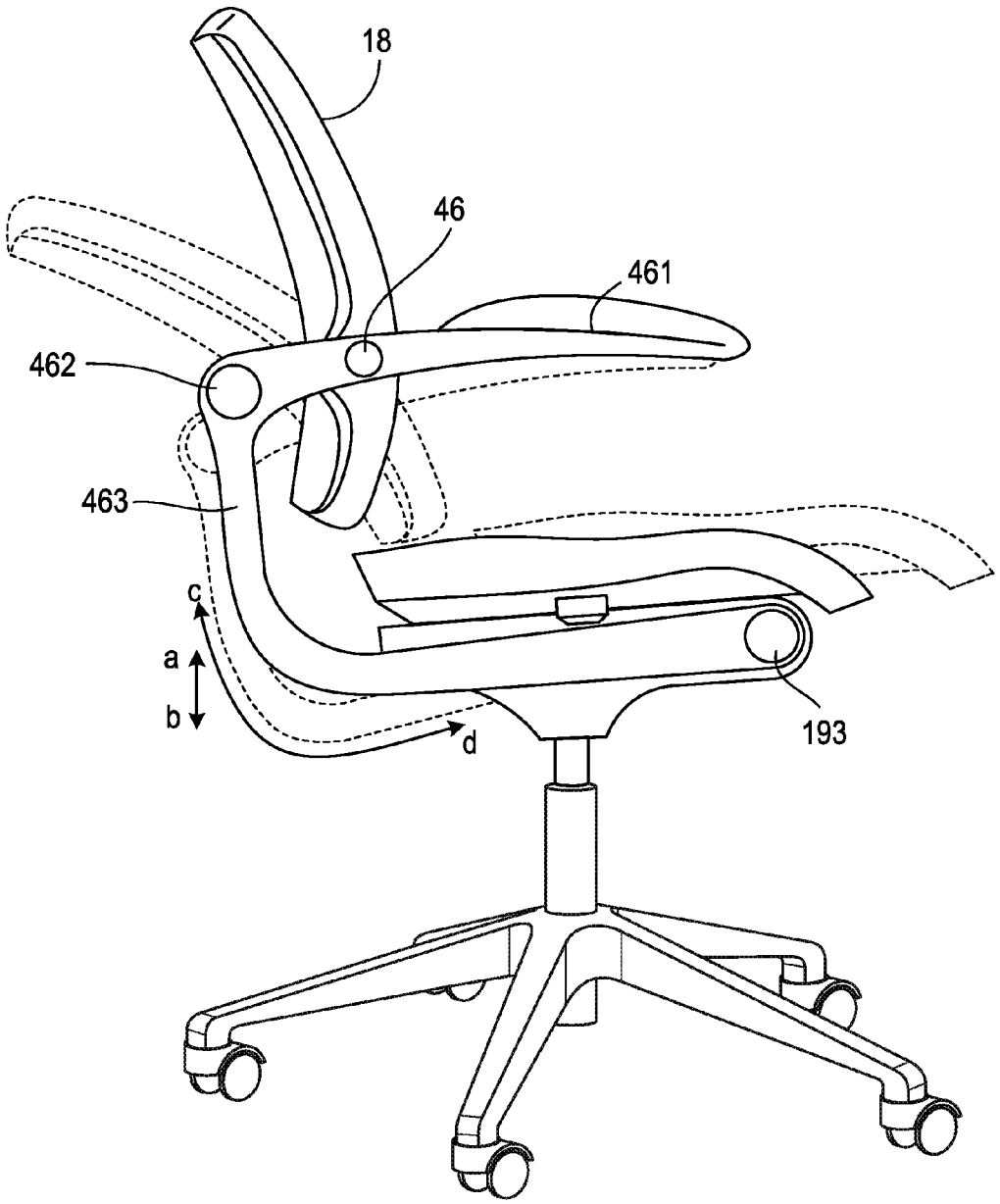
Figure 34:
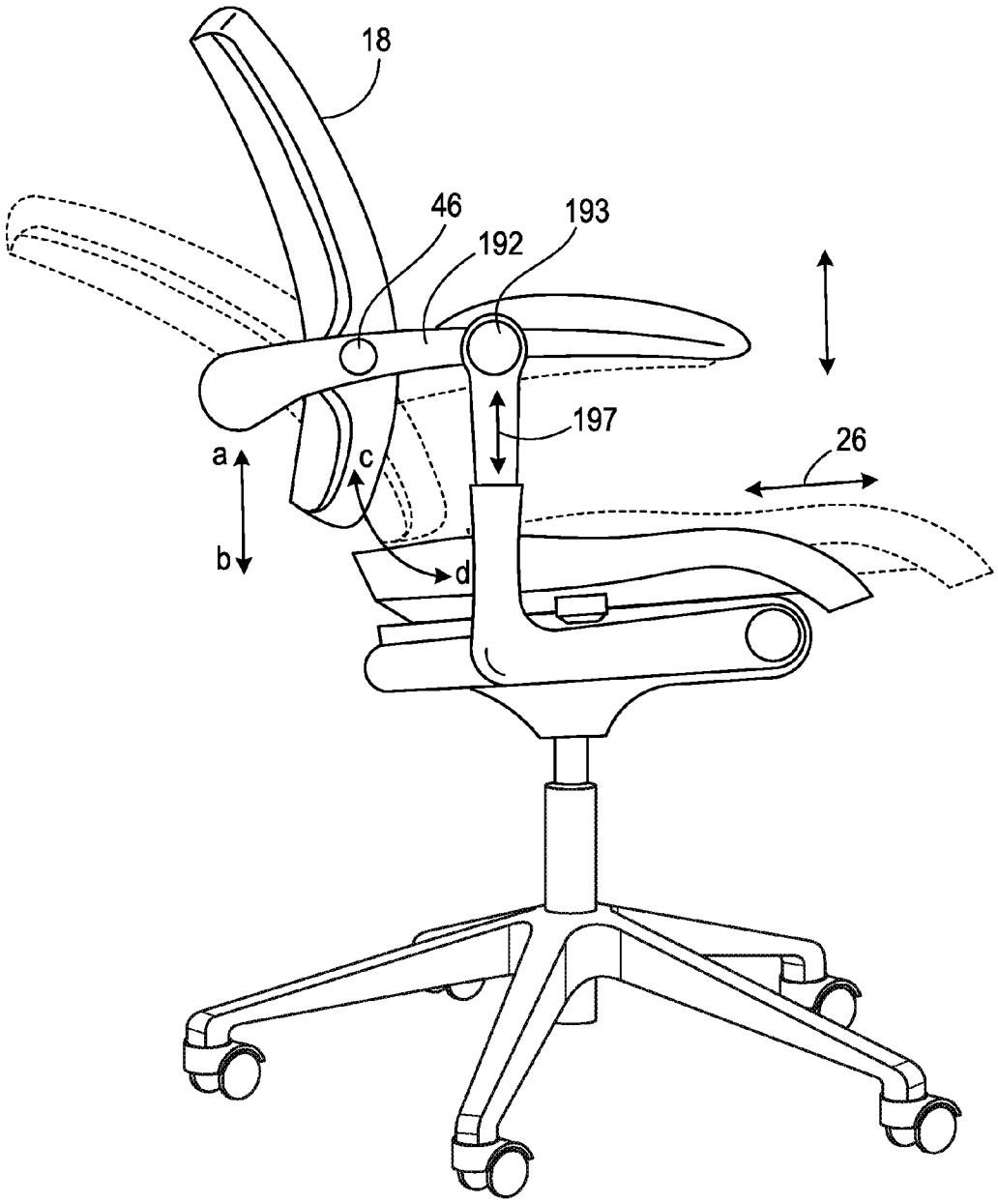

FIGS. 33 and 34 are side views of implementations of a seat.

Figure 35:
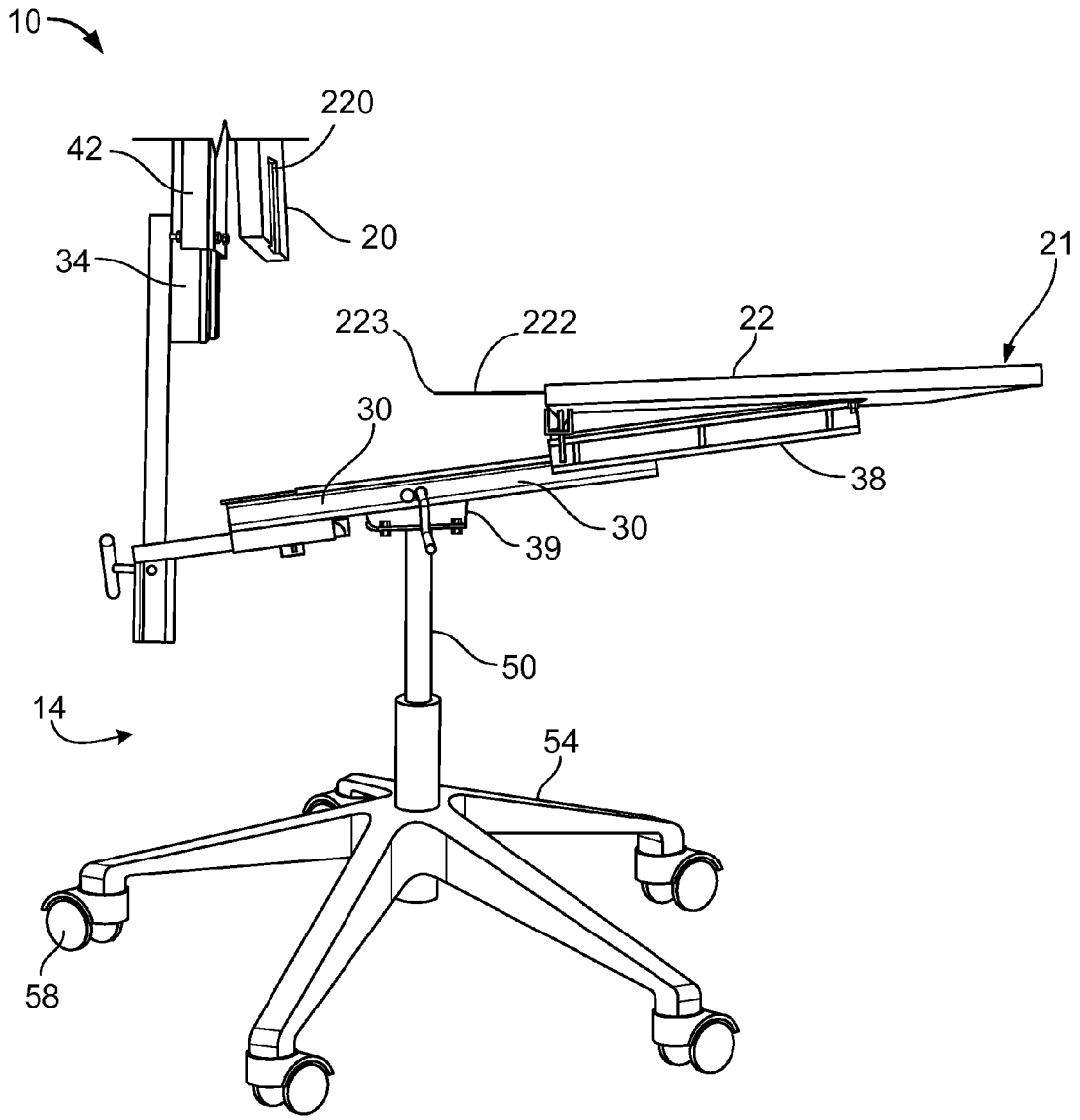
Figure 36:
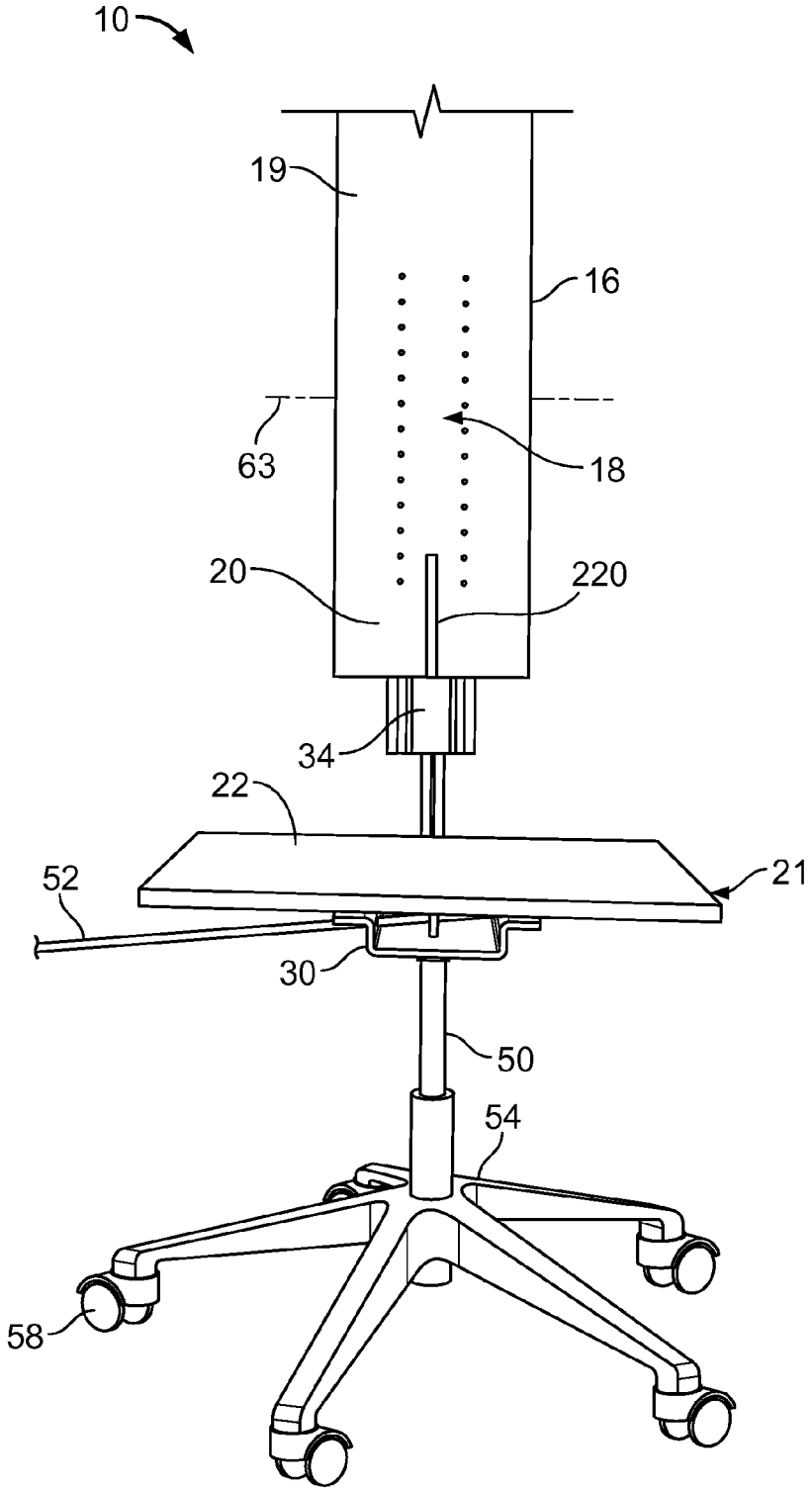

FIGS. 35 and 36 are a side view and a front view of a seat

Figure 37:
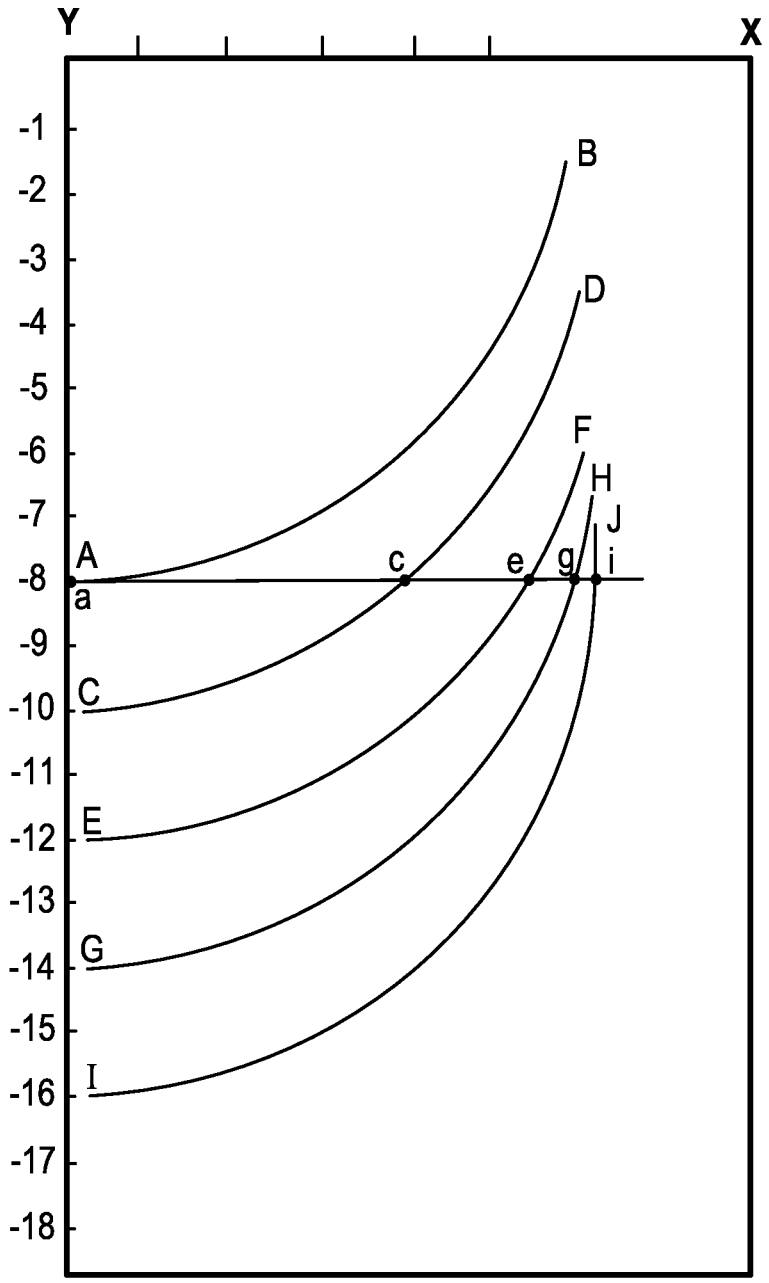
Figure 38:
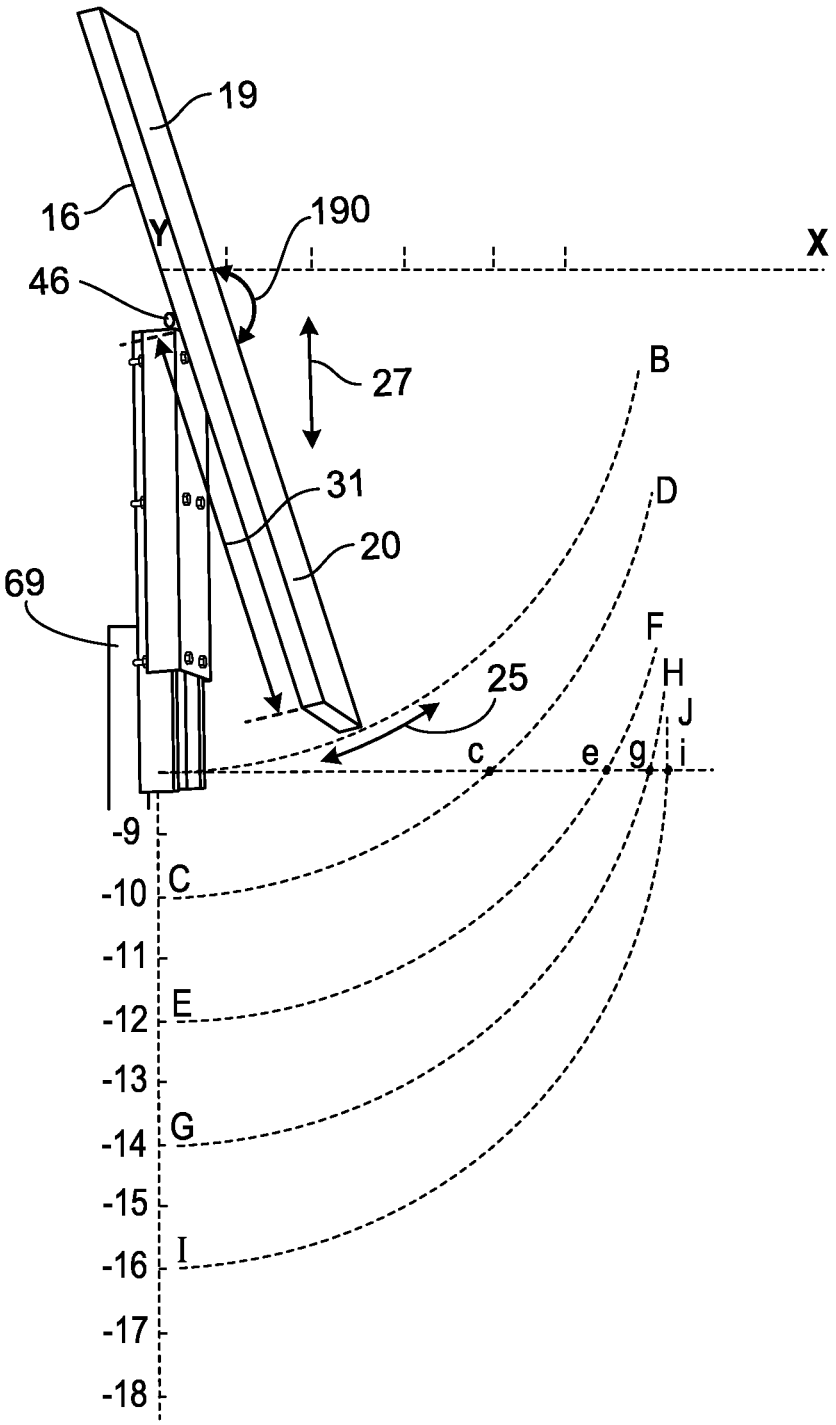

FIGS. 37 and 38 illustrate motion of the seat back.

Figure 39A:
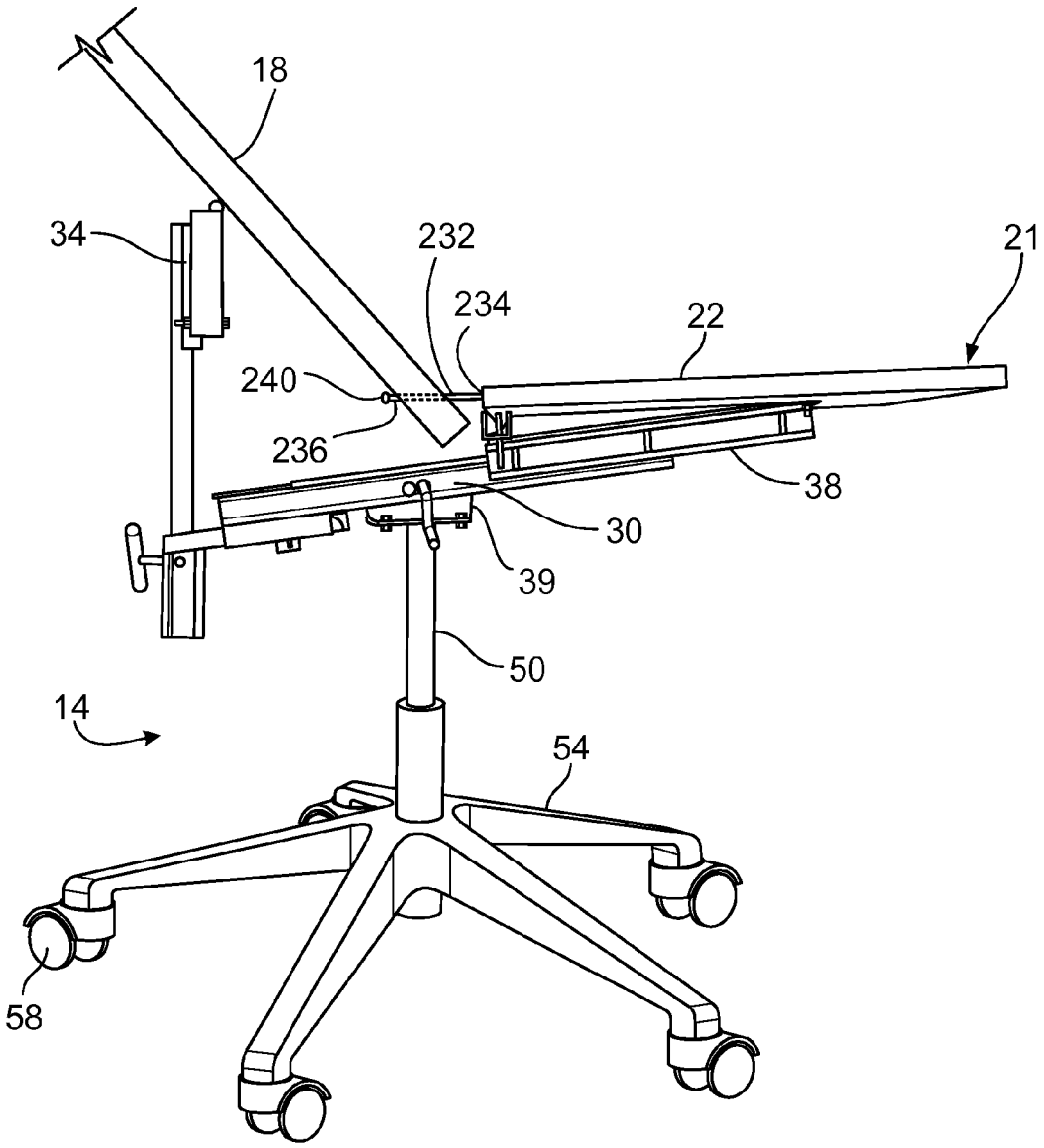
Figure 39C:
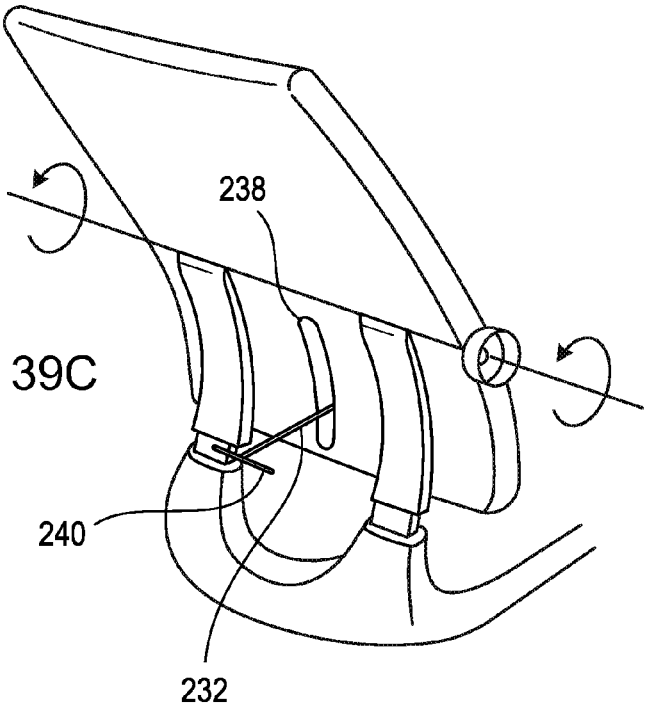
Figure 39B:
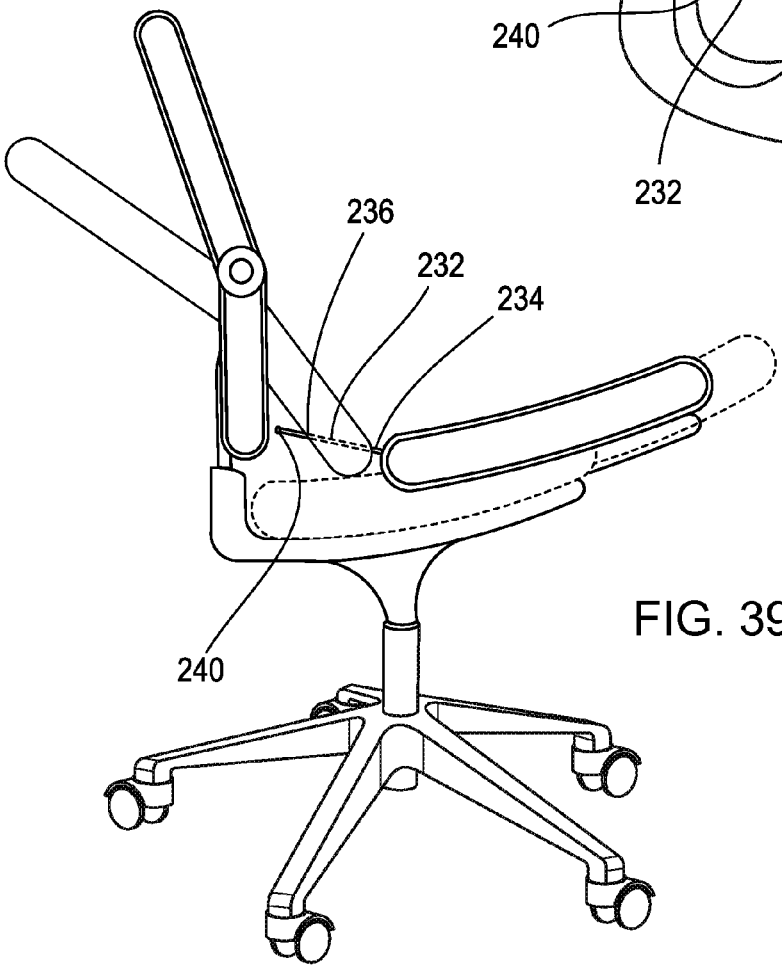

FIGS. 39*a*, 39*b*, 39*c* are a side view, a side view, and a perspective view, respectively, of a seat.

Figure 40:
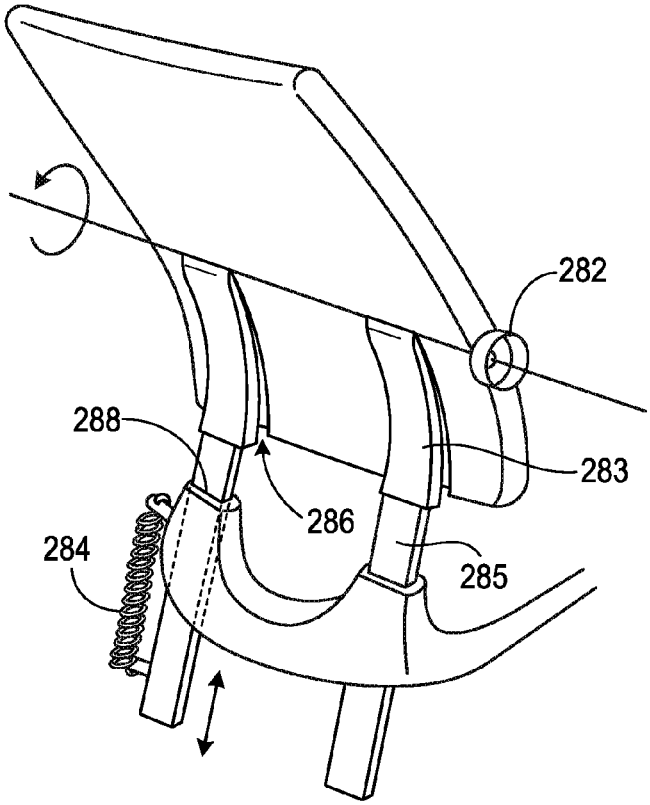
Figure 40:
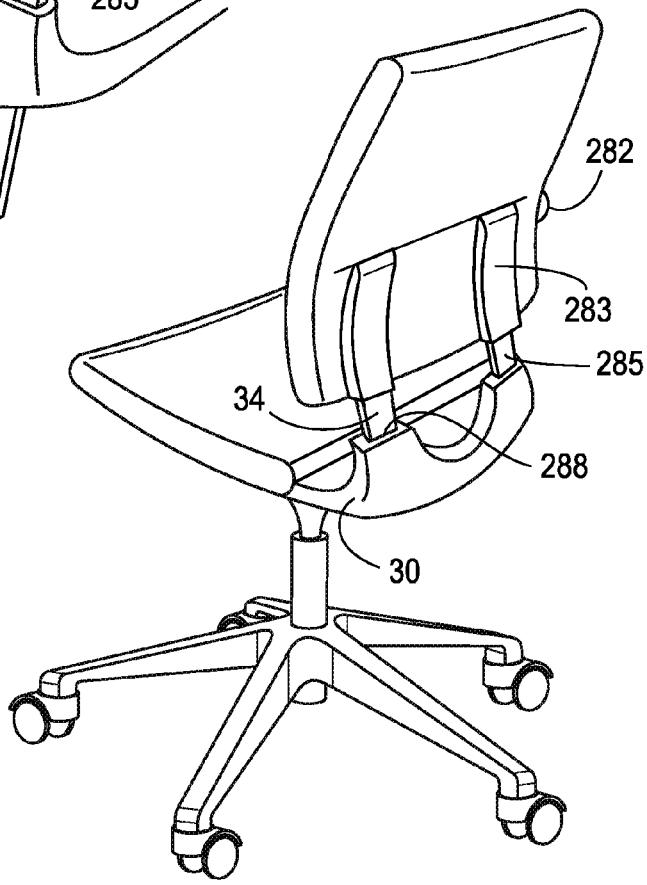

FIG. 40 shows two perspective views of a seat back mounting.

Figure 41:
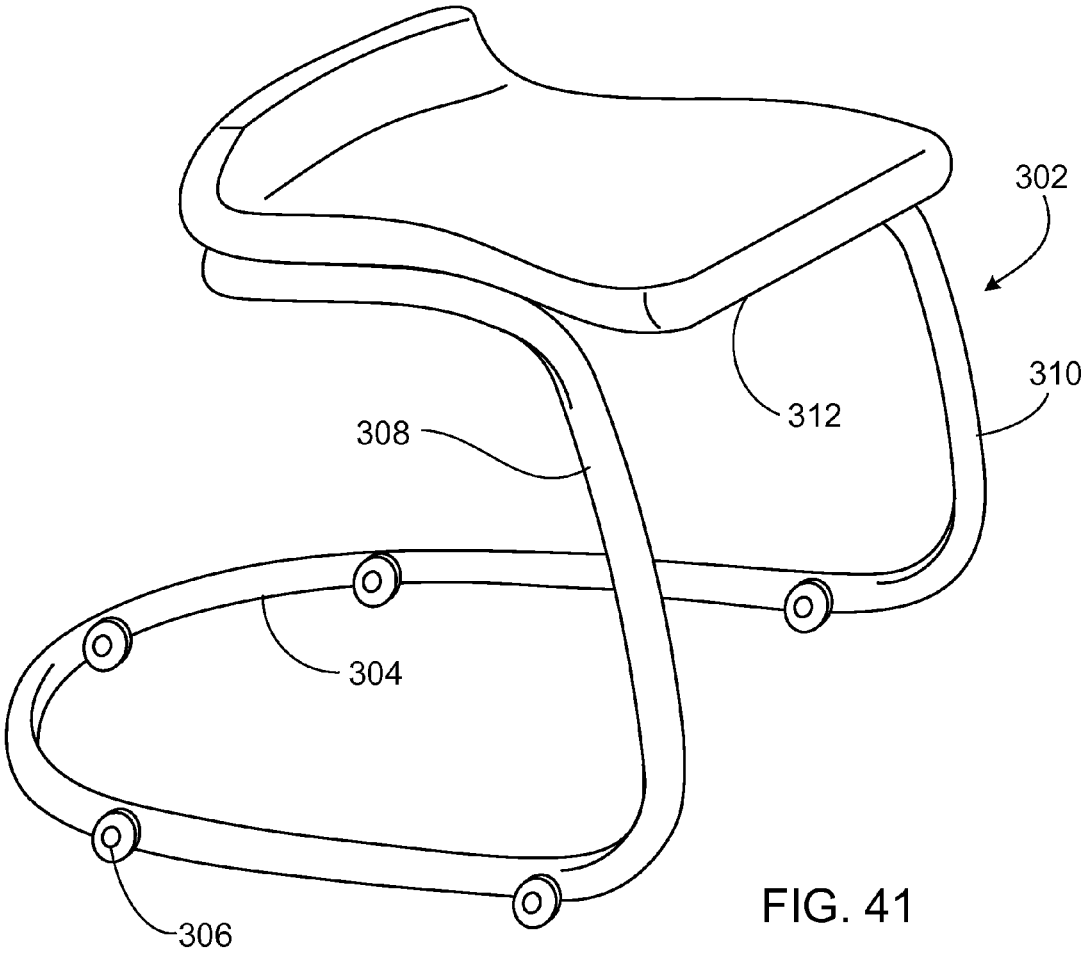

FIG. 41 shows a perspective view of a cantilevered seat.

DESCRIPTION

The immobilization of a person's joints, including the joints of the spine and hips, during prolonged periods of sitting can lead to chronic inflammation that may be linked to other diseases, such as heart disease, diabetes, Alzheimer's, stroke, and cancer. These and other illnesses have been associated in what some people have called "sitting disease."

The seating structure, arrangement, and method of use that is described here will enable and promote the mobilization of the person's joints while seated, thereby reducing or eliminating the chronic inflammation that results from prolonged periods of sitting and disease associated with the inflammation. It will also promote muscle activity increasing seated metabolism.

Among other features, the seat that we describe here (which we also sometimes call a chair or seating) can include a seat back and a seat pan (we sometimes also refer to the seat pan, which supports the buttocks of the user, as the seat bottom). In some implementations, the seat pan and the seat back can be structured and arranged to exhibit three independent degrees of freedom of motion when the seat is not occupied: The seat back has freedom to move up and down. The seat back also has independent freedom to pivot about a horizontal axis so the angle of the seat back relative to the floor varies from upright to reclined (also called anteclined), and the seat pan has independent freedom to move forward and backward relative to the back. By independent degrees of freedom of motion we mean, for example, that, when the seat is not occupied, motion in one of the degrees of freedom can occur independently of motion in another degree of freedom of motion. The independent motion can occur with complete independence or in some cases there could be some resistance to the complete independence of motion. In some cases, mechanical, electrical, magnetic, or other couplings, or combinations of them, could be provided between or among any two or more of the three independent degrees of freedom of motion and between or among any two or more of the elements of the structure. When such couplings are provided, we sometimes refer to the freedom of motion of the parts of the seat as being "dependent" rather than independent, because the freedom of motion is then dependent on the couplings. The couplings could have a wide range of strengths, from very gentle to very stiff. The couplings could be simple direct couplings or could provide for complex coupling of motion between two or more of the elements of the structure.

The freedom of motion in each of the three degrees—rotation of the seat back, sliding of the seat pan, and sliding of the seat back—can be resisted or constrained by widely varying amounts of resistance or constraint from stiff to weak, can be controlled in a wide range of approaches from simple to complex, and can be driven by motors, magnets, pneumatic devices, and in other ways. The strength of the resistance or constraint and the complexity of the control can be governed by mechanisms that are set and reset between uses of the seating or can be arranged to be dynamically altered during the use of the seat or both. For example, constraint can be governed by the number and strength of springs used to resist motion along one of the degrees of freedom. In some implementations, adjustable pads can be provided or adjustable gas springs. The torque of bearings used to support elements of the seat can be varied.

Although, in some implementations, there are three degrees of freedom of motion (which can be free, or constrained, or controlled motion for each degree) when the seat is not occupied, a person sitting on the chair serves as a link between the seat pan and the back in a way that allows or encourages—and at times requires—mobilization (and an amount of mobilization) of the joints of the sitter that would not otherwise occur with other kinds of seating. And the link automatically recruits the use of certain muscles. The person's body serves to constrain the freedom of motion of the parts of the seat and in that way promotes mobilization of joints and exercise of muscles as motion of one part of the seat promotes motion of another part of the seat through the medium of the sitter's body. In some implementations, the horizontal pivot axis of the back of the seating is positioned within a range of heights above the seat pan and is mounted in a relatively fixed location forward and aft, so that when a user's buttocks are on the seat pan, the seat back hinge provides a firm support against the user's back. This is true regardless of the rotational orientation of the back or the height of the seat back (as the horizontal pivot axis rises and falls with the seat back).

In other words, when the seat is occupied, the hinge can be oriented in a position and at a vertical height such that if the sitter pushes back on the seat back, the seat back resists the force of the sitter in a way similar to the way a typical seat back resists forces of a sitter that push back against the seat back.

However, the sitter can also consciously or subconsciously engage in a wide range of motions that include rotation of the seat back, pushing the seat back downward and allowing it to rise, and moving the seat pan fore and aft.

When the seat is occupied, the linkage between the seat back sliding up and down, the seat back rotating, and the seat pan gliding forward and back (and along, for example, an inclined path) is the seated human being. For example, when the sitter's back is pressed against the seat back, the sitter's buttocks can move forward as the seat pan slides forward. Because the sitter's buttocks are connected to the sitter's back through the pelvis and the spine, the motion of the buttocks in a forward direction causes the sitter's back to recline (antecline) as the seat back pivots about the hinge. The reverse happens when the sitter then pushes against the floor to force the seat pan to glide backwards or changes posture to allow the seat pan to glide backwards, that is, the user's back becomes more upright as the seat back pivots to a more upright orientation around the hinge. The motion of the seat pan back and forth also causes bending of the knees, if the feet remain stationary on the floor. Viewed in another way and assuming that the sitter's back is against the seat back and the sitter's feet are stationary on the floor, as the sitter's buttocks move back and forth with the gliding motion of the seat pan, the sitter's back reclines (anteclines) and then becomes more upright, and the sitter's lower legs change their orientation to the floor so that the joints, muscles, and tendons of the hips, spine, and knees are continuously exercised.

Vertical or substantially vertical downward motion of the seat back will typically occur when the user has tilted the seat back beyond a certain threshold amount. As the user tilts the seat back the center of gravity of the user's back moves rearward and is no longer directly above the sitter's pelvis. The natural vertical upward support provided by the user's spine from the pelvis decreases as the sitter tilts the seat back. The sitter then naturally allows the weight of her back to descend towards the floor which provides a vertical or substantially vertical downward force against the seat hinge and causes the seat back to descend vertically or substantially vertical against the restoring force of a spring that is applied upwardly on the hinge. Conversely, as the user rotates the seat back to a more vertical position the downward force exerted by the sitter's back is diminished eventually to zero and the seat back hinge and seat back correspondingly rise toward their original position under the influence of the spring.

Other motions of parts of the body may also be accommodated by the seat.

Thus, during use of the chair, when the bottom of the seat back is rotating forward, the portion of the user's spine that is below the hinge also moves forward producing a pivoting between at least a portion of the spine and the legs around a pivot axis in the user's body. That internal pivot axis could be through the hips but often will be higher up along the spine. As the user leans back against the chair back, the user is pushing against the temporarily stationary hinge, forcing the user forward and up an inclined plane. This motion causes rotation of the pelvis which produces intervertebral joint motion. In addition, the freedom of the seat back to move up and down permits mild compressive forces that cause imbibition and nourishment of the spine, among other things, and reduces what is known as "shirt tail pull". Also, as the chair back rotates and the user's buttocks move forward there is a degree of extension of the spine above the hinge, while the chair back below the hinge may gently touch the user at different areas of the user's back at times causing gentle vertebral motions and offering support of the spine. And these motions can be independent while the chair is occupied; the chair flows these motions seamlessly together to feel as one continuous complex motion that automatically incorporates user's muscle action.

The structure and operation of the chair thus takes advantage of several motions individually and in combination: When the seat pan glides the ankle, knee, and hip joints will move. When the seat pan glides while the sitter on the seat pan leans against the back, the sitter's pelvis will move and if gliding on an inclined plane the pelvis rotates; this causes motion of intervertebral joints, especially in the lumbar area. When there is a pivot axis part way up the seat back and the sitter leans over it this can cause extension and upon return flexion of thoracic joints. And the lower portion of the seat back can gently push into and move spinal joints. The entire rotated seat back always provides a shelf for the user's back to rest, supporting back muscles and ligaments from over stretch and from fatigue. When the seat back glides up and down, the spinal joints are loaded.

The rate of travel, distance of travel, and ratio of travel of the different components, chair back rotation, chair back verticalglide, and seat panglide, can vary from time to time in the chair and will vary from sitter to sitter and during the use by one sitter. This produces a significant health and comfort factor. The chair produces motion of lower extremity joints and intervertebral joints and subconsciously causes muscle function and metabolism. This is accomplished in degrees that vary with the different stages of motion that are linked by a seated user whose muscles and joints come in to play intuitively. In a sense, the chair asks you to sit the proper way because it rewards you for doing so.

Referring to FIGS. 1 through 11, for example, a seat 10 includes a support 14, a back support 16 (which we sometimes call a back or a seat back), and a seat pan 21 (which we sometimes call a seat bottom). As described in more detail below, the back support 16 and the seat pan 21 can be coupled to the support 14 by mechanisms that allow each of them to move relative to the support and relative to each other (with independent freedom of motion as mentioned earlier). The coupling mechanisms are arranged such that user-exerted force on the back support 16 and the seat pan can (and will during typical use of the chair) cause (1) movement of the seat pan 21 back and forth along a direction of motion 26 that corresponds to a gently inclined plane, (2) changes of the angle 190 (FIG. 10A), height 27 (FIG. 10A), and position of the back support 16 relative to the seat pan 21 through a range and variety of seating positions, and (3) when the back support is rotated back beyond a threshold angle 190, movement of the seat back downward, driven by the weight of the sitter's back, as discussed earlier.

As compared to passively sitting on a non-adjustable seat, the movements and relative movements of the back support 16 and the seat pan 21 allowed by the coupling mechanisms and caused by the forces and motion applied by the user to the seat can reduce the likelihood of injury to the user who is in a seated position over prolonged periods. Injury can be reduced by, for example, enhancing blood flow to the user's joints or facilitating strengthening of certain anatomical core muscles (e.g., abdominal muscles, oblique muscles, erector spinae, or a combination of any two or more of them) or allowing the articular surface of intervertebral joints to be bathed by synovial fluid which nourishes the cartilage surface, or a combination of any two of more of these benefits.

In the FIGs, the seat 10 has been shown without cushions or contoured surfaces. However, one or more of the surfaces supporting the weight of the user can include a wide variety of cushioned or contoured surfaces or a combination of them to improve comfort for the user.

The support 14 includes a seat guide 30 and a back guide 34. In some implementations, the back guide 34 is vertical or substantially vertical relative to a horizontal floor surface. In some cases, the seat guide 30 inclines relative to the horizontal floor surface with the rear end of the seat guide closer to the floor than its front end such that the seat guide 30 defines an inclined direction of motion 26. During use, the included angle 49 between the seat guide 30 and the back guide 34 is typically fixed while the mechanisms that couple the seat pan and the back support to the seat guide and the back guide permit the seat pan and back support each to move and allow the two to move relative to one another through the linkage of the sitter. As a result, forces (for example forces imparted by the user) on the seat pan and the back support are free to produce movement and rotation of the back support 16, up and down motion of the seat back, and movement of the seat pan 21 relative to the support and relative to the back support.

In some implementations, the-angle 49 between the back guide and the seat guide (for example, 80-90 degrees) will be uncomfortable for many people if the seat back were rigidly held parallel to the back guide, and in many cases people will tend to lean back on the back support to cause it to pivot about 10 degrees relative to the back guide so that the effective included angle 59 between the rotated back support and the seat pan is greater than the included angle 49 and is, for example, about 90 degrees. An advantage of this arrangement is that in normal sitting, the sitter has caused the seat back to pivot about the hinge and the seat back is then in an orientation to permit easy motion of the sitter's back from a more upright position to a less upright. In some implementations, the chair can be constructed so that the angle between the back guide and the seat guide is 90 degrees, and the angle between the seat pan and the back guide would be about 100 degrees if the seat pan were horizontal to the floor. In some cases, the seat guide top surface is set at about 10° to the floor and the top surface of the seat glider (on which the seat pan rests) is set at about a six degree angle to the floor. This arrangement helps to prevent the user from sliding off the seat pan. The resulting angle between the seat pan and the back guide is 94 degrees in this example.

Figure 16:
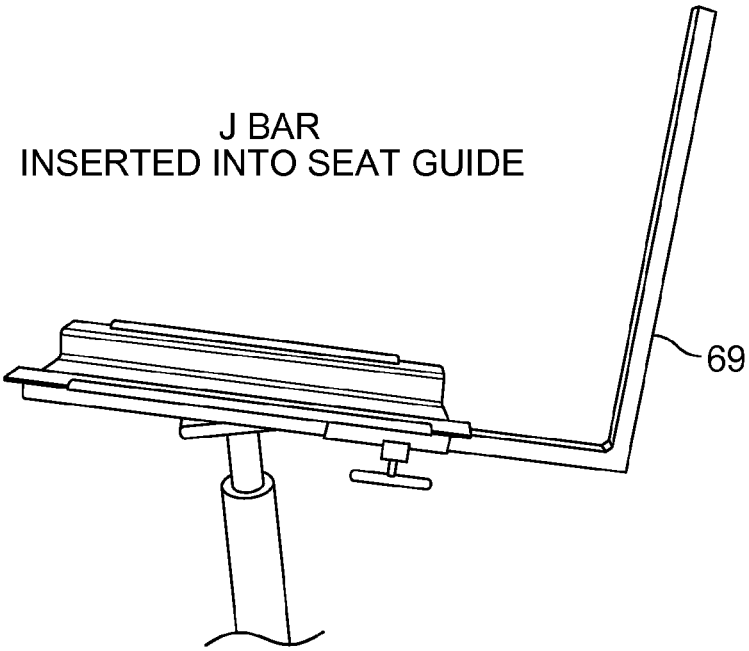
Figure 16A:
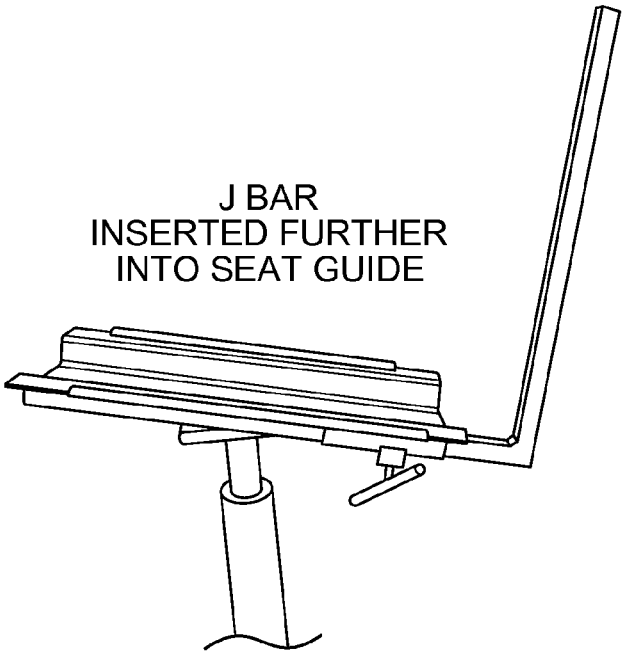

In some implementations, the angle 49 can be defined by an angle between two separate pieces as in FIG. 1, for example. In some cases, the angle 49 can be defined between a back piece and a seat piece of what we sometimes refer to as a J bar 69. As shown also in FIGS. 15, 16, 16A, 18, 20, and 22, for example, the J bar 69 in some examples can be two square-cross-section pipes welded together to form a rigid piece with the angle 49 between them. The seat piece of the J bar can be inserted into and clamped to the seat guide as shown in FIG. 16. As shown in FIG. 16A, the seat piece can be inserted to different degrees into the seat guide compared to the degree of insertion shown in FIG. 16, for example.

Figure 17:
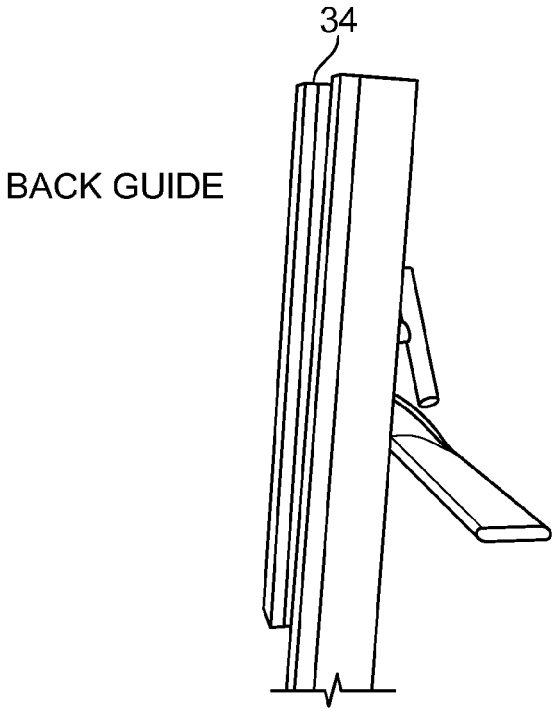
Figure 18:
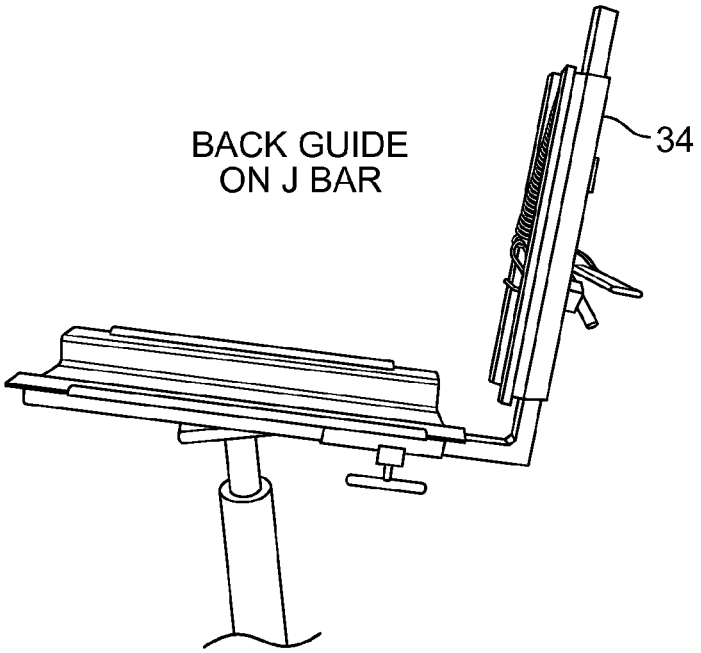

In some examples, the back guide 34 is slid onto the J bar and is adjustable up and down on the J bar as shown in FIGS. 17 and 18. As mentioned, the J bar can be fabricated to have a fixed angle 49, different J bars can have different fixed angles 49, or the J bar can have an adjustable angle 49. It seems comfortable for most people to have the back piece of the J bar at 90° to the seat guide and tilted back about 10° to the vertical and therefore with the vertical part of the J bar at about 100° to the floor.

Figure 19:
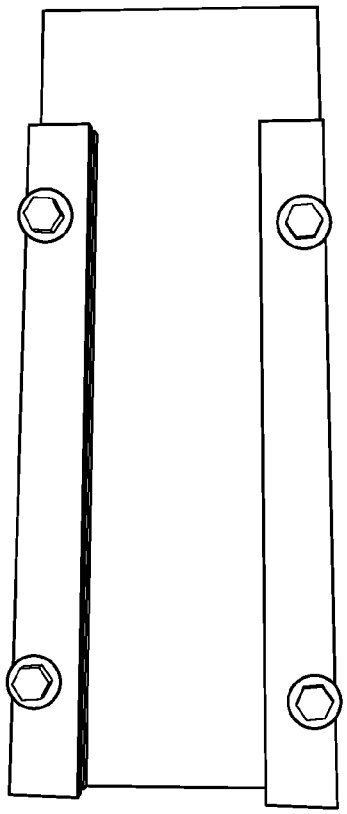
Figure 20:
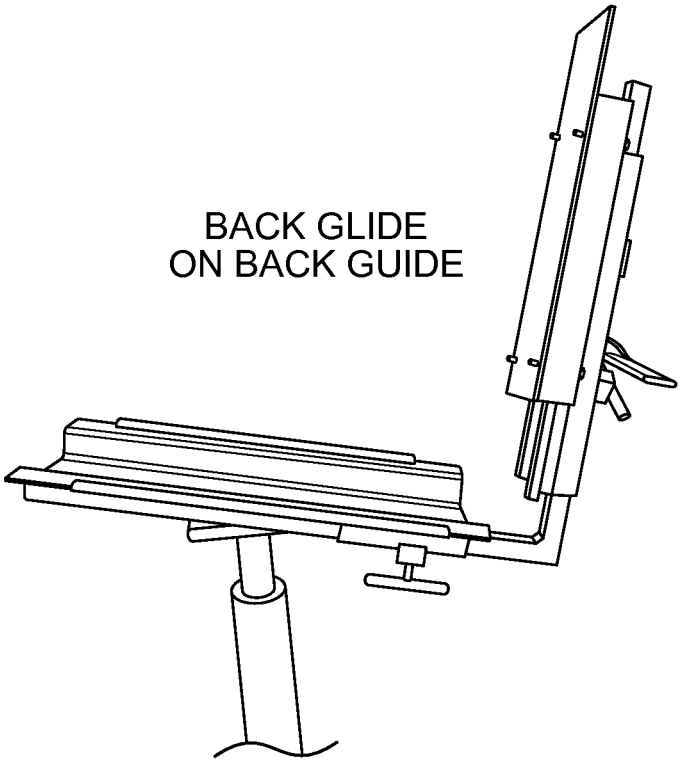
Figure 21:
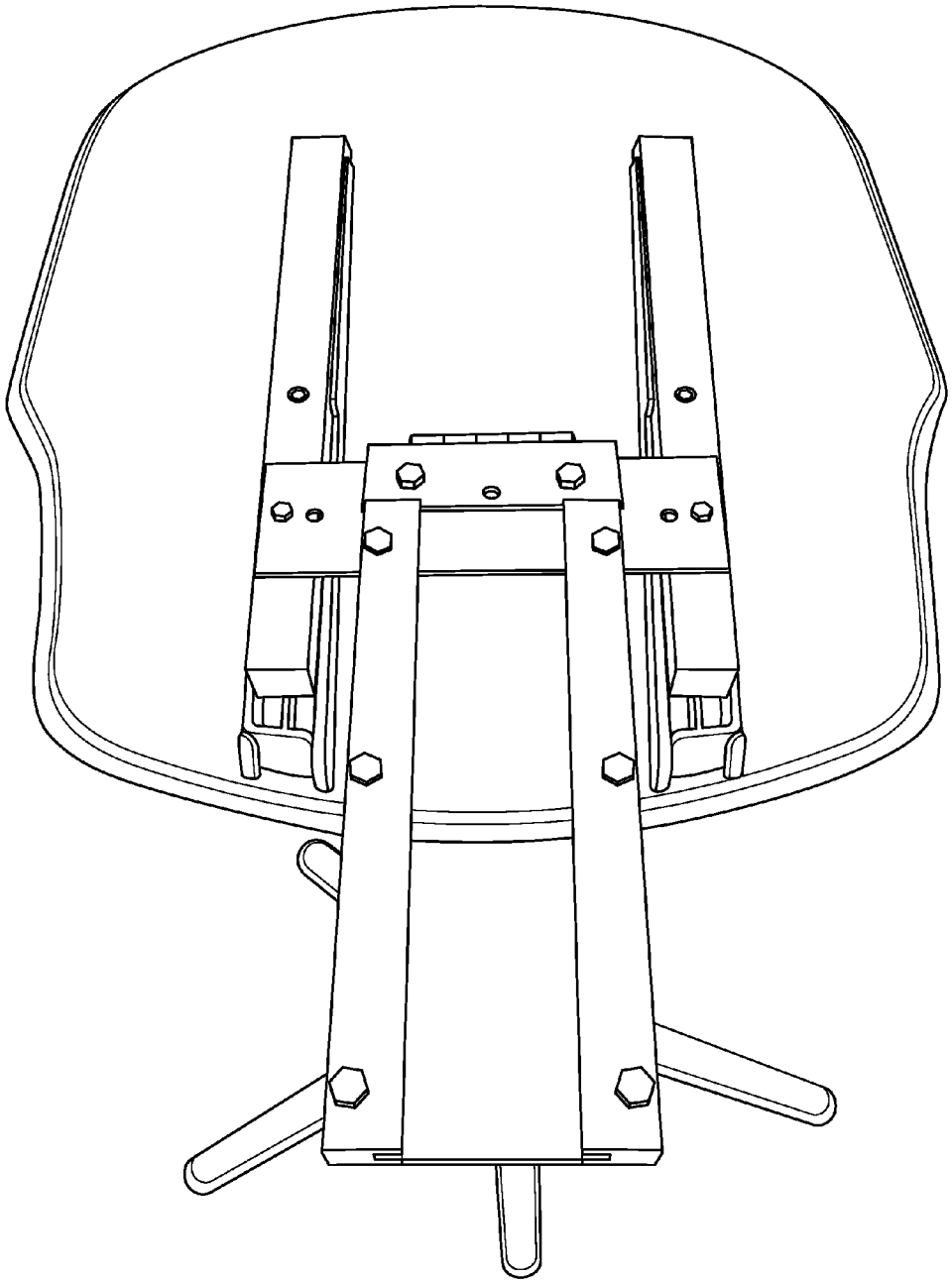
Figure 22:
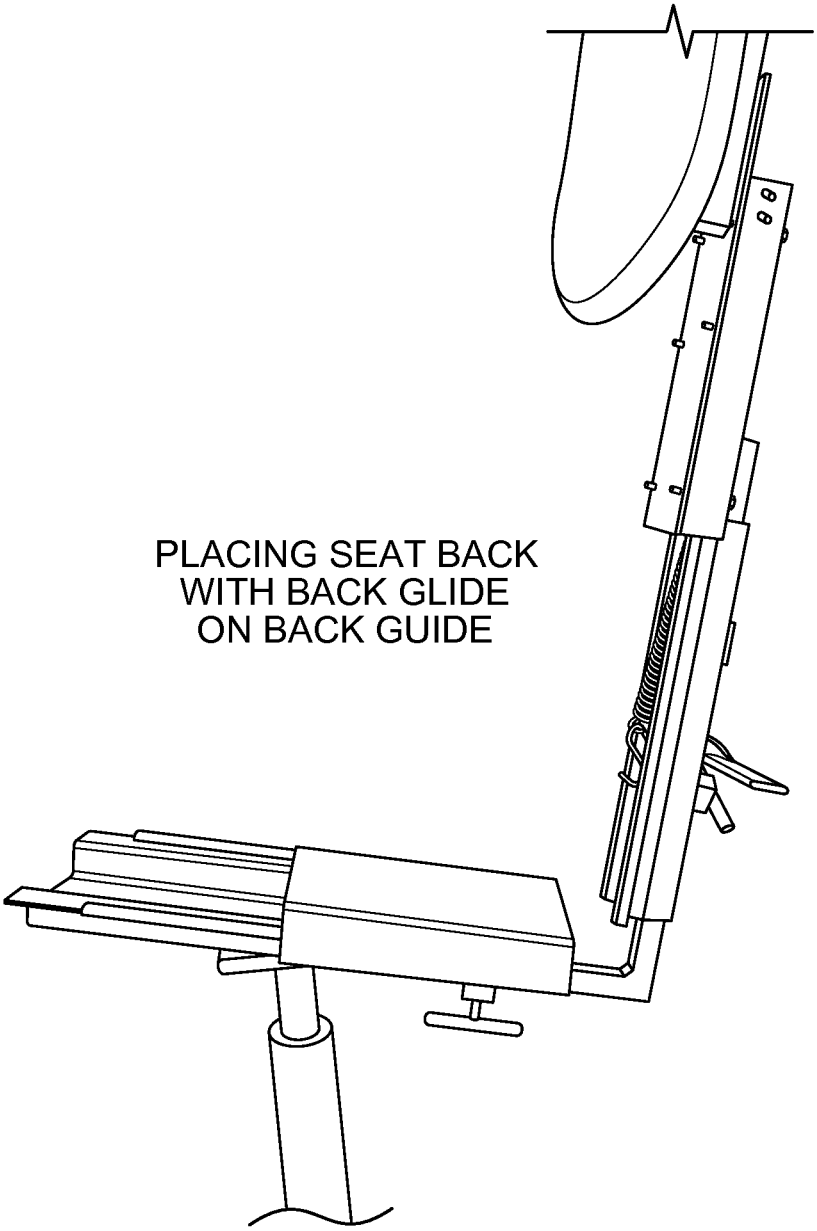
Figure 23:
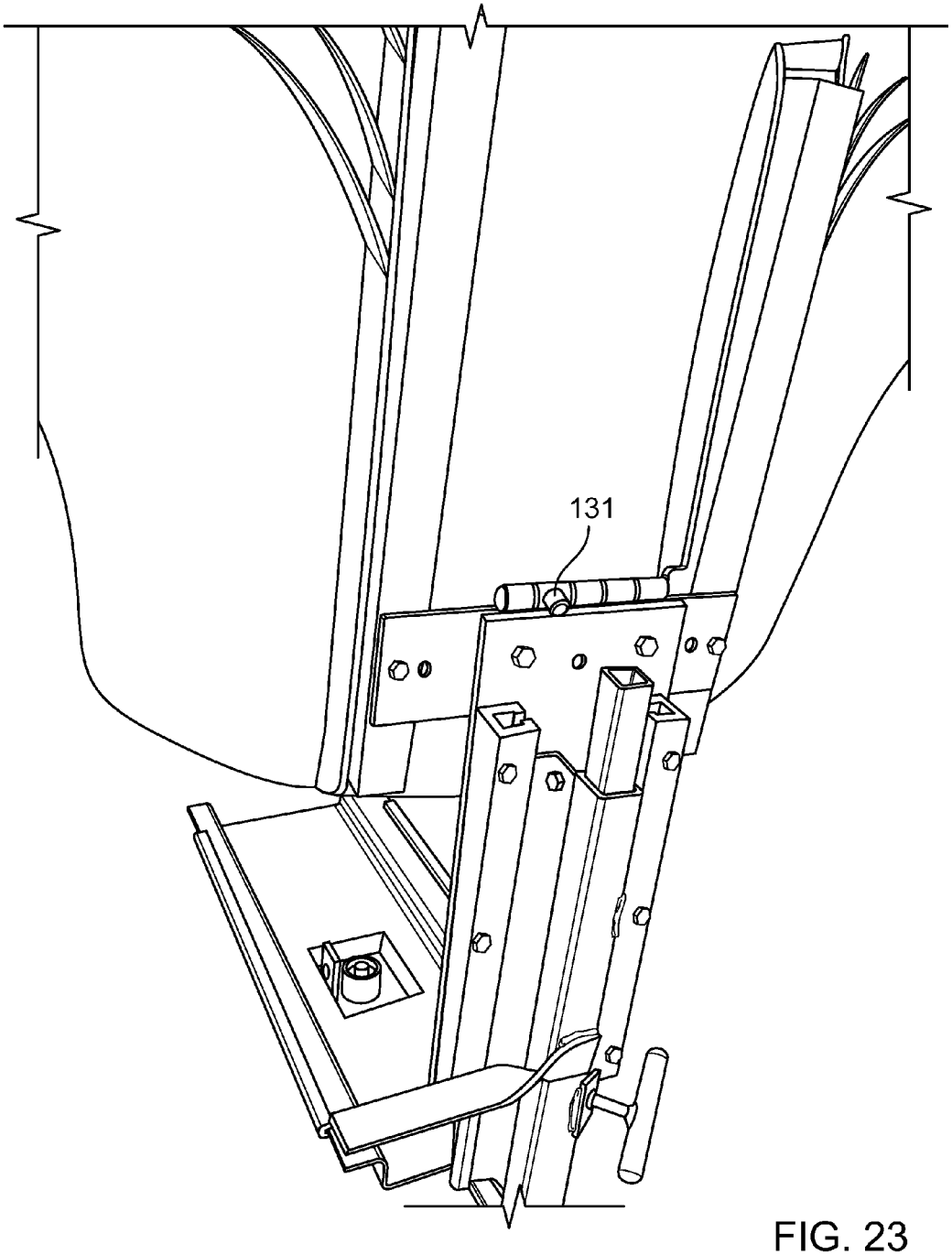

FIG. 19 shows the back glider detached from the seat. In some examples, the hinge that provides the axis of rotation is mounted on the top of the back glider and attached to the seat back. As the seat back and the back glider move up and down together, then, the axis of rotation also moves up and down. FIG. 20 shows the back glider on the back guide. FIG. 21 shows the back glider hinged to the seat back. FIG. 22 shows the chair back with attached back glider being placed on the back guide that is on a J bar. FIG. 23 shows the seat back attached to the back glider that has been slid onto the back guide that has been slid onto the J bar which has been slid into the seat guide. The back guide is adjustable up and down on the J bar. The J bar is adjustable in and out of the seat guide.

A wide variety of other structures can be used to support the seat pan and the seat back relative to one another, including examples described later.

A seat glider (we sometimes use the word "glide" interchangeably with the word "glider") 38 (see FIG. 1, for example) that is fixed relative to (for example, is attached to the bottom of) the seat pan 21 can rest on or be connected to the seat guide 30 to permit the seat pan to move slidably (or rollably) back and forth along the seat guide. Stops can be provided, for example, in the vicinity of the front and the back of the seating surface to limit the range of the seat glider as it moves back and forth. The stops prevent the seat glider from falling off. Also, for a person who is obese or has long thighs, the back seat glider stop can be adjusted forward to yield the same effect as if there were a longer seat pan by situating more of the seat pan under the distal thigh (the part nearer the knee).

The motion of the seat pan can be along channels or tracks defined by or on the seat glider 38 or the seat guide or along ball bearings held by the seat glider 38 or the seat guide or by a variety of other mechanisms. The seat pan 21 moves along the direction of motion 26 as the seat glider 38 moves relative to the seat guide 30 along the direction of motion 26. The seat pan 21 has a seating surface 22 substantially parallel to a horizontal floor to support a user during use. The seat pan 21 and, thus, the seating surface 22 can move along the direction of motion 26 in response to force exerted by the user seated on the seating surface 22 (e.g., in a direction away from or toward the back support 16) or under the force of gravity (e.g., in a direction toward the back support 16) because of the incline of the seat guide, or a combination of both. The user can apply such a force, for example, by pushing against the seat back or by pulling against her feet when they are engaged against the floor.

In some cases, the seating surface 22 and the direction of motion 26 defined by the seat glider 38 (or seat guide) 30 may be oblique to one another by an angle 61, with the seating surface 22 substantially parallel to a horizontal floor and the direction of motion 26 inclined relative to the horizontal floor during use. In some cases, the seating surface and the direction of motion need not be oblique to one another. The seating surface 22 is usually substantially parallel to a horizontal floor during use to provide a comfortable support to the user. The included angle 61 between the seating surface 22 and the direction of motion 26 may be constant as the seating surface 22 moves along the direction of motion 26, toward and away from the back-supporting surface 18.

The seat glider 38 is inclined relative to the horizontal floor during use which allows gravity to provide a small force tending to move the seating surface 22 in a direction toward the back support 16 and, additionally or alternatively, to position the direction of motion 26 along a path that can be substantially followed by a lower portion of the back support 16 as the back support 16 and the seat pan 21 move relative to one another (e.g., under force exerted by the user).

We use the term "path" broadly to include, for example, any pathway, line, direction, or route along which motion occurs. The path can be a line, an arc, a curve, a profile, or any combination or two or more of those. We sometimes use the term "direction of motion interchangeably with "path".

A spacer 43 can be disposed in the included angle 61 between the seat pan 21 and the seat glider 38 to support at least a portion of the weight of the user seated on the seating surface 22 and to define the included angle 61. For example, the spacer 43 can be disposed beneath the portion of the seat pan 21 closest to the back support 16. In certain implementations, the spacer 43 can be integrally formed with the seat glider 38 and the seat pan 21.

The back support 16 is coupled to the back glider 42 by a hinge 46 disposed between an upper portion 19 and a lower portion 20 of the back-supporting surface of the back support 16. The hinge 46 defines a horizontal axis of rotation 63 substantially parallel to the back-supporting surface 18 and substantially parallel to the seating surface 22. The axis of rotation 63 (FIG. 2) defined by the hinge 46 is non-convergent with the direction of motion 26 of the seat pan (e.g., the hinge 46 lies above the direction of motion 26). Rotation of the upper portion 19 and the lower portion 20 of the back support 16 about the hinge 46 can change the respective positions of the upper portion 19 and the lower portion 20 of the back-supporting surface 18 relative to the back guide 34.

In addition, the back glider 42 is slidably movable relative to the back guide 34 in a vertical or substantially vertical direction 27 (e.g., along channels defined by the back glider 42 or along ball bearings held by the back glider 42 or by another mechanism). The vertical or substantially vertical motion can occur while the back-supporting surface 18 rotates about the rotational axis 63 defined by the hinge 46 and as the seat glider is moving back and forth along the direction 26. In some implementations, a mechanism can be provided to apply an upward force to bias the back glider toward a top position of its vertical motion. In use, downward forces may be applied to cause the back glider to move downward, as discussed earlier. When those forces are released, the upward biasing force tends to return the back glider to its top position.

Figure 5:
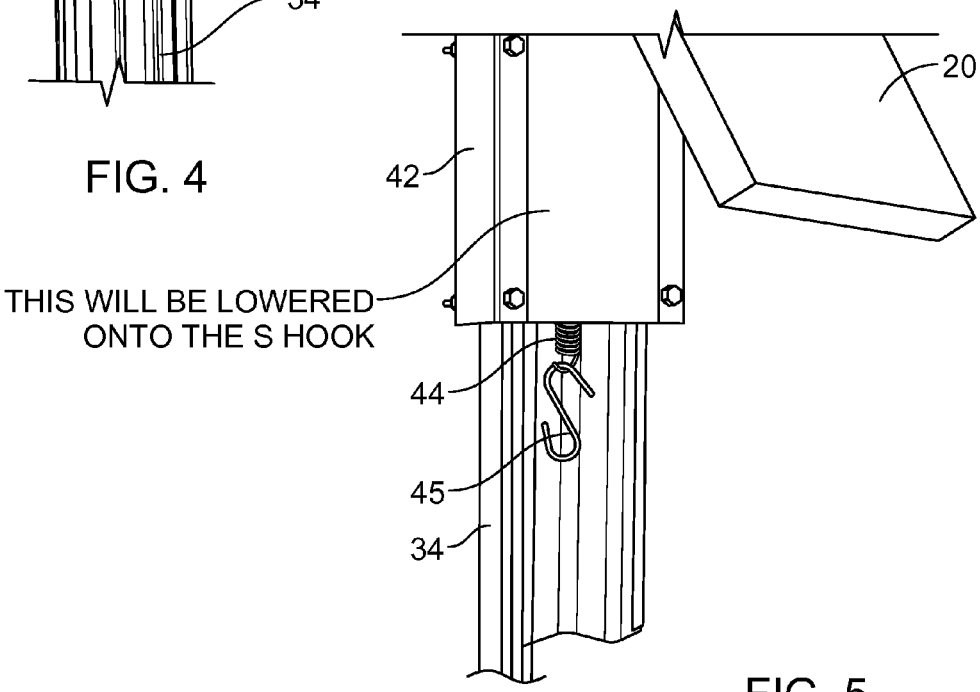
FIG. 5 is a partial perspective view of a back guide and a back glider of the seat of FIG. 1.
Figure 6:
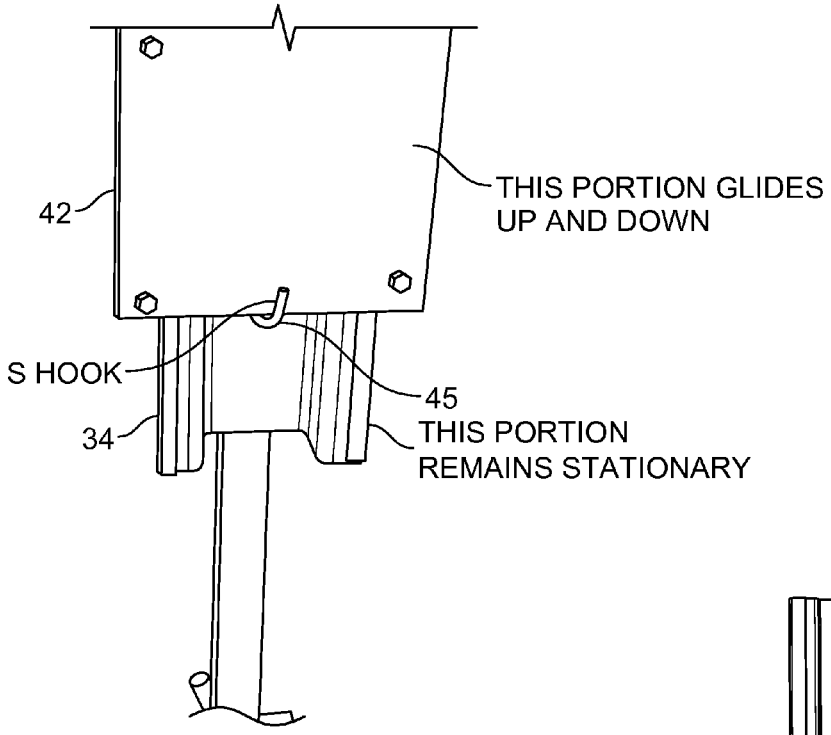
FIG. 6 is a partial front view of the back guide and the back glider of the seat of FIG. 1.
Figure 7:
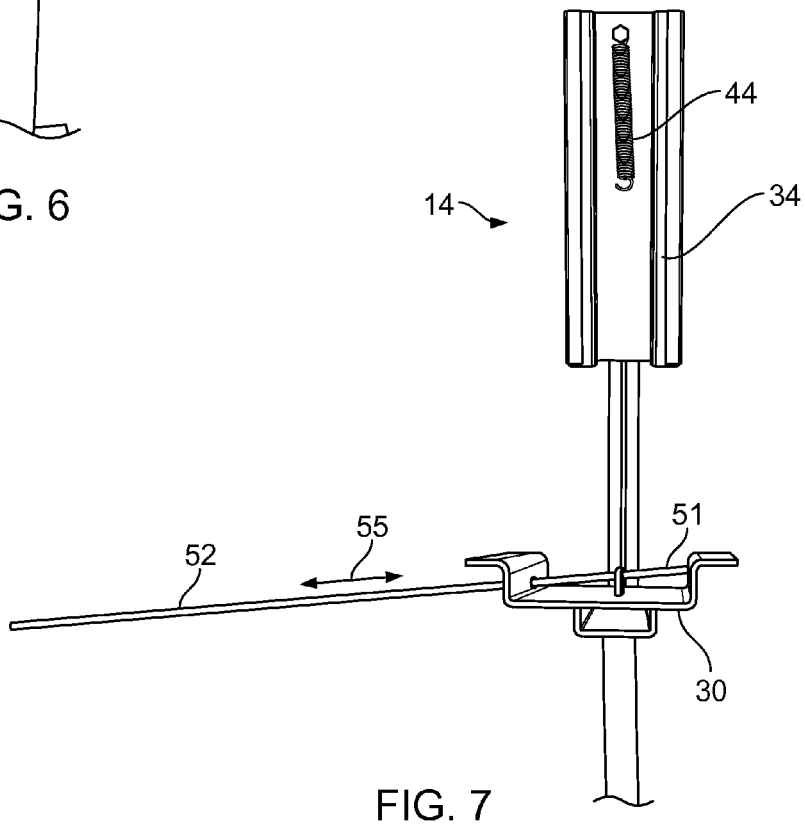
FIG. 7 is a partial front view of a support of the seat of FIG. 1.
Figure 8:
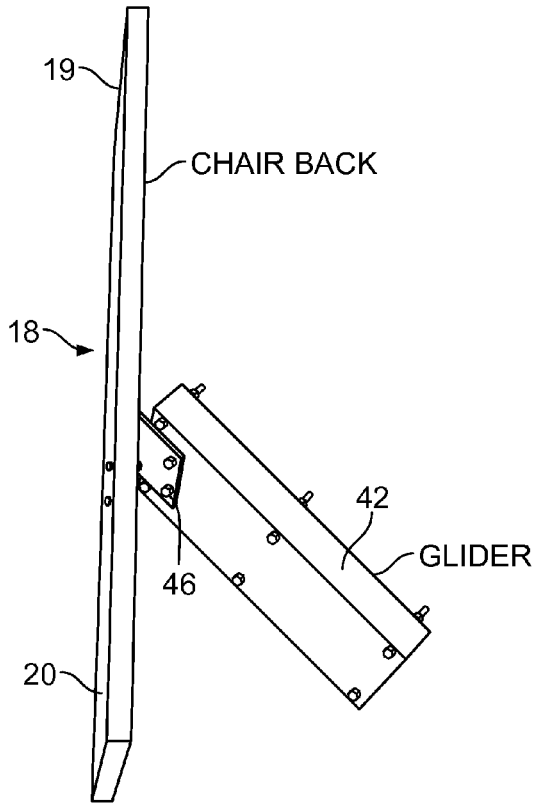
FIG. 8 is a perspective view of a back support and a back glider of the seat of FIG. 1.
Figure 9:
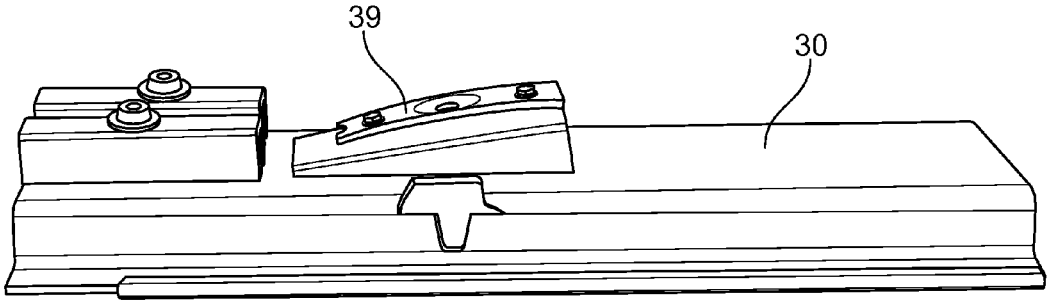
FIG. 9 is a perspective view of a seat guide of the seat of FIG. 1.

In some examples, as shown in FIGS. 5 and 6, a hook 45 is coupled to the back glider 42 and to one end of a spring 44 (e.g., a compression spring or a gas spring or an extension spring) that applies the upward biasing force. Other supporting devices rather than a hook can be used to support the back glider on the spring. Another end of the spring 44 is coupled to the back guide 34 such that movement of the back glider 42 downward along the vertical or substantially vertical direction 27 creates tension in the spring 44. The upward biasing force of the spring 44, in response to the tension, can return the back glider 42 to an original position (e.g., a position corresponding to the equilibrium length of the spring).

The back glider 42 can be slidably moved downward along the vertical or substantially vertical direction 27 by force exerted by the user's back as the user is seated on the seating surface 22, and the back glider 42 can be slidably moved upward along the vertical or substantially vertical direction 27 by force exerted by the spring 44, as the downward force of the user is lessened or removed. During use, the force exerted by the spring 44 on the back glider 42 can facilitate continuous vertical or substantially vertical adjustment of the back-supporting surface 18 at the same time as the seating surface 22 is moved along the direction of motion 26.

The spring 44 adjusts the height of the back-supporting surface 18 relative to the direction of motion 26 as the lower portion 20 of the back-supporting surface 18 moves in effect parallel to the direction of motion 26. The vertical or substantially vertical travel of the back-supporting surface from its resting point (which we sometimes calls it top position) downward will vary but could be as much as 11.43 cm (or more, for example, 18 cm of vertical travel or more) in some implementations. When we refer to motion of one element of the structure that is parallel to motion of another element of the structure, we mean parallel broadly to include, for example, motion by both elements that is along exactly the same path generally along the same path; motion of the elements along respective different paths that extend in the same direction, are equidistant at all points and never converge or diverge; and motion along respective different paths that extend generally in the same direction but may diverge or converge.

In some implementations, the spring 44 is disposed between the back guide 34 and the back glider 42 such that the spring 44 remains substantially concealed during use of the seat 10. This can reduce the likelihood of inadvertent contact with the spring during use, which can improve the safety of operation of the seat 10.

As shown in FIG. 13, in some implementations, the back glider can be formed of a tube 70 that can slide vertically within a slightly larger tube 72 that is fixed to a stationary column 74 of the support. The upper ends of extension springs 78 can be mounted on opposite sides of the column (only one spring is shown) and the bottom ends attached to the bottom of the tube 70 to provide the upward biasing force. In some implementations, tubes 70 and 72 can be parts of a gas cylinder that has a compression spring (to provide the upward biasing force) between the bottom inside wall of the tube 72 and the bottom of the tube 70, which is enclosed in the tube 72. In these implementations, the sitter can rotate the seat back, lean against the seat back and rotate to seated user's left and right. Arrangements can be made to control the left and right rotation. When arrangements of the kind shown in FIG. 13 are used, there may be no need to include a back glider or a back guide in the structure that supports the seat back. The tubes 70 and 72 (and any gas cylinder of which they are part) can themselves provide the supporting and sliding functions in addition to providing the upward biasing function.

In some implementations, the rotation of the back-supporting surface 18 changes the included angle 59 between the seating surface 22 and the back-supporting surface 18, for example, at times when the seating surface 22 moves along the direction of motion 26. In certain implementations, the rotation of the back-supporting surface 18 relative to the seating surface 22 in conjunction with motion of the seat glider along direction 26 causes the included angle 59 to vary through a range from a minimum of about 90 to 100 degrees to a maximum of about 140 to 160 degrees. (The degrees of maximum angle for seating surface to back-supporting surface and maximum angle of direction of motion and back-supporting surface in testing measures about the same.) The measurement should be less for the direction of motion measurement by the difference in the angle of the seat guide and the seat pan which is the angle between the direction of motion and seat pan which can average from 0 degrees to 10 degrees.)

In addition to the components already mentioned, the support 14 includes a column 50, an actuator 52 (FIG. 14), a support portion 54, and wheels 58. The column 50 extends upward from the support portion 54 into a wedge portion 39 attached to the seat guide 30 in the example shown in the figures, but alternatively or in addition could extend into a tapered cylinder that can be attached to the seat guide in different ways to provide the incline of the seat guide 30. The wedge portion 39 spans the angle between the seat guide 30 and a horizontal floor surface. The support portion 54 is coupled to the wheels 50 to facilitate movement of the seat 10 over the floor surface (e.g., over short distances relative to a desk).

The column 50 can be a gas cylinder such that movement of the actuator 52 (e.g., a lever) changes the height of the column 50 and, thus, the height of the seat guide 30 and the back guide 34 above the floor. The user can activate a lever 52 to adjust the height of the column 50 to achieve comfortable positioning of the user's legs relative to the floor (e.g., a higher height for upright seated positions and a lower height for reclined positions).

The same lever 52 can also be arranged to be able to stop the seat glider from gliding, at any one of a number of positions along its forward and backward path of motion.

As shown in FIG. 14, for this purpose a series of holes 101 is provided in a metal plate 103 that is attached to the bottom of and along the length of the seat pan 21. Each hole is large enough to accommodate the diameter of the end 51 of the rod of the lever 52. The end 51 is supported in and movable through a hole in a metal support 57 that is fixed to the seat guide. The rod and lever can be moved back and forth to the left and right in the FIG., as indicated by arrows 55. A set screw 53 mounted in the rod serves as a stop to prevent the lever from being pulled to the left so far that the end of the rod would no longer be supported in the hole in the metal support 57.

When the rod is pulled to the left so that the end 51 is withdrawn from any of the holes of the metal plate that is attached to the seat pan that is attached to the seat glider, the seat glider can glide back and forth freely. When the user wishes to stop the gliding motion of the seat glide, the rod can be inserted into any one of the holes 101 to temporarily fix the position of the seating surface at a selected one of a range of different positions along the gliding path. The lever also remains usable to control the top valve of the gas cylinder to control the height of the seating surface as explained above.

Figure 27:
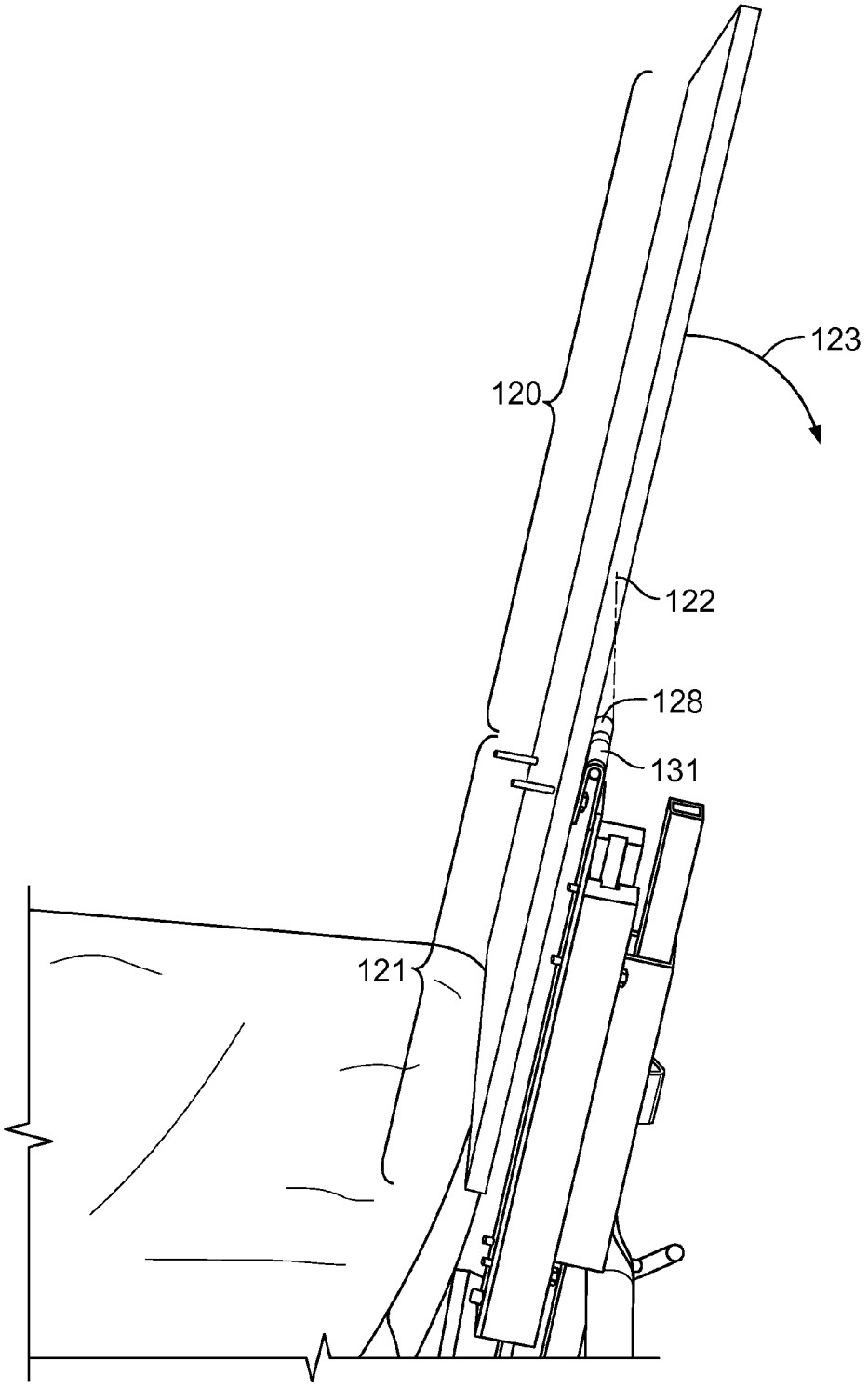

In many implementations, the axis of rotation of the seat back is in the plane of the seat back and the portion of the seat back above the axis of rotation is heavier than the portion of the seat back below the axis of rotation. As shown in FIG. 27, the latter configuration will exist, for example, if the seat back is uniformly thick and the portion 120 above the hinge is longer than the portion 121 below the hinge. Then the center of gravity 122 of the seat back will lie slightly behind the position of the hinge as shown by the thin vertical line. The seat back will therefore tend to rotate backwards 123 when the seat is not occupied. In some examples, the rotation backwards can be and is stopped before the seat back rotates beyond a predetermined position (for example upside down) by the detent mentioned earlier. The detent 131 can take the form of a bolt that is attached to or otherwise interacts with the hinge that forms the axis of rotation of the seat back, so that the extent of rotation is limited when the rotation reaches a predetermined angle. A wide variety of other arrangements are possible to reduce or stop the rotation of the seat back. And the angle at which rotation will be reduced or stopped can be altered, either by design or by the user in some implementations. Even with the detent, the rotation of the seat back can make the chair appear to be broken. In some implementations, therefore, the seat back is mounted more forward so that its center of gravity is directly above the axis of rotation (that is, is in a natural balance point) when the seat back is in what appears to be a normal generally upright position. The detent is then placed to stop the rotation of the seat back just before the seat back reaches the balance point at which the seat back is generally upright. Then, when an individual gets off the chair, the back rotates to the vertical-neutral position and stops. Hence, there is no appearance of a broken chair.

Figure 28:
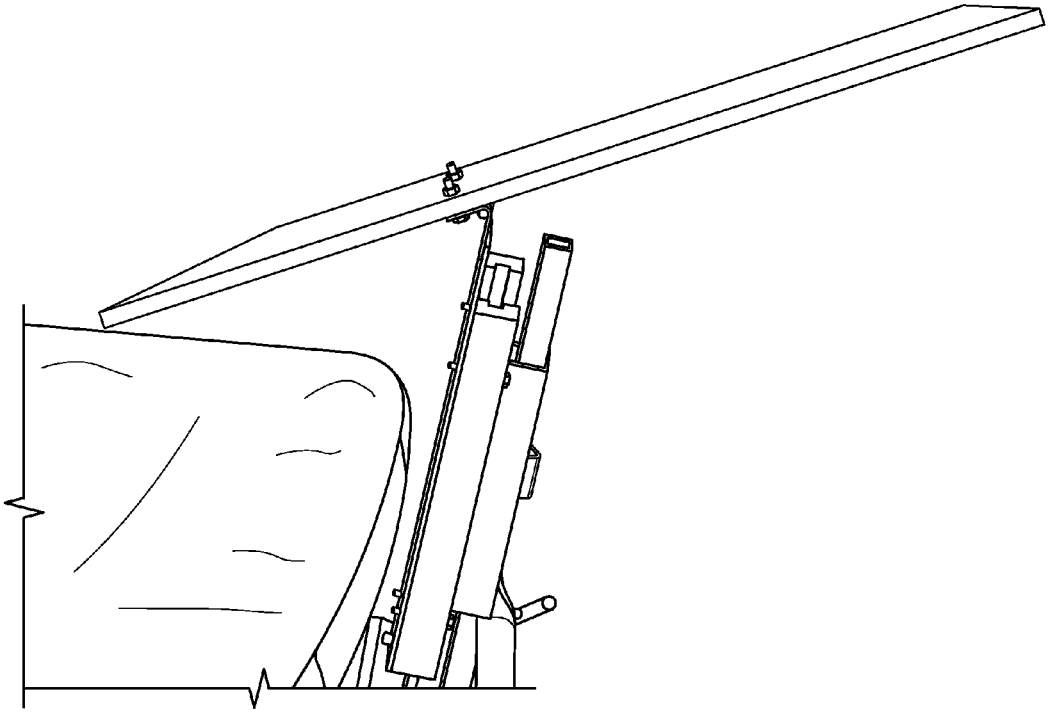
Figure 29:
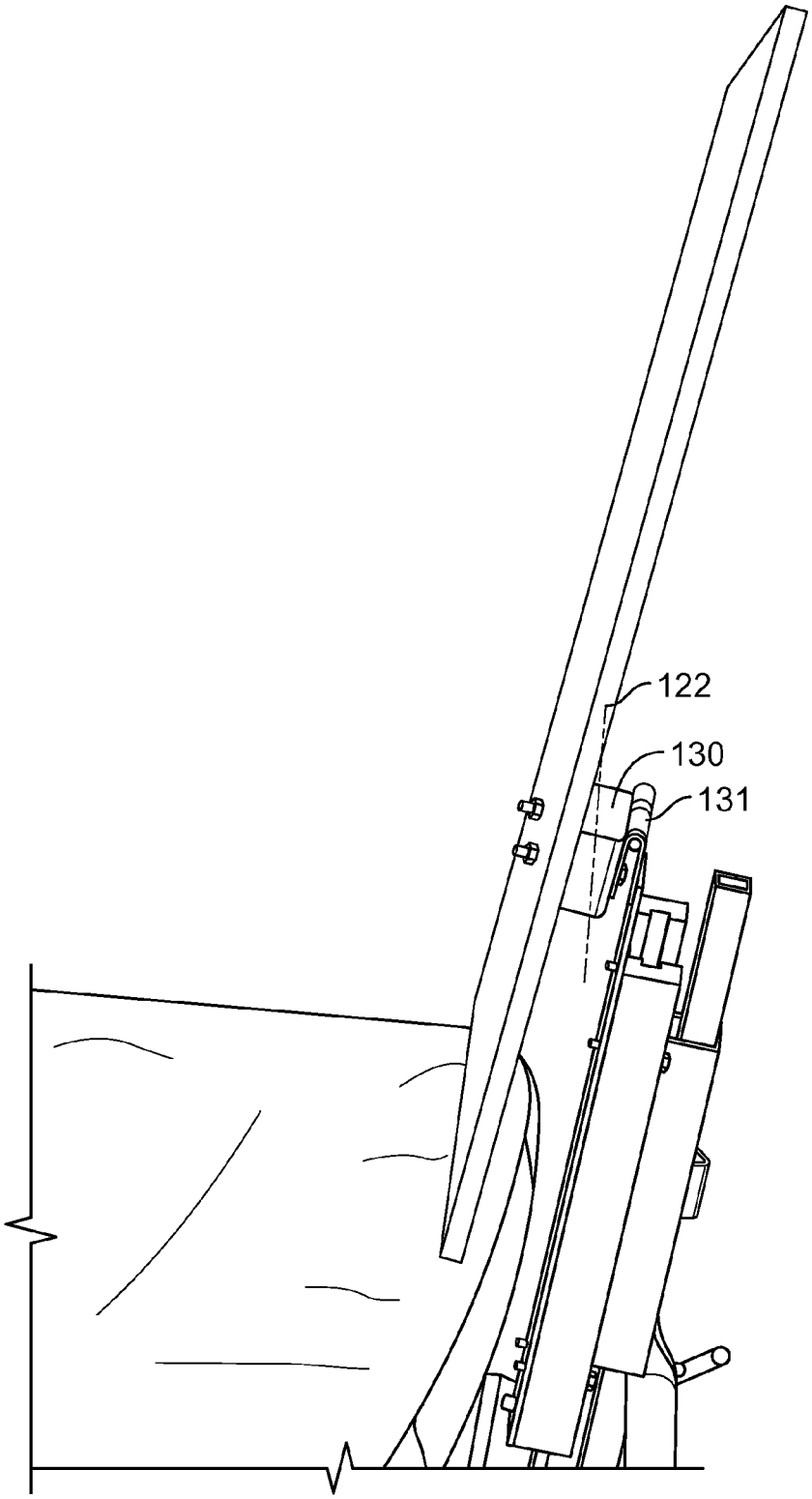
Figure 30:
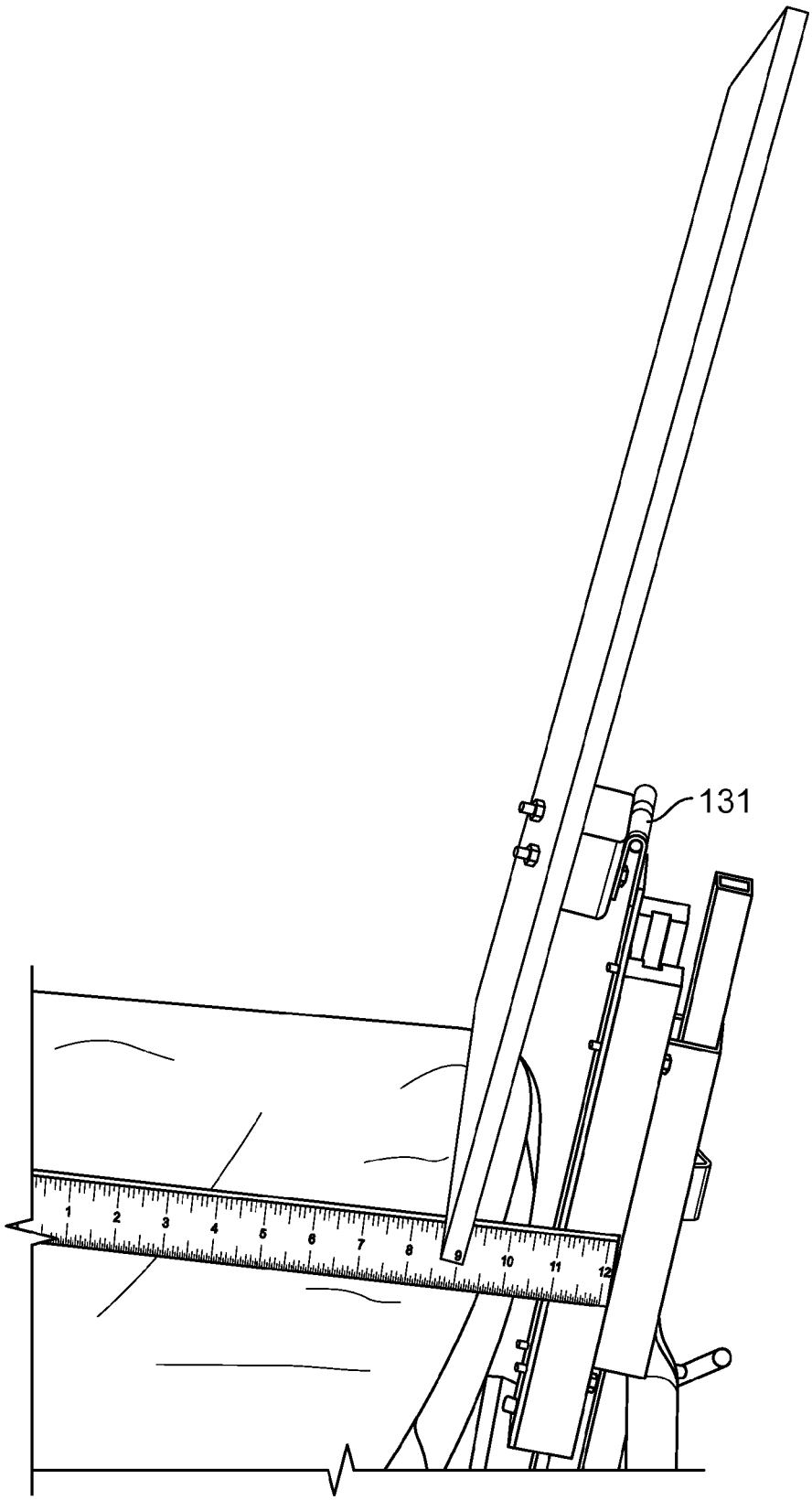
Figure 31:
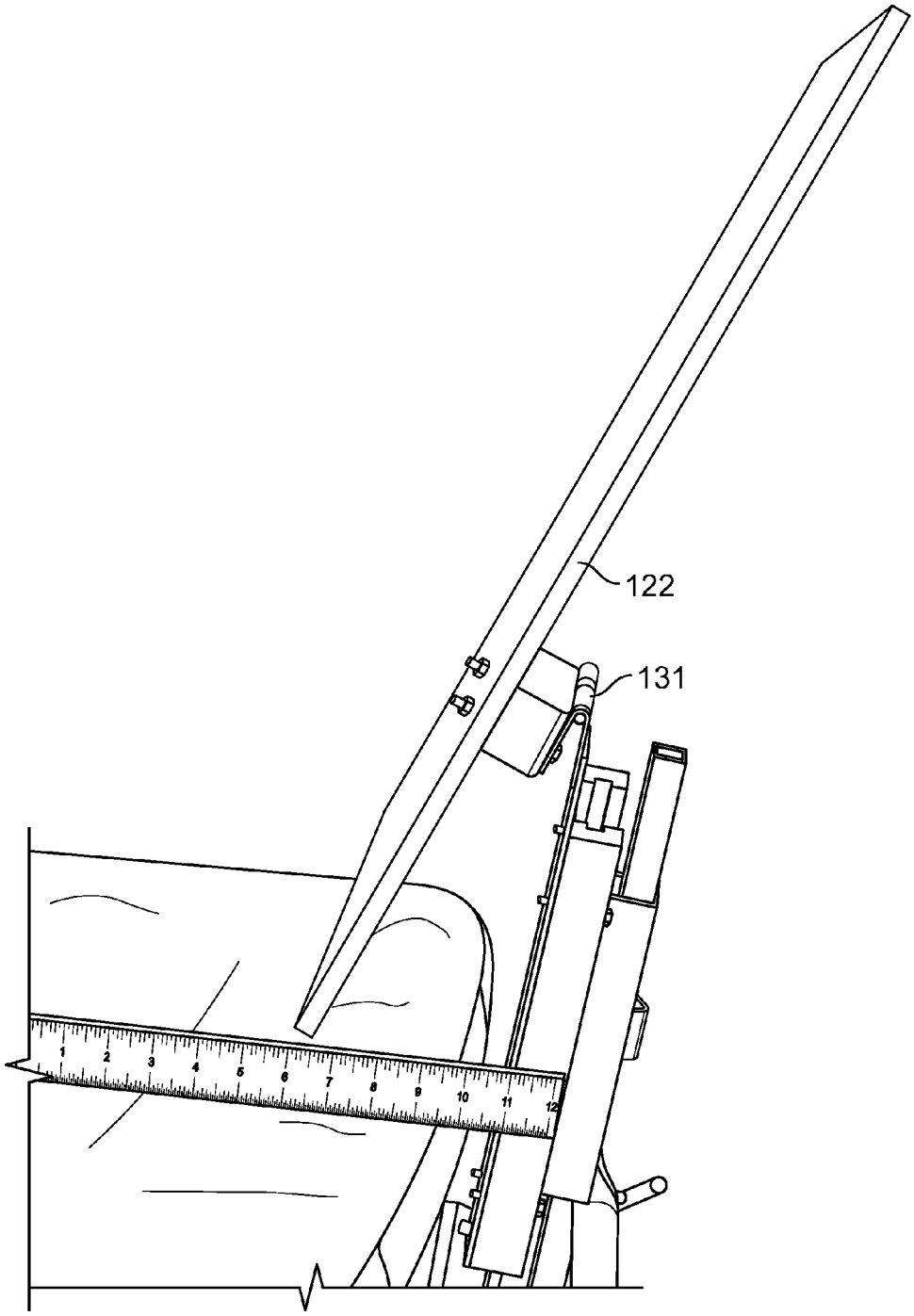
Figure 32:
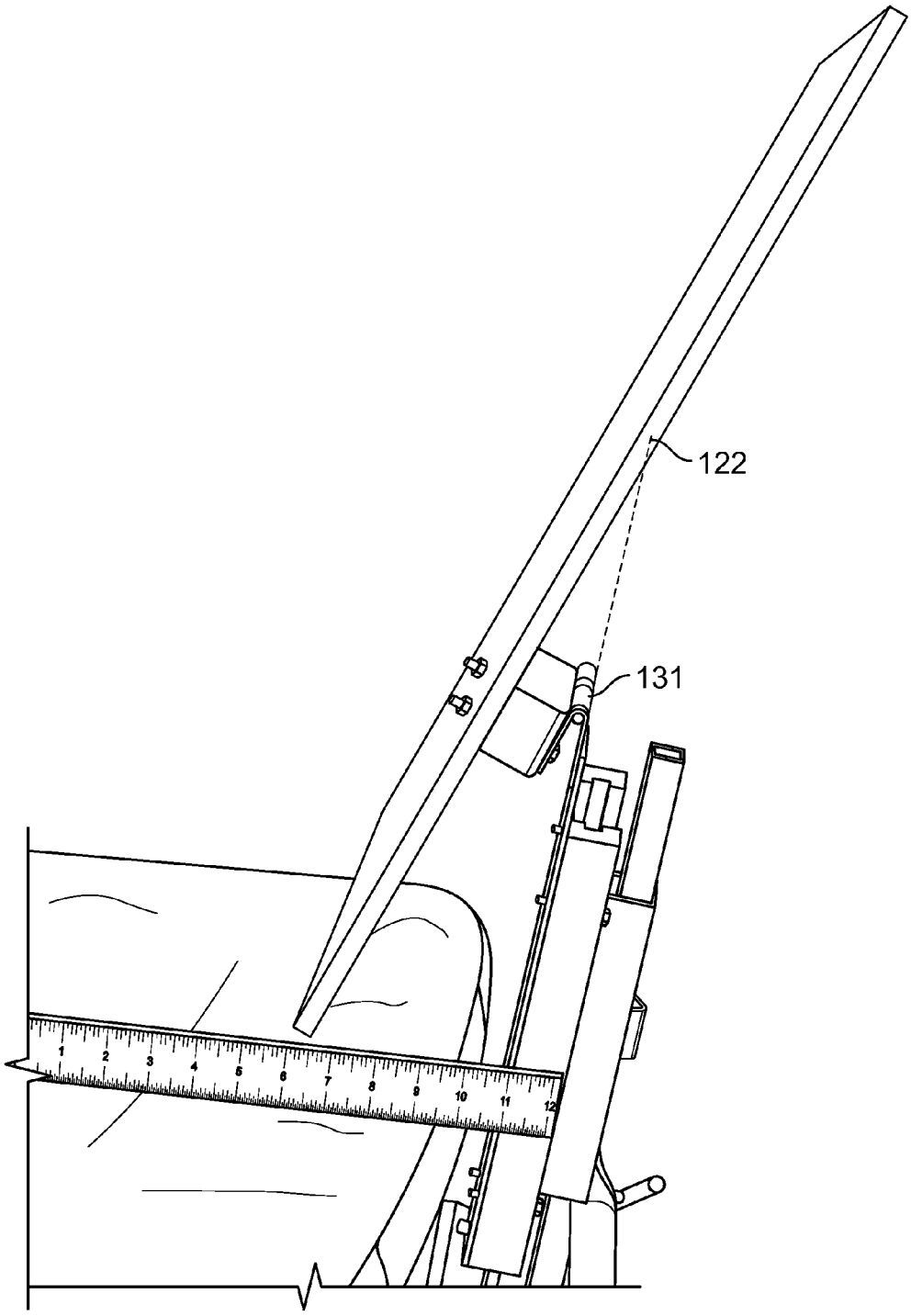

This arrangement is illustrated as follows. In FIG. 27, the seat back is shown with the axis of rotation 128 in the plane of seat back. The seat back must be held (as it is being held in the FIG) to remain upright. In the FIG, the seat back is being held in its fully forward position with the hinge, which is fully closed, preventing any further rotation forward. However rearward rotation is possible, and, if the individual holding the back in place releases the back, the back rotates back 123 until the detent stops it (preventing it from flopping all the way over). In FIG. 28, after the back is released, the seat back has rotated back to its resting position against the detent and the chair may appear to be broken. In FIGS. 29 and 30, the seat back has been re-attached to be more forward of the axis of rotation using a block 130. Now the center of gravity of the seat back is forward of the hinge which tends to bias its rotation forward to its upright position where it does not look broken. Therefore, the seat back remains naturally balanced in an essentially vertical position without being held. In FIG. 31, the seat back has been rotated relative to its position in FIG. 30 so that the center of gravity is now exactly above the hinge and the seat back is balanced. From the position in FIG. 30, the slightest rotation forward of the seat back will place the center of gravity forward of the hinge and the seat will automatically be rotated to the position of FIG. 30.

When the seat is in use, movements of the back support 16 and the seat pan 21 change the seating position of the user. Because the back support and seat pan positions can be frequently or continually changed, the user can make continuous positional adjustments while seated on the seat 10. In some instances, these continuous adjustments can facilitate strengthening the user's anatomical core muscles (e.g., abdominal muscles, oblique muscles, erector spinae, etc.) or allow the user to burn more calories or cause motion of spinal joints which enhances nourishment of the joints and reduces or prevents degeneration of the joints as compared to passively sitting on a seat that does not adjust itself dynamically as the one we describe here does or achieve any combination of two or more of these benefits. Additionally or alternatively, the relative movements of the back support 16 and the seat pan 21 allow the back support 16 to maintain consistent support on the user's back (e.g., a lumbar portion of the user's back) over a range of adjustable seating positions, reducing the likelihood of injury to the user.

Referring now to FIGS. 10A and 10B, the relative movement of the back-supporting surface 18 and the seating surface 22 results in a continuously adjustable seating position that provides consistent support to the user's back (e.g., each point of the back-supporting surface 18 remains in contact with a corresponding point on the user's back, as the user slides the seating surface 22 along the direction of motion 26).

This effect is achieved by a somewhat complicated motion of the back-supporting surface 18 and its lower portion 20 relative to the seating surface 22 and the motion of the seating surface back and forth along the direction 26. The back-supporting surface 18 is mounted to permit it to rotate 190 about the horizontal rotational axis 46. The axis in turn is mounted to permit it (and the back-supporting surface that is held on it) to move up and down 27. The seating surface is mounted to be able to glide back and forth along the direction 26. The movements of the back-supporting surface and the seating surface occur in response to movements and forces of the user, the force of gravity, and the upward biasing force applied to the back glider.

As the back-supporting surface 18 rotates about the axis 46, its lower portion 20 would (if there were no vertical or substantially vertical motion 27) follow an arc 25 centered at axis 46. The back-supporting surface 18, however, can move vertically or substantially vertical at the same time it is rotating about axis 46. As a result of the combination of the rotation and downward movement, with the seat occupied, the lower portion 20 will tend to traverse a path 251 that is not an arc of a circle but, in some implementations, is essentially parallel to the motion of the seating surface 22 back and forth along the direction 26, or in some cases a shallow curve 251, or in other cases more complex trajectories. Because of this motion, the position of the bottom of the back-supporting surface relative to the rear of the seating surface need not change significantly even though the user's body is moving and shifting significantly.

The length of travel of the lower portion 20 of the back-supporting surface along path 251 is mainly determined by the length 31 of the portion of the back-supporting surface below the axis and the height 29 of the axis relative to the seating surface (both heights being adjustable). For example, if the height 29 is 22.86 cm (9 inches), then the lower portion 20 can move almost that distance 31 in a direction roughly parallel to the direction of motion 26 of the seating surface 22.

In some implementations, the back-supporting surface 18 is not encumbered in its motion by attachment to any part of the seat guide or seat glider. The back-supporting surface is attached to the back glider which glides on the back guide which is attached to the J bar which is attached to the seat guide. However, this does not encumber the rotation of the back-supporting surface at all. And it does not encumber the vertical or substantially vertical motion within the amount the spring allows. The parts that rotate and glide vertically or substantially vertical are not attached to the seat guide and are not attached to the seat glider. Without a user occupying the seat, the amount of rotation 190 of the back-supporting surface therefore can be 90° or greater about the axis 46 and the length of travel of the bottom of the back-supporting surface along path 251 is only limited by the length 31 from the lower end of the back-supporting surface to the axis 46.

When a user is on the seat, the rotation of the back-supporting surface and the gliding of the seat glider are functions of, for example, the size, weight, and proportions of the user, forces applied by the user, gravity, the upward biasing force on the seat back glider, and the conscious and subconscious responses and biofeedback of the user.

FIGS. 24, 25, 25A, and 26 illustrate examples of trajectories of the bottom edge of the back-supporting surface assuming that the axis of rotation of the seat back always lies on the Y axis at the left side of each figure. Up and down motion of the axis of rotation is shown to occur along the Y axis which is vertical (but in fact the up and down motion need not be strictly vertical, but could be substantially vertical, or along some other path). The numbers along the vertical axis in the FIGs represent inches of vertical distance. The value 0.0 on the vertical axis represents the uppermost possible position of the axis of rotation. Numbers shown along the axis below 0.0 indicate distances below that point in inches. The FIGs present graphs of the trajectories as the seat back is rotated about the hinge and as the hinge moves up and down along the Y axis, under three different scenarios.

Figure 24:
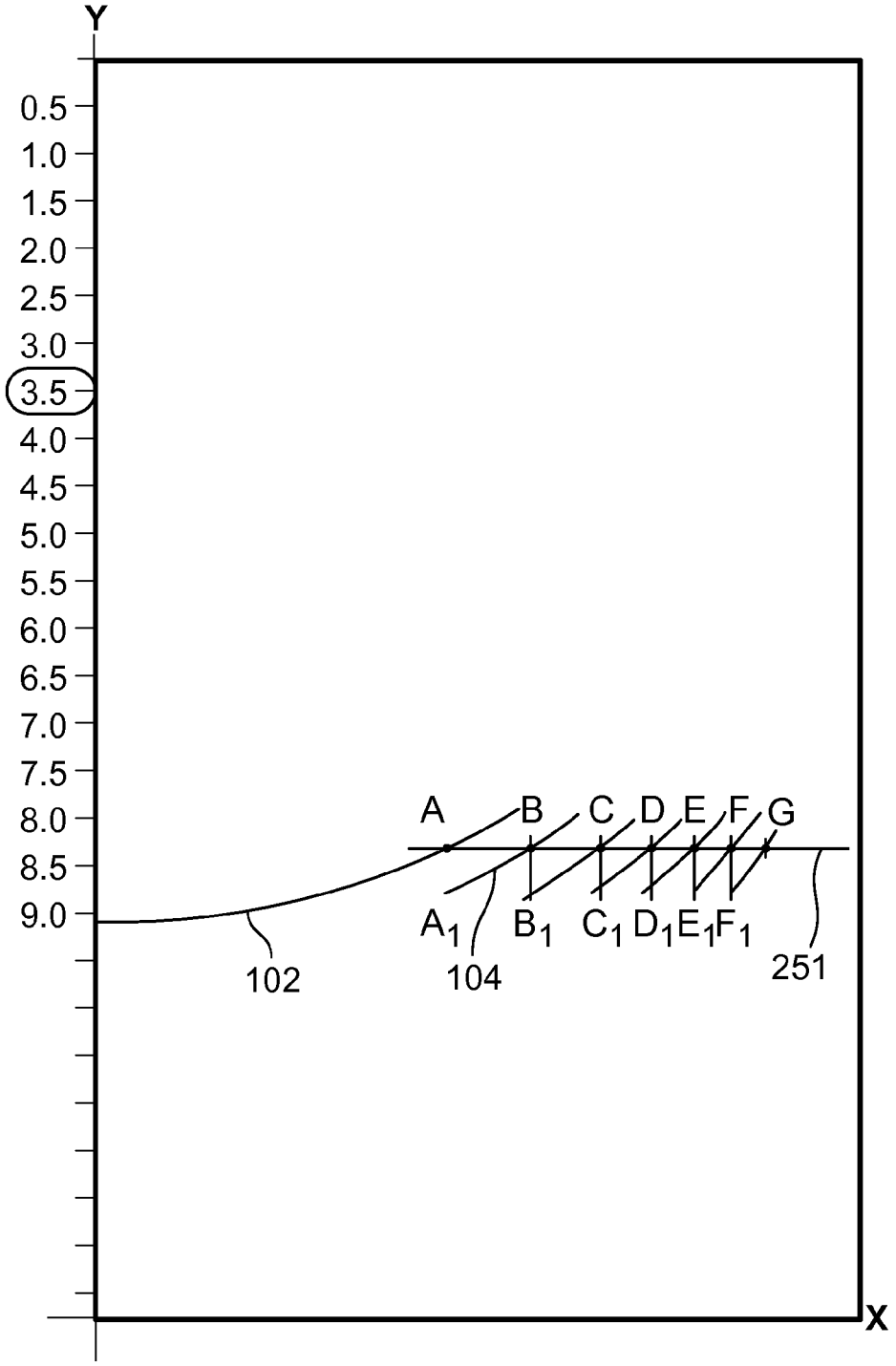
Figure 25:
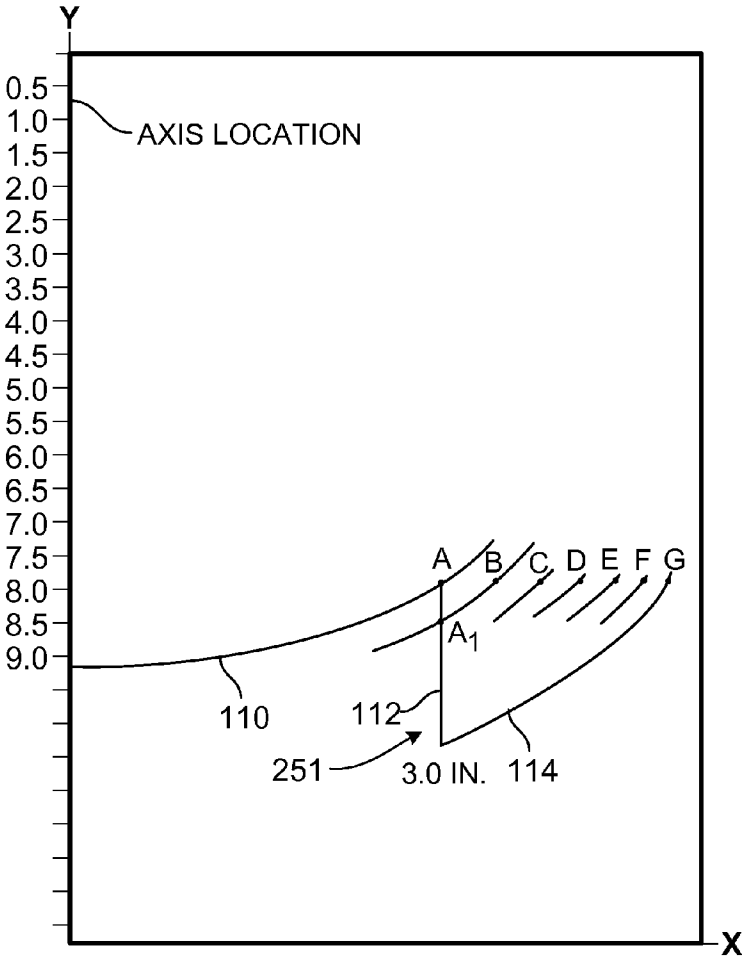
Figure 26:
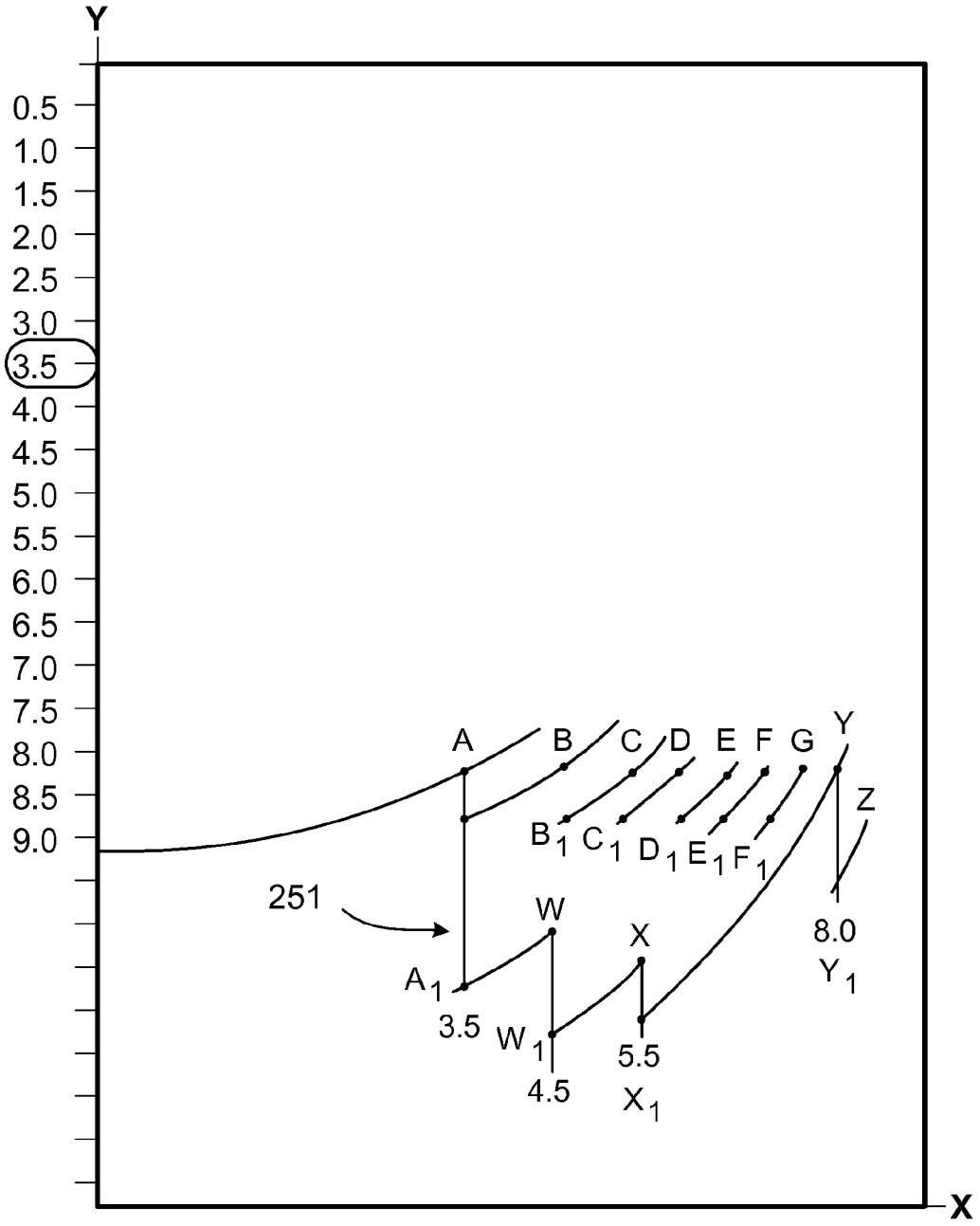

In the FIGs, the vertical locations of two points associated with the seat back can be gauged along the vertical (Y) axis. One point is the bottom of the seat back. The other point is the vertical position of the axis of rotation. The two points move up and down together because the axis of rotation (the hinge) is attached to the seat back. The difference between the vertical positions of the two points varies, however, as the seat back is tilted even though the distance 31 (FIG. 10A) between the axis of rotation and the bottom of the seat back—as measured along the seat back—is fixed. In the examples of FIGS. 24, 25, and 26, the distance 31 is 8.5 inches, the initial axis location is at a little more than about 0.5 inches (below an uppermost theoretical position) and the bottom point of the seat back on the Y axis is at a little more than about 9.0 inches.

From this position, if a user were to push down vertically or substantially vertical on the seat back, the hinge, which is the axis of rotation, would move down the Y axis together with the seat back and its bottom. If one were to rotate the seat back to an orientation in which it is parallel to the floor and then push down on the axis the bottom of the seat back would slide up and down the Y axis by amounts identical to the sliding up and down of the hinge. But the vertical distance between the height of the hinge and the height of the seat bottom would be and remain 0 inches. And if one were to rotate the seat back so that it was 3.0 inches lower than the hinge, when pushing down on the seat back, the hinge would glide down with the bottom point, along the Y axis. The bottom of the seat back reading on the Y axis would always be 3.0 inches lower than the axis of rotation as they glide up and down the Y axis.

By way of further explanation of the motion of the bottom of the seat back, and with reference to FIGS. 37 and 38:

1. Values along the Y axis represent a vertical path along which the hinge, the axis of rotation, and the back glider to which it is attached travel vertically. The Y axis 71 can represent the vertical part 67 of the J-bar 69 (and a hypothetical extension of the J-bar 69) in FIG. 1, for example.

2. The X axis represents the horizontal component of the arc traversed by the bottom edge of the seat back as it travels downward and pivots out from the hinge.

3. Each vertical marking on the Y axis represents 1 inch.

4. Distance 31 shown on FIG. 10A is the length of portion of back-supporting surface below the axis. In this example it is 8 inches. Hence, the bottom edge of the seat back is 8 inches below the hinge when at rest in the vertical posture.

5. With the axis of rotation at 0, 0, the bottom edge of the seat back rests at point 0,−8.

6. If the hinge, the axis of rotation, is at rest is at 0,0 and one leans against the upper back, the lower edge of the seat back travels the route designated by the arc A-B.

7. If the hinge, the axis of rotation, is at rest is at 0, −2 and one leans against the upper back, the lower edge of the seat back travels the route designated by the arc C-D.

8. If the hinge, the axis of rotation, is at rest is at 0, −4 and one leans against the upper back, the lower edge of the seat back travels the route designated by the arc E-F.

9. If the hinge, the axis of rotation, is at rest is at 0, −6 and one leans against the upper back, the lower edge of the seat back travels the route designated by the arc G-H.

10. If the hinge, the axis of rotation, is at rest is at 0, −8 and one leans against the upper back, the lower edge of the seat back travels the route designated by the arc I-J.

In use, the hinge travels down the Y axis as the bottom edge of the seat back travels down and swings out along its arc; this occurs at various vertical to horizontal ratios of the bottom edge. The outward swing is measured along the X axis. In this example with the hinge at 0,0, the bottom edge of the seat back swung out along arc A-B to point a and then the hinge continued traveling down the Y axis. By the time the hinge reached 0,−2, the bottom edge of the seat back had swung out and reached point c. The hinge continued to travel down the Y axis and when it reached 0,4 the bottom edge of the seat back reached point e and when the hinge traveled down vertically to 0,−6 the bottom edge of the seat back reached point g. FIG. 37 represents the vertical drop of the hinge with accompanying vertical drop and outward swing of the bottom edge of the seat back using a sample 8 inch vertical drop in 2 inch increments of the hinge along the J-bar of FIG. 1 represented by the Y axis of the chart. In reality the rate of drop and arc swing varies. It is continuous small increments that coalesce to form a composite trajectory. The resultant travel of the bottom edge of the seat back is represented by the line a-i, a line of travel known to an observer but support and comfort experienced by the user.

Because the seat back can rotate, the position of the bottom point of the seat back can move left and right along the X axis. And up and down motion of the seat back also affects the position (vertically) of the bottom point of the seat back.

FIG. 24 includes a series of possible rotational arcs 102, 104 of the bottom of the seat back each of which is associated with a corresponding vertical position of the seat back hinge. Each arc is shown to include a starting position (for example, A1 for arc 104), and a second position (for example, B, for arc 104). In theory, the bottom of the seat back could traverse any path that leads from a point on each of the arcs to a point on the next arc, and so on. However, because the user's body serves as a coupling between the seat back and the seat pan during use, and because the seat pan glides back and forth along a path determined by its mounting on the seat guide, one typical trajectory of the bottom of the seat back would be along the straight path 251 formed as a composite of the positions A, B, C, D, E, F, and G that lie on the series of theoretical arcs of the bottom of the seat back for different vertical positions of the horizontal axis of rotation of the seat back. In other words, in a typical use as shown in FIG. 24, the user's body keeps the bottom of the seat back moving substantially along a path 251 that corresponds to the path along which the seat pan is moving. The trajectories in the FIGs do not take account of the fact that the track of the seat glider is canted slightly upward. For example, in actual use, the buttocks of the user would move along a slightly inclined path 251 and by the coupling effect of the user's body, the lower part of the seat back would also traverse a slightly inclined path 251. Similarly, the vertical axis Y in the figures suggests that the seat back would be vertical at its starting position, but in fact it can be inclined as discussed earlier.

A wide variety of actual trajectories (an almost limitless variety) 251 of the bottom of the seat back are possible such that each of the trajectories represents a composite of possible points on the various possible arcs of the bottom of the seat back for different vertical positions of the seat back. In some cases, the path 251 could be a gentle curve 251 rather than a straight path depending on the user's motions. In FIG. 24, the distances from point A to B, B to C, C to D, D to E, E to F, and F to G are successively smaller and smaller. In effect, the rotation of the back-supporting surface has less and less effect on the motion of the bottom of that surface along path 251, which is a function of the geometry of the back-supporting surface and its axis of support. FIG. 24 can also be interpreted literally as a series of trajectories that involve small vertical motions of the back and small rotations of the seat back as shown.

As shown in the case of FIG. 25, some sequences of motion can be less continuous than the one illustrated in FIG. 24. In the example of FIG. 25, the back-supporting surface is rotated through a path 110 with the rotational axis at about 0.5 on the Y axis, then a vertical drop 112 (of the hinge and the bottom of the seat back) of 3.0 inches occurs, and the surface is rotated again 114 to reach point G.

In some uses, the user could stop the motion of the vertical glide or limit the rate of vertical glide motion and accentuate the rotation of the back-supporting surface to cause a variation of the path of the end of the lower seat back. In some uses, the user could stop or limit the rotation and emphasize the vertical glide motion. A wide variety of motion paths can result. In some cases, the back-supporting surface only rotates through an arc to a point where the path of the lower end of the back-supporting surface is essentially parallel to the motion of the seating surface or the path is any combination of an arc and a parallel path (which is a flattened arc). The range and complexity of possible motions can yield many beneficial and varying affects with the outcome of comfort and health.

A more complicated example is shown in FIG. 26 in which the path includes an initial rotation with the axis at 0.5 inches followed by paths from A to A1, from A1 to W (for which the axis of rotation has been pushed down to 3.5 inches), W to W1, W1 to X (for which the axis of rotation has been pushed down to 4.5 inches), X to X1, X1 to Y (axis at 5.5 inches) Y to Y1, and Y1 to Z (axis at 8.0 inches).

In many implementations, the path of the bottom of the back support surface is a flattened arc. In FIGS. 10A and 10B note how the arc 25 becomes the flattened arc 251 as a result of the axis 46 lowering in FIG. 10B versus FIG. 10A. FIG. 10B shows the seat back in three different vertical positions and rotated to three different angles. FIG. 10B also shows three different arcs 1, 2, 3, of the lower edge of the seat back that could occur when the seat back is respectively in each of the three vertical positions shown in the figure. Therefore, the three dots 1', 2', 3' are possible locations of the bottom of the seat back. Connecting those three dots yields a path traversed by the bottom of the seat back along line or arc 251.

Figure 25A:
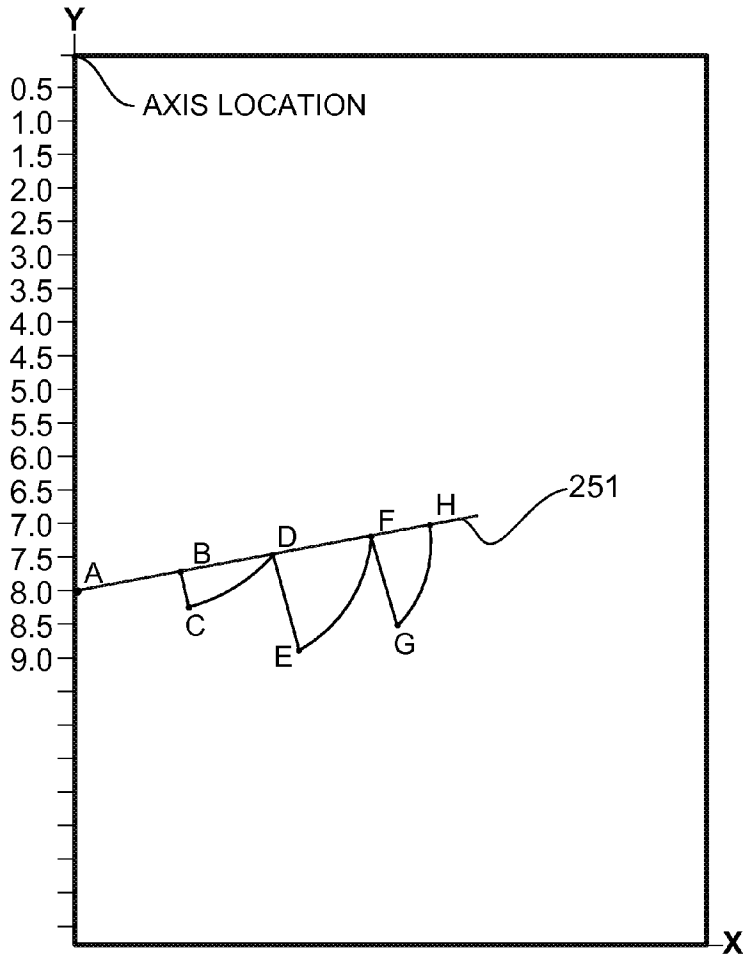

FIG. 10C is similar to FIG. 10B and illustrates a trajectory 251 of the seat back bottom that corresponds to the trajectory illustrated in FIG. 25A. Of course, the seated user's input controls the actual trajectory at any time, and the user can stop at any point and remain there, reverse path or continue.

In the example of FIG. 10C (and also with general reference to FIG. 25A), the distance from the hinge to the bottom of the seat back (which corresponds to distance 31 in FIG. 10A) is 8.0 inches, the initial axis location is at 0.0 and the bottom point of the seat back on the Y axis is 8.0 inches. The axis of rotation (the hinge) and the bottom of the seat back are attached and the Y axis gauges the vertical movement. The X axis is the horizontal path of the bottom edge of the seat back. The intervals on the Y axis are measured in inches. With the chair back axis starting at a resting point 0 on the Y axis and with 31, the length of portion of back-supporting surface below axis 8 inches in this example, it will rest at 8 on the Y axis and when the user pushes back it will travel the arc A-B. If the user presents a downward vertical or substantially vertical force to the seat back, it can travel down to 10 on the Y axis, the bottom edge of the seat back will travel from B to C, and then can rotate along the arc from C to D. The illustrated trajectories can end with the arc from G to H where the sitter is in an almost horizontal ante-recline position. Varying amounts of the user's vertical force over varying amounts of time related to user's backward force that causes seat back rotation results in different segments of the arcs being traveled and varied vertical drops. In FIG. 10C, the distance traveled is AB+BC+CD+DE+EF+FG+GH. The overall displacement however is illustrated as an essentially straight line path AH. No matter the path taken the overall displacement is a straight line from initial starting point of the bottom edge of the seat back to its final stopping point. The seat back travel is seamless and the vectors are not obvious to the sitter. What is obvious to the sitter is that there is a back support always present and that she either sub-consciously or consciously can increase the force of the bottom edge of the seat back into her back.

Note that the trajectories and composite paths of the bottom of the seat back and shown in FIGS. 24, 25, 25A, and 26, and other figures are intended to be schematic and illustrative. The actual trajectories and composite paths may be more or less gentle than as shown in the FIGS.

The varying of the orientation of the back-supporting surface 18 is based at least in part on a force exerted by the back of the user seated on the seating surface 22 as the seating surface 22 moves forward or backward in the direction of motion 26. The orientation of the back-supporting surface 18 can vary as the user leans back in the seat 10 to push the seating surface 22 forward, and away from the back glider, along the direction of motion 26. Additionally or alternatively, the orientation of the back-supporting surface 18 can vary as the user leans forward (or otherwise reduces the amount of force on the back-supporting surface 18) in the seat to allow the seating surface 22 to move backward toward the back glider, along the direction of motion 26.

Varying the orientation of the back-supporting surface 18 includes changing an included angle between the seating surface 22 and the back-supporting surface 18. For example, rotation of the back-supporting surface 18 about the hinge 46 (e.g., about a rotational axis parallel to the back-supporting surface 18 and parallel to the seating surface 22 can change the included angle between the seating surface 22 and the back-supporting surface 18. In some implementations, a force exerted by the upper back of the user on the upper portion 19 of the back-supporting surface 18 rotates the back-supporting surface 18 about the hinge 46.

As discussed above, varying the orientation of the back-supporting surface 18 also includes changing the position of the back-supporting surface 18 along the vertical axis 27. The force exerted by the user leaning back in the seat 10 to push the seating surface 22 away from the back-supporting surface 18 also acts to move the back-supporting surface 18 downward, in a direction toward the direction of motion 26. Thus, as the user leans back in the seat 10 to push the seating surface 22 away from the back-supporting surface 18, the back-supporting surface 18 undergoes both vertical or substantially vertical motion and rotational motion. The reverse movement by the user results in reverse vertical or substantially vertical and rotational motion to allow the seating surface 22 to move toward the back-supporting surface 18.

This relative change in positioning of the back-supporting surface 18 relative to the seating surface 22 can provide consistent support to the lumbar portion of the user's back as the user moves through a variety of reclining angles (e.g., from an upright seated position to a reclined or anteclinal position). For example, the lower portion 20 of the back-supporting surface 18 can remain in contact with the same point of the user's back as the user moves through various reclining angles. Additionally or alternatively, the combined vertical or substantially vertical and rotational motion of the back-supporting surface 18 can allow the upper portion 19 of the back-supporting surface 18 to provide consistent support to the upper portion of the user's back as the user moves through the variety of angles of inclination.

Varying the orientation of the back-supporting surface 18 can also include continuously varying the orientation of the back-supporting surface 18 as the seating surface 22 moves along the direction of motion 26. For example, the combined vertical or substantially vertical and rotational movement of the back-supporting surface 18 relative to the seating surface 22 is self-adjusting (e.g., through the balancing of the vertical and rotational forces exerted by the user on the back-supporting surface 18 and the force exerted by the user on the seating surface 22), allowing the user to make continuous minor adjustments to the sitting position and/or larger adjustments to the sitting position. By facilitating continuous minor adjustments to the sitting position, the seat 10 can facilitate burning more calories by the user, as compared to sitting passively. Additionally or alternatively, by facilitating continuous minor adjustments to the sitting position, the seat 10 can reduce the likelihood of injury resulting from prolonged periods of sitting (e.g., by enhancing blood flow to nourish the joints of the user and by motion of the joints which allows imbibition and exposure of the articular surfaces for synovial fluid nourishment). Additionally or alternatively, by facilitating continuous minor adjustments to the sitting position, the seat 10 can facilitate strengthening the user's anatomical core muscles while providing ergonomic support.

While certain implementations have been described, other implementations are possible.

In some implementations, while the seat pan has been described as being a single horizontal piece, other implementations are additionally or alternatively possible. As shown in FIG. 11, for example, a seat pan 21' can include an upper seat pan 60 and a lower seat pan 62. The lower seat pan 62 can be coupled to the seat glider 38 and angled parallel to the seat glider 38. The upper seat pan 60 can be coupled to the lower seat pan 62 and disposed in a substantially horizontal orientation during use.

In some examples, while the back-supporting surface has been described as a planar or contoured surface, other implementations are additionally or alternatively possible. As shown in FIG. 12, for example, a seat 10' can include a back-supporting surface 18' can include rollers 64 spanning at least a portion of the back-supporting surface 18', from a lower portion 20' of the back-supporting surface 18' to an upper portion 19' of the back-supporting surface 18'. Each roller 64 is substantially cylindrical and independently movable relative to each of the other rollers 64 such that movement of the back-supporting surface 18' can result in a rolling motion of the rollers 64 relative to the user's back to provide, for example, a massaging effect for the points of contact on the user's back. In some implementations, the rollers 64 can include surface features (e.g., ridges and/or bumps), which can further enhance the massaging effect on the user's back.

In some cases, while the support has been described as including wheels, other implementations are additionally or alternatively possible. For example, the support can include a plurality of legs for stationary contact with a floor surface. We use the term support (which we sometimes use interchangeably with the word "base") broadly to include, for example, any element that holds, is coupled to, is mounted on, is connected to, braces, or otherwise abuts the seating surface or the back-supporting surface or both. In some cases the support is stationary relative to the floor or a building or vehicle when the seat is in use.

In some examples, while the back-supporting surface and the seating surface have been described as movable under the power of a user, other implementations are additionally or alternatively possible. For example, one or more of the back-supporting surface and the seating surface can be movable through an external force, such as a force exerted by a motor. The use of external force to move the back-supporting surface and the seating surface can, for example, reduce the risk of chronic inflammation in users (e.g., individuals with some form of paralysis) who may otherwise be unable to move the back-supporting surface and/or the seating surface. Or a practitioner might use methods to control the various motions.

One or more of the back-supporting surface and the seating surface can be stopped along their respective directions of movement. In some implementations, the user can actuate a manual brake that stops movement of the back-supporting surface and/or the seating surface. In certain implementations, the user can actuate a brake to stop movement of the back-supporting surface or the seating surface, while the other one of the back-supporting surface or the seating surface remains movable. Braking the back-supporting surface or the seating surface or both can assist the user in tailoring the movement of the chair to achieve a particular therapeutic goal or allow the user to engage in movement as desired, while remaining stationary at other times, or both.

The chair is easy to manufacture and assemble. The construction can be modular making replacement of the seat pan or chair back or other parts easy.

The techniques that we have described here can be used on a wide variety of seating in addition to a stand-alone chair in a building, for example, chairs in cars, trucks, boats, airplanes, and other vehicles, outdoor seating, and ganged seating for more than one person, to name a few. The techniques can be used in treatment facilities, physical therapy clinics, chiropractic clinics, in home treatment, and in exercise equipment. Among other things, the techniques facilitate performing pelvic tilt exercises frequently prescribed by medical practitioners for spine problems.

The motion of the seat back up and down and the motion of the seat pan forward and backward can be achieved using a rollable mechanism, for example, of the kind used in tank treads and conveyor belts, in place of or in addition to slides and sliders.

There can be more than one location that defines the pivot axis around which the seat back pivots. For example, by using two j-bars, one to the left and one to the right of the center of the seat, rather than one in the center, the space behind the seat back could be unobstructed allowing the seat back to pivot back without being stopped by the j-bar.

The seat pan glider and the seat back glider ride on straight-line glides, but the gliders could be non-linear to enable the seat pan or the seat back or both to traverse non-linear paths.

A wide variety of other configurations could be used to support the back, provide the pivoting axis, permit the back to move vertically or substantially vertically, and to bias the back to rise vertically. For example, as shown in FIG. 33, the pivot axis for the seat back could be defined by two bearings respectively on left and right arm rests 461. At a location behind the seat back, each of the armrests includes a connecting point 462 that connects the arm rest through a seat pan connector 463 to a bearing 193 that is spring-loaded to bias the seat back to an upper vertical position. As shown in phantom, when the user rotates the seat back backward about the pivot axis 46 and bears down vertically on the seat back, the seat back can move vertically downward (as indicated by arrows a-b) as a result of a pivoting motion of the seat pan connector around the bearing 193. If the user reduces the downward force on the seat back, the spring-loaded bearing 193 causes the seat back to rise to its original position. While these motions are happening, the seat pan is free to move forward and backward independently as discussed earlier.

As shown in FIG. 34, in some implementations, two arms of the seat can be connected through spring-biased bearings 193 to vertical posts 197 the bottom ends of which are attached to the support. Again, the seat back can be rotated about pivot axis 46. At the same time, the seat back is free to pivot about the axis defined by bearings 193 which has the effect of permitting independent vertical motion of the seat back (a-b) the height of the back relative to the seat pan can be adjusted by providing a vertical adjustment mechanism in the posts 197. As before, the seat pan is free to move forward and backward.

In both FIGS. 33 and 34, the biasing of the back to return to its upper original position can be achieved not only by a torsion spring in the bearing 193, but also by an intrinsic springing in the seat pan (or seat guide or seat support) connector 463 (FIG. 33) or the vertical post 197.

In FIG. 33, the axis defined by the bearings 193 is relatively lower than it is in FIG. 34. As a result of this, the available vertical motion of the seat back (a-b) is relatively smaller in FIG. 33 then it is in FIG. 34, in which the pivot axis at bearings 193 is higher and the arc of the user's back goes down and forward, allowing for a larger span a-b.

In some implementations there can be a coupling between the seat back and the seat pan in addition to the coupling provided by the body of the user. When such a coupling is included, motion of the back-supporting surface can push the user away from the back-supporting surface or push the seat away from the back-supporting surface or both, or follow the user along the direction of motion of the user.

For example, as shown in FIGS. 35 and 36, a pin 222 can be mounted on and project rearward from the back of the seat pan 22. A free end 223 of the pin fits within a vertical slot 220 in the lower end of the front face of the seat back. As the seat back moves up and down, the pin can continue to ride within the slot 220. The pin provides a mechanical coupling between the seat back and the seat pan at times when the seat back is being rotated so that the bottom of the seat back is moving toward the seat pan. The free end of the pin need not be connected to the bottom end of the seat back, so that the sitter is free to slide the seat pan forward without rotating the seat back.

In some implementations, the mechanical coupling between the seat back and the seat pan need not be a pin. Rather, the seat back and seat pan can be configured so that they interact in a similar way without additional coupling elements. In some instances, the bottom of the seat back can be extended so that the front surface of the bottom of the seat back can contact the back end of the seat pan, without the use of the pin. When the user rotates the seat back and causes the seat back to glide downward, the bottom end of the seat back will push against the back end of the seat pan. As the seat back rotates up and along the direction of motion 26 it pushes the seat glider forward.

In some implementations, as shown in FIGS. 39A, 39B, and 39C, a T-bar 232 has one end 234 attached to the back of the seat pan, a bar 236 that passes through a slot 238 in the bottom of the seat back, and a cross piece 240. The seat back is free to ride up and down independently of the motion of the seat pan, because the bar 236 can pass freely within the slot 238. When the seat pan is glided forward sufficiently, the cross piece 240 will pull the bottom of the seat back forward. When the seat pan is then glided backward, the cross piece 240 releases the bottom of the seat back and allows it to be moved back and forth by the user within a range of motion, without obstruction by the motion of the seat pan. In some instances, the coupling between the seat back and the seat pan can be a chain that can be adjusted by taking up links of the chain to shorten the chain. When slack in the chain is taken up as the seat pan is glided forward, the seat pan pulls the bottom of the seat back forward.

In implementations in which the seat back (with or without a coupling) pushes and pulls the seat pan or seat glider, the lower edge of the seat back need not touch the user's lumbar area but instead can push into the seat glider, which tends to reduce involvement of hamstring muscles both statically and dynamically. In this scenario, instead of the vertebrae pivoting at the facette joints there is shear stress tending toward a retrolisthesis and placing tension on the joint capsule causing capsular damage and even radiculopathy. To reduce this effect, support such as a lumbar bolster can be integrated into the seat back or as a separate piece.

In some instances, the seat back and the seat pan need not be coupled by a J-bar. As shown in FIG. 40, for example, the seat guide 30 could include two slots 288 that accommodate two arms 285 (one on the left and one on the right) and permit the arms to glide up and down within the two slots. The two arms 285 can project from two supports 283 that are held on the seat back in a way that enables them to rotate about a pivoting mechanism 282 or enables the seat back to rotate about a pivoting mechanism 282 relative to the supports 283 or a combination of the two. The two supports 283 can rest within channels 286 in the seat back when the seat back has not been rotated. A spring 284 (or two springs, one on each side of the seat) is coupled between an upper supporting bracket attached to the seat guide and a lower supporting bracket attached to the bottom end of the arm 285. The spring urges the seat back to move up vertically or substantially vertically if the user has forced the seat back downward and then releases it. Or the two supports 283 can be slotted, and they can ride up and down on stationary arms 285.

In some implementations, a coupling between the seat back and the seat pan can be motorized, so that the back-supporting surface is movable in response to a motorized force exerted on it or the seat glider is movable in response to a motorized force exerted on the seat glider or to another external force other than the user.

In some implementations, as shown in FIG. 41, a support of the seat need not include a typical central pedestal column supported on a star cluster of casters and including a gas cylinder to enable the seat pan and seat back to be raised and lowered relative to the floor. In some cases, the cantilevered support 302 could be provided that includes a floor loop 304 that rides on a set of casters or wheels 306 and a pair of beams 308, 310 that couple the front ends of the loop 304 to a shelf 312 above. The shelf is therefore cantilevered above the floor. Any of the seat guide, seat glider, seat back guide, and seat back glider structures and arrangements described above, and others (not shown in FIG. 41), could be mounted on the shelf 312, the beams 308, 310, or combinations of them. A mechanism would be provided to permit raising and lowering those components relative to the floor. The mechanism could be a gas cylinder, a jack such as a screw mechanism or a scissor mechanism or a bottle type jack mechanism, for example.

The invention claimed is:

1. A seat comprising:

a stationary base to rest on a floor;

a seating surface supported on the base, a back-supporting surface supported on the base; and a rotational mechanism that enables the back-supporting surface to rotate about an axis that is higher from the floor than is the seating surface, the seating surface being movable on the base along a path of motion toward and away from a vertical plane that contains the axis, the axis having an original starting position when the seating surface is not occupied, the axis being movable from its starting position along a path of motion in response to a force exerted on the back-supporting surface when a sitter is sitting on the seating surface, at least part of the path of motion of the axis not tracking the path of motion of the seating surface, and simultaneously the seating surface being movable on the base along the path of motion toward and away from the vertical plane that contains the axis in response to a force exerted when the sitter is sitting on the seating surface, at least part of the motion of the seating surface toward and away from the vertical plane being independent of any component of motion of the axis that is aligned with the path of motion of the seating surface, at least one location on the back-supporting surface following a path of rotation about the axis, the path of rotation having a radius centered on the axis, the radius of the path remaining unchanged during at least a portion of the motion of the axis.

2. The seat of claim 1, wherein the back-supporting surface is movable up and down during use of the seat and biased to tend to move up in its motion along a vertical path, a lower portion of the back-supporting surface being movable to enable the lower portion of the back-supporting surface to move along the length of the path of motion of the seating surface as it moves on the base, in response to force exerted on the back-supporting surface as the seating surface moves.

3. The seat of claim 2 in which the back-supporting surface is movable to enable the lower portion to move along the path of motion in response to force exerted on the back-supporting surface as the seating surface remains stationary.

4. The seat of claim 2, wherein the back-supporting surface is movable to enable the lower portion to move along the path of motion for a maximum distance of between about 22.8 cm and about 33 cm as the seating surface moves.

5. The seat of claim 1, wherein the seating surface is movable while the back-supporting surface remains stationary.

6. The seat of claim 1, wherein the back-supporting surface is movable to change an included angle between the seating surface and the back-supporting surface as the seating surface moves.

7. The seat of claim 6, wherein a minimum included angle between the seating surface and the back-supporting surface is between about 90 degrees and about 100 degrees.

8. The seat of claim 6, wherein a maximum included angle between the seating surface and the back-supporting surface is between about 140 degrees and about 160 degrees.

9. The seat of claim 6, wherein a minimum included angle between the path and the back-supporting surface is between about 80 degrees and about 90 degrees and a maximum included angle between the path and the back-supporting surface is between about 140 degrees and about 160 degrees.

10. The seat of claim 1, wherein the seating surface is biased to move toward the back-supporting surface.

11. The seat of claim 10, wherein the seating surface is biased to move toward the back-supporting surface under the force of gravity.

12. The seat of claim 1, wherein the axis is parallel to the back-supporting surface and parallel to the seating surface.

13. The seat of claim 12, wherein the axis and the motion of the seating surface are non-convergent.

14. The seat of claim 12 in which the axis is behind the back-supporting surface.

15. The seat of claim 12, wherein the back-supporting surface is movable in a direction perpendicular or substantially perpendicular to the seating surface.

16. The seat of claim 15, wherein movement of the back-supporting surface in the direction perpendicular or substantially perpendicular to the seating surface changes a distance between the lower portion of the back-supporting surface and the seating surface.

17. The seat of claim 15, wherein the back-supporting surface is biased to move away from the seating surface in the direction perpendicular or substantially perpendicular to the seating surface.

18. The seat of claim 15, further comprising a spring, the spring biasing the back-supporting surface to move away from the seating surface in the direction perpendicular or substantially perpendicular to the seating surface.

19. The seat of claim 12, wherein the axis of rotation of the back-supporting surface is between a lower portion and an upper portion of the back-supporting surface.

20. The seat of claim 1, wherein the motion of the seating surface is oblique to the seating surface.

21. The seat of claim 20, wherein the motion of the seating surface is inclined in a direction away from the back-supporting surface.

22. The seat of claim 1, wherein an included angle between the seating surface and the motion of the seating surface is constant as the seating surface moves.

23. The seat of claim 1, in which at least part of the back-supporting surface is movable relative to the base and the seating surface is movable relative to the base, the seating surface being slidably or rollably movable relative to the base.

24. The seat of claim 23, comprising a spacer disposed between the seating surface and the base, the spacer being fixed relative to the seating surface and slidably or rollably movable relative to the base, wherein the spacer spans an included angle between the motion of the seating surface and the base.

25. The seat of claim 1, wherein the base comprises wheels to move the seat on the floor.

26. The seat of claim 1, wherein the base is adjustable in a direction toward and away from the floor.

27. The seat of claim 1, wherein the base comprises a gas cylinder actuatable to move the support toward and away from the floor.

28. The seat of claim 1 comprising:

at least part of the back-supporting surface and the seating surface being independently movable relative to one another, the back-supporting surface being movable vertically and biased upwardly in its vertical motion, the back-supporting surface being movable (a) to push the user away from the back-supporting surface or (b) to push the seating surface away from the back-supporting surface, or (c) to cause a portion of the back-supporting surface to follow, without pushing, the user substantially along the motion of the seating surface.

29. The seat of claim 28 comprising the seating surface being movable along the motion with respect to the stationary base.

30. The seat of claim 28, wherein the back-supporting surface is movable in response to a force exerted on the back-supporting surface by the user.

31. The seat of claim 28, wherein the back-supporting surface is movable in response to a force exerted on the back-supporting surface.

32. The seat of claim 28, wherein the back-supporting surface is movable in a direction perpendicular or substantially perpendicular to the seating surface.

33. The seat of claim 28, wherein the back-supporting surface comprises a lower portion nearer the seating surface and an upper portion that is farther from the seating surface, and the back-supporting surface is rotatable about the axis between the upper and lower portions of the back-supporting surface and substantially parallel to the seating surface.

34. The seat of claim 33, wherein the axis is movable in a direction perpendicular or substantially perpendicular to the seating surface to change a point of contact between a back of the user and the lower portion of the back-supporting surface.

35. The seat of claim 33, wherein the axis is movable in a direction perpendicular or substantially perpendicular to the seating surface to change a point of contact between a back of the user and the upper portion of the back-supporting surface.

36. The seat of claim 28, wherein the vertical position of the back-supporting surface relative to the seating surface is adjustable.

37. The seat of claim 28, comprising the seating surface being slidably or rollably mounted on a seat guide that is fixed with respect to the base and the horizontal distance of the seat back from the seat guide being adjustable.

38. The seat of claim 1 comprising a mechanism to slow or stop motion of the back-supporting surface.

39. The seat of claim 1 comprising a device to control a path of the motion of the back-supporting surface.

40. The seat of claim 1 comprising a device to control the motion of the seating surface.

41. The seat of claim 1 comprising a mechanism to enable vertical adjustment of a position of the back-supporting surface relative to the seating surface.

42. The seat of claim 1 comprising a mechanism to enable the seating surface to be adjustable horizontally relative to the back-supporting surface.

43. The seat of claim 1 comprising a mechanism to adjust a vertical position of the back-supporting surface above the floor.

44. The seat of claim 1 comprising the back supporting surface being supported to enable up and down motion of the back-supporting surface independently of the motion of the seating surface, the back-supporting surface being biased to move up.

45. The seat of claim 44 in which the supporting mechanism is biased to move the back-supporting surface up to a rest position when no force is being applied to move the back-supporting surface down.

46. The seat of claim 44 in which the supporting mechanism provides a resting vertical position for the back-supporting surface, and the resting vertical position can be adjusted up and down manually.

47. The seat of claim 1 comprising the back-supporting surface being supported so that, while the seating surface moves toward and away from the back-supporting surface, up and down motion of the back-supporting surface, and rotation of the back-supporting surface about an axis are simultaneously enabled.

48. The seat of claim 47 in which the axis of the back-supporting surface is horizontal and is higher than the seating surface.

49. The seat of claim 47 in which, when the seat is not occupied, the back-supporting surface is biased to rise to a rest position vertically and to rotate to an upright resting orientation.

50. The seat of claim 1 comprising the back-supporting surface being supported to enable unconstrained rotation of the back-supporting surface about an axis that is horizontal and is perpendicular or substantially perpendicular to and above the seating surface.

51. The seat of claim 50 also comprising a mechanism that stops the rotation of the back-supporting surface at the upright position when it tends to rotate to the upright position.

52. The seat of claim 50 in which the back-supporting surface has a center of gravity above the axis of rotation.

53. The seat of claim 50 comprising a rotation control mechanism that permits the unconstrained rotation through a range of rotation and stops the back-supporting surface from the unconstrained rotation beyond a predetermined angle of rotation.

54. The seat of claim 50 in which the back-supporting surface is mounted so that its center of gravity is forward of the axis so that when the seat is not occupied, the back-supporting surface tends to rotate under the influence of gravity to an upright position.

55. The seat of claim 1 in which the seating surface is not biased to move toward the back-supporting surface.

56. The seat of claim 1 in which the rotational mechanism is coupled to the base to prevent backward motion of the axis of rotation relative to the base when a sitter exerts a force to move the axis of rotation from its starting position.

57. The seat of claim 1 in which the axis is movable linearly from its starting position in response to a force when a sitter is sitting in the seating surface.

58. The seat of claim 1 in which the back-supporting surface is enabled to rotate in response to motion of a person sitting on the seating surface.

59. The seat of claim 1 in which the back-supporting surface is enabled to rotate in response to an external force.

60. The seat of claim 59 in which the external force is manual.

61. A method of supporting a user above a floor, the method comprising:

moving a seating surface back and forth along the path of motion toward and away from a back-supporting surface in response to a force applied while a sitter is sitting on the seating surface;

rotating the back-supporting surface about an axis such that the axis (a) is higher from the floor than the seating surface and (b) has an original starting position when the seating surface is not occupied, moving the axis from the starting position in response to a force at least part of the path of motion of the axis not tracking the path of motion of the seating surface, at least part of the moving of the seating surface toward and away from the vertical plane being independent of any component of the moving of the axis that is aligned with the path of motion of the seating surface, and rotating at least one location on the back-supporting surface along a path of rotation about the axis, the path of rotation having a radius centered on the axis, and the radius of the path of rotation remaining unchanged during at least a portion of the motion of the axis in response to a force exerted while the sitter is sitting on the seating surface and the seating surface is being moved back and forth along the path of motion toward and away from the back-supporting surface.

62. The method of claim 61, comprising varying orientation of the back-supporting surface in response to a force exerted on the back-supporting surface as the seating surface moves back and forth.

63. The method of claim 61, comprising varying orientation of the back-supporting surface in response to a force exerted on the back-supporting surface when the seating surface is not moving.

64. The method of claim 61, comprising varying orientation of the back-supporting surface to change the included angle between the seating surface and the back-supporting surface.

65. The method of claim 64, wherein changing the included angle between the seating surface and the back-supporting surface comprises rotating the back-supporting surface about an axis parallel to the back-supporting surface and parallel to the seating surface.

66. The method of claim 64, wherein changing the included angle between the seating surface and the back-supporting surface comprises the seating surface moving back and forth.

67. The method of claim 61, wherein varying the orientation of the back-supporting surface comprises continuously varying the orientation of the back-supporting surface as the seating surface moves along the path.

68. The method of claim 61, comprising varying the orientation of the back-supporting surface including changing a distance, parallel to the path, between the seating surface and portion of the back-supporting surface closest to the seating surface.

69. The method of claim 68 in which the back-supporting surface can move vertically or substantially vertical and the seating surface is biased to move toward the seat back.

70. The method of claim 61 in which the rotating of the back-supporting surface causes a portion of the sitter's spine that is below the axis of rotation of the back-supporting surface to move forward to rotate about an internal pivot axis in the sitter's body relative to the legs of the sitter.

71. The method of claim 70 in which the internal pivot axis passes through the hips of the user.

72. The method of claim 70 in which the internal pivot axis passes through a location in the sitter's body that is higher up along the spine than the hips.

73. A seat comprising:

a stationary base to rest on a floor;

a seating surface supported on the base, a back-supporting surface supported on the base; and a rotational mechanism that enables the back-supporting surface to rotate about an axis that is higher from the floor than is the seating surface, the axis having an original starting position when the seating surface is not occupied, the axis being movable from its starting position in response to a force exerted by a sitter when sitting in the seating surface without taking the sitter's hands away from another activity, and simultaneously while the axis is movable from its starting position in response to the force exerted by the sitter, the seating surface being movable back and forth along a path of motion toward and away from the back-supporting surface in response to a force exerted when the sitter is sitting in the seating surface, at least part of the motion of the seating surface toward and away from the vertical plane being independent of any component of motion of the axis that is aligned with the path of motion of the seating surface, at least one location on the back-supporting surface following a path of rotation about the axis, the path of rotation having a radius centered on the axis, the radius of the path remaining unchanged during at least a portion of the motion of the axis.

74. The seat of claim 73 in which the back-supporting surface is enabled to rotate in response to motion of a person sitting on the seating surface.

75. The seat of claim 73 in which the back-supporting surface is enabled to rotate in response to an external force.

76. The seat of claim 75 in which the external force is manual.

* * * * *